US010071276B2

(12) United States Patent
Vorozilchak et al.

(10) Patent No.: US 10,071,276 B2
(45) Date of Patent: Sep. 11, 2018

(54) WEIGHT LIFTING BENCH

(71) Applicant: Maxx Bench, Wilkes Barre, PA (US)

(72) Inventors: David Vorozilchak, Shavertown, PA (US); James J. Lennox, Shickskinny, PA (US); Kenneth Brown, Hamburg, NY (US)

(73) Assignee: MAXX BENCH

( * ) Notice: Subject to any disclaimer, the term of this patent is extended or adjusted under 35 U.S.C. 154(b) by 251 days.

(21) Appl. No.: 15/200,517

(22) Filed: Jul. 1, 2016

(65) Prior Publication Data

US 2017/0028246 A1 Feb. 2, 2017

Related U.S. Application Data

(60) Provisional application No. 62/187,364, filed on Jul. 1, 2015, provisional application No. 62/195,106, filed
(Continued)

(51) Int. Cl.
*F15B 1/02* (2006.01)
*A63B 21/078* (2006.01)
(Continued)

(52) U.S. Cl.
CPC ..... *A63B 21/0783* (2015.10); *A63B 21/078* (2013.01); *A63B 21/0724* (2013.01); *A63B 21/4029* (2015.10); *A63B 24/0087* (2013.01); *A63B 21/0083* (2013.01); *A63B 21/0087* (2013.01); *A63B 2071/0081* (2013.01); *A63B 2210/50* (2013.01); *A63B 2210/56* (2013.01); *A63B 2220/30* (2013.01);
(Continued)

(58) Field of Classification Search
CPC ... A64B 21/0783; F16K 15/183; F15B 1/021; F15B 2211/212
USPC ..... 137/539, 535
See application file for complete search history.

(56) References Cited

U.S. PATENT DOCUMENTS 3,905,496 A 9/1975 Reeder
4,995,130 A 2/1991 Hahn et al.
(Continued)

FOREIGN PATENT DOCUMENTS

EP 0214328 3/1987

OTHER PUBLICATIONS

Corresponding International Search Report and Written Opinion for PCT/US2016/040685 dated Sep. 16, 2016.

*Primary Examiner* — F. Daniel Lopez
*Assistant Examiner* — Daniel Collins
(74) *Attorney, Agent, or Firm* — The Belles Group, P.C.

(57) ABSTRACT

A hydraulic cylinder assembly for operating a weight lifting bench and other equipment. The hydraulic cylinder assembly comprises a hydraulic cylinder containing a hydraulic fluid, an accumulator containing a pressurized compressible fluid, and a flow control valve assembly interposed in a flow path therebetween. The flow control valve includes an axially reciprocating piston defining a flow control orifice and an axially movable plunger received in the orifice. Movement of the plunger operates to engage and open a ball check valve which in turn opens the flow path allowing hydraulic fluid to flow from the hydraulic cylinder to the accumulator. The working end may be stepped and positionable between first and second axial positions relative to the orifice to define first and second flow areas via movement of the plunger. Reciprocating movement of the piston opens and closes the flow path.

24 Claims, 64 Drawing Sheets

Related U.S. Application Data on Jul. 21, 2015, provisional application No. 62/254, 755, filed on Nov. 13, 2015.

(51) Int. Cl.

| | |
|---|---|
| ***A63B 21/072*** | (2006.01) |
| ***A63B 24/00*** | (2006.01) |
| ***A63B 21/00*** | (2006.01) |
| *A63B 21/008* | (2006.01) |
| *A63B 71/00* | (2006.01) |

(52) U.S. Cl.

CPC ..... *A63B 2220/34* (2013.01); *A63B 2220/56* (2013.01); *A63B 2225/09* (2013.01); *A63B 2225/093* (2013.01); *F15B 2211/212* (2013.01)

(56) References Cited

U.S. PATENT DOCUMENTS

| | | | |
|---|---|---|---|
| 5,125,884 | A | 6/1992 | Weber et al. |
| 5,141,480 | A | 8/1992 | Lennox et al. |
| 5,281,193 | A | 1/1994 | Colbo, Jr. |
| 6,689,027 | B1 | 2/2004 | Gardikis, Jr. |
| 6,746,379 | B1 | 6/2004 | Brawner |
| 8,066,622 | B2 | 11/2011 | Kim |
| 2004/0162200 | A1 | 8/2004 | Brawner |
| 2006/0135324 | A1 | 6/2006 | Rullestad et al. |
| 2009/0203505 | A1 | 8/2009 | Kroll et al. |
| 2011/0172066 | A1 | 7/2011 | Roppolo |

WEIGHT LIFTING BENCH

CROSS-REFERENCE TO RELATED APPLICATIONS

The present application claims the benefit of priority to U.S. Provisional Application No. 62/187,364 filed Jul. 1, 2015, U.S. Provisional Application No. 62/195,106 filed Jul. 21, 2015, and U.S. Provisional Application No. 62/254,755 filed Nov. 13, 2015; the entireties of which are all incorporated herein by reference.

BACKGROUND

The present invention relates to exercise equipment, and more particularly to an improved and safer weight lifting bench.

The present invention relates to improvements for a self-spotting and adjustable weight bench that allows weight lifters to adjust their positioning while remaining on the weight training equipment, and also remove themselves from heavy weights and a high risk of injury if fatigue prevents continuation of the exercise. Weight training is performed to develop the strength and size of skeletal muscles. Weight lifters use the gravity force of weight, in the form of barbells and dumbbells, to oppose the force generated by muscle through concentric or eccentric contraction. Weight training uses a variety of specialized equipment for users to target specific muscle groups with different types of movement.

While weight lifting, it is common to push oneself to a limit of fatigue that prevents returning the barbell to the rack. At this point in a workout, the weight lifter is at a serious risk for injury or even death. However, even though weight lifters take this into account, it is common for weightlifters to workout alone and without a "spotter" or assistance of a work out companion.

In addition to safety concerns with traditional equipment, adjustability is cumbersome and problematic. It is beneficial for weight training equipment to offer adjustability to accommodate different size users and training with different heights, angles, and strengths. When muscles are forced to contract at different angles, additional muscle fibers are incorporated into the workout, which increases the potential for muscular growth. For a large muscle group, such as the chest, the muscles must be trained from different angles to involve fibers from all parts of the muscle. This type of training builds stronger, fuller muscles. With traditional equipment, weightlifters must put the weight down, get off the equipment, adjust the equipment manually, get back on the equipment, pick the weight back up, and start the exercise again from a different position. The time wasted adjusting the equipment makes the workout inefficient.

It is further desirable to provide a safe device which is mechanically simple, easy to operate, non-compromising to traditional weight training exercises, and extremely functional for weight training.

A safe and convenient weight lifting bench is desirable.

SUMMARY

A weight lifting bench according to the present disclosure is provided which incorporates various features for safe and convenient operation in addition to a flexible user-changeable configuration adapted for performing a variety of weight-lifting or exercise routines.

According to one aspect, a hydraulic cylinder assembly includes: a hydraulic cylinder containing a hydraulic fluid; an accumulator in fluid communication with the hydraulic cylinder, the accumulator containing a pressurized compressible fluid; and a flow control valve assembly interposed in a flow path between the hydraulic cylinder and the accumulator, the flow control valve configured and operable to control flow of the hydraulic fluid exchanged between the hydraulic cylinder and accumulator; the flow control valve including an axially reciprocating piston defining a flow control orifice and an axially movable plunger having an operating end and an opposing working end, the working end being received in the flow control orifice and positionable between a first axial position and a second axial position relative to the flow control orifice. The working end of the plunger defines a first flow area when the plunger is in the first axial position and a second flow area smaller than the first flow area when the plunger is in the second axial position.

According to another aspect, a hydraulic cylinder assembly includes: a hydraulic cylinder containing a hydraulic fluid; an accumulator in fluid communication with the hydraulic cylinder, the accumulator containing a pressurized compressible fluid; a block manifold disposed between the hydraulic cylinder and accumulator, the block manifold comprising an axial central bore defining a centerline, a hydraulic cylinder port fluidly coupling the central bore to the hydraulic cylinder, and an accumulator port fluidly coupling the central bore to the accumulator, the bore and ports collectively forming a hydraulic fluid flow path between the hydraulic cylinder and the accumulator; a check valve disposed in the central bore and comprising an annular valve seat and a check ball biased into removable engagement with the valve seat by a check spring; a reciprocating piston disposed in the central bore and axially movable between a first proximal position nearest the check valve and a second distal position farthest from the check valve, the piston including a flow control orifice and internal flow control cavity in fluid communication with the flow control orifice; a plunger disposed in the central bore and axially movable between first and second axial positions, the plunger having an operating end and an opposing working end inserted through the flow control orifice and engageable with the check ball. Moving the plunger from a first axial position to a second axial position causes the working end of the plunger to disengage the check ball from the valve seat to open the flow path from the hydraulic cylinder to the accumulator.

A method for operating a hydraulic cylinder assembly is provided. The method includes: providing a hydraulic cylinder assembly including a hydraulic cylinder containing a hydraulic fluid, an accumulator in fluid communication with the hydraulic cylinder and containing a compressible fluid, and a flow control valve assembly interposed in a hydraulic fluid flow path between the hydraulic cylinder and the accumulator, the flow control valve assembly including a reciprocating piston, a plunger, and a check valve collectively forming an open flow path between the hydraulic cylinder and accumulator; engaging a spring-biased check ball with an annular valve seat of the check valve to form a closed flow path; moving the plunger from a first axial position to a second axial position; displacing and disengaging the check ball from the valve seat with the plunger; and opening the flow path via unseating the check ball wherein hydraulic fluid flows from the hydraulic cylinder to the accumulator.

BRIEF DESCRIPTION OF THE DRAWINGS

The features of the exemplary embodiments will be described with reference to the following drawings where like elements are labeled similarly, and in which:

FIGS. 9A, 9B, and 9C show sequential side views of an embodiment of a portable flat bench pad assembly without attached weight rack in the process of the bench descending after actuating the foot pedal, in which FIG. 9A shows a first bench position, FIG. 9B shows a second bench position, and FIG. 9C shows a third bench position;

FIGS. 65A, 65B, 65C, and 65D are sequential side cross sectional views of the flow control valve assembly taken from FIG. 64 in various stages of operation, in which FIG. 65A shows a first position of the valve assembly, FIG. 65B shows a second position thereof; FIG. 65C shows a third position thereof; and FIG. 65D shows a fourth position thereof;

All drawings are schematic and not necessarily to scale. Parts given a reference numerical designation in one figure may be considered to be the same parts where they appear in other figures without a numerical designation for brevity unless specifically labeled with a different part number and/or described herein. Any reference to whole figure numbers (e.g. FIG. 1) which are comprised of multiple sub-parts (e.g. 1A, 1B, etc.) shall be construed as a reference to all sub-parts unless indicated otherwise.

DETAILED DESCRIPTION

Figure 1:
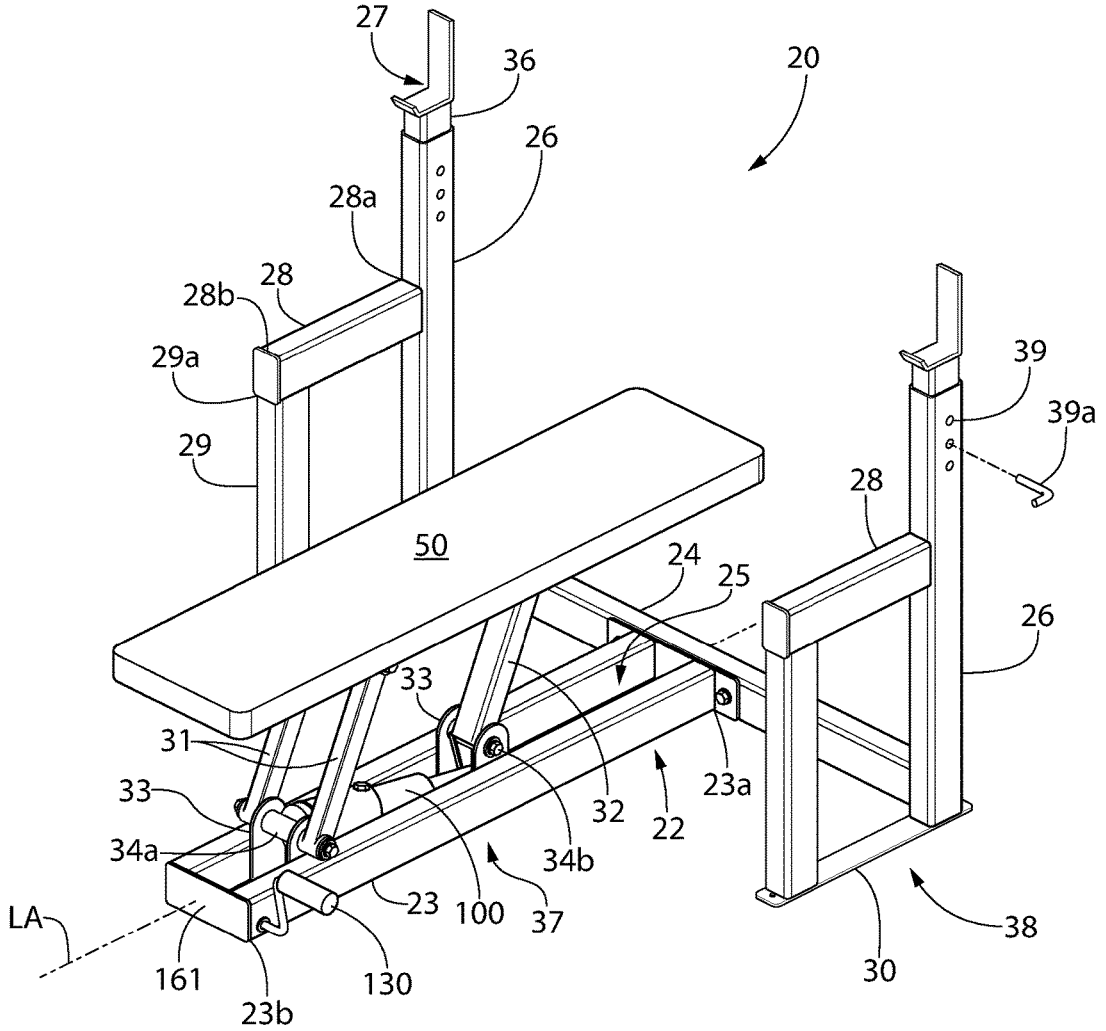
FIG. 1 is a front perspective view of an embodiment of a flat weight lifting bench with automatic bench return and bench descent control mechanisms according to the present disclosure including a bench pad assembly and attached weight rack.
Figure 2:
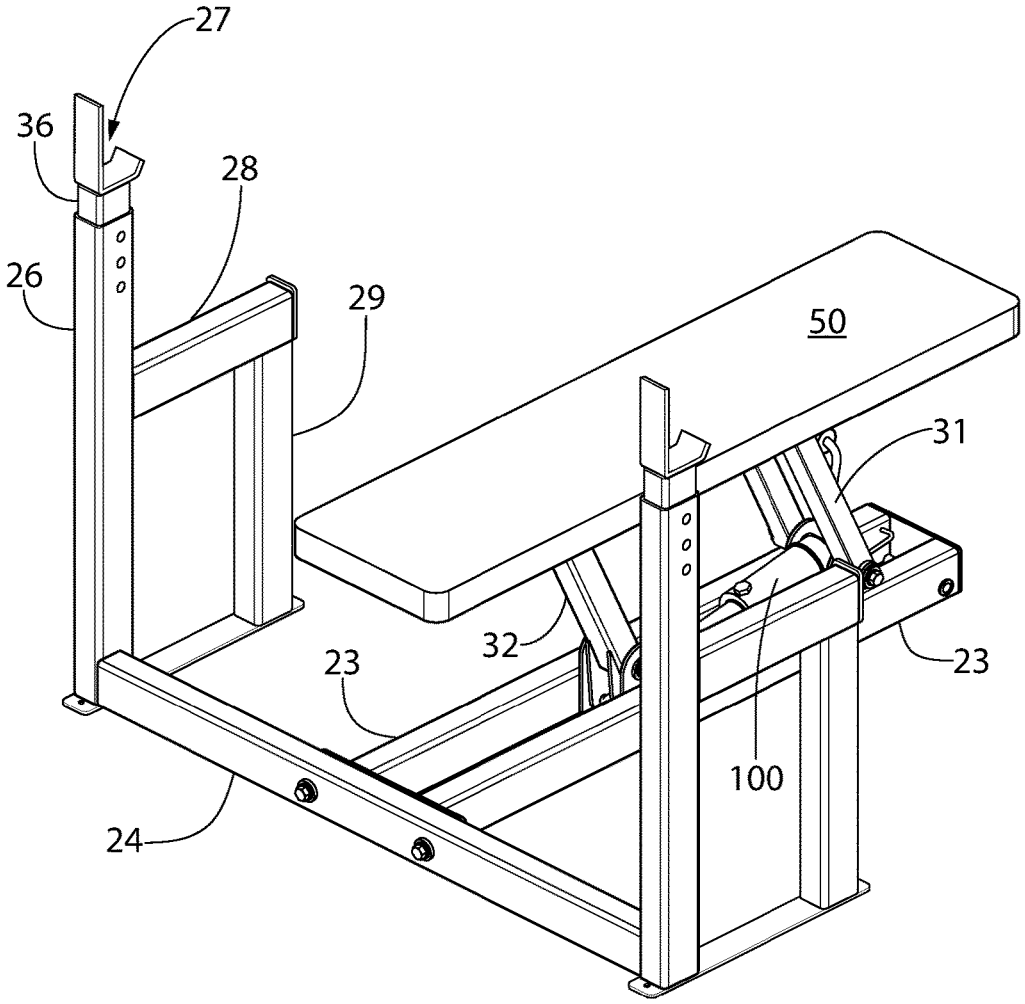
FIG. 2 is a rear perspective view thereof.
Figure 3:
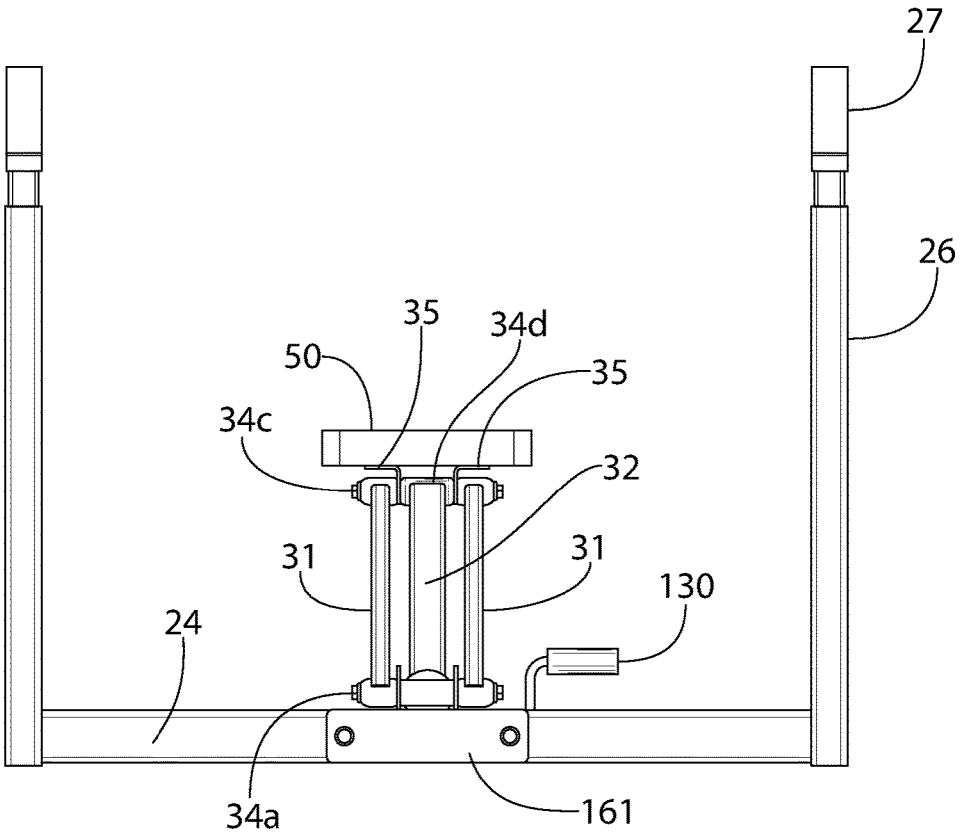
FIG. 3 is a front view thereof.
Figure 4:
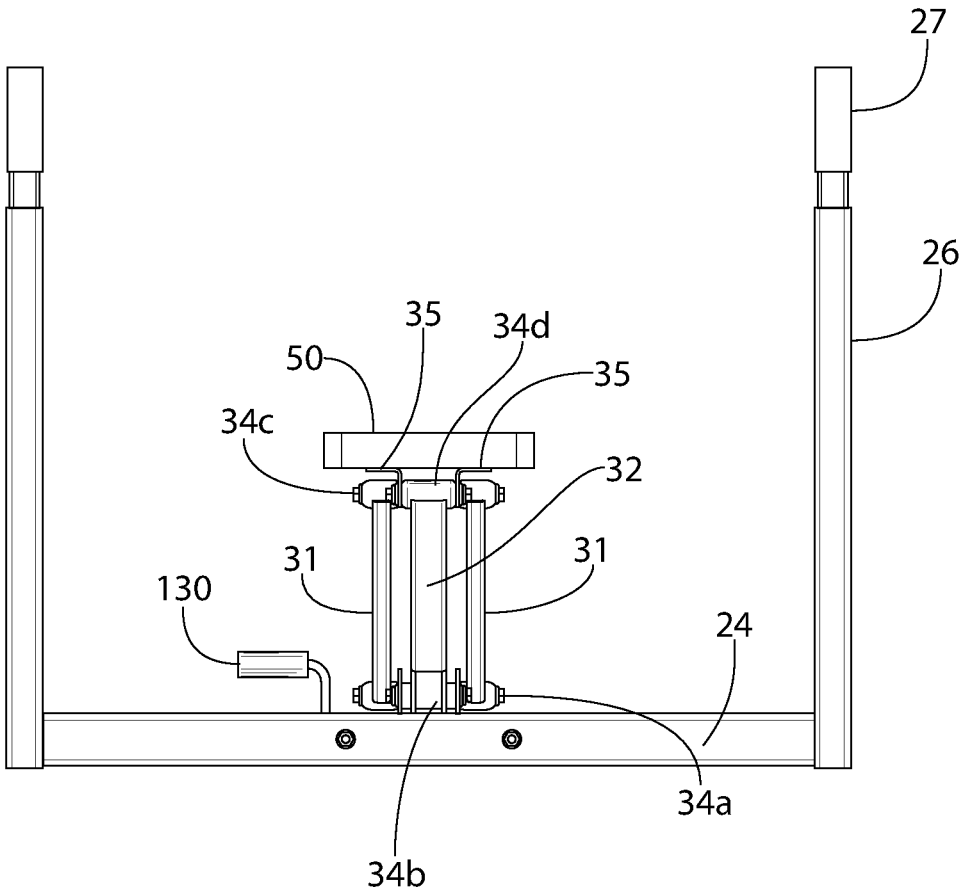
FIG. 4 is a rear view thereof.
Figure 5A:
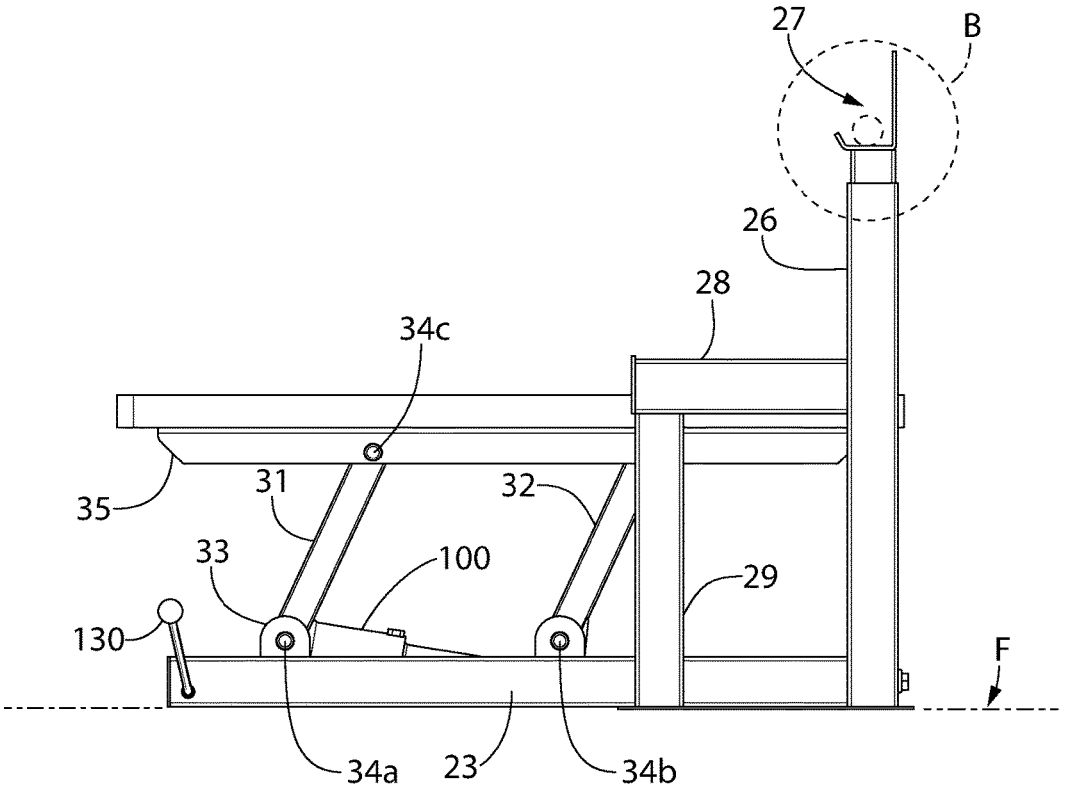
FIG. 5A is a first side view thereof showing the bench in a first position.
Figure 5B:
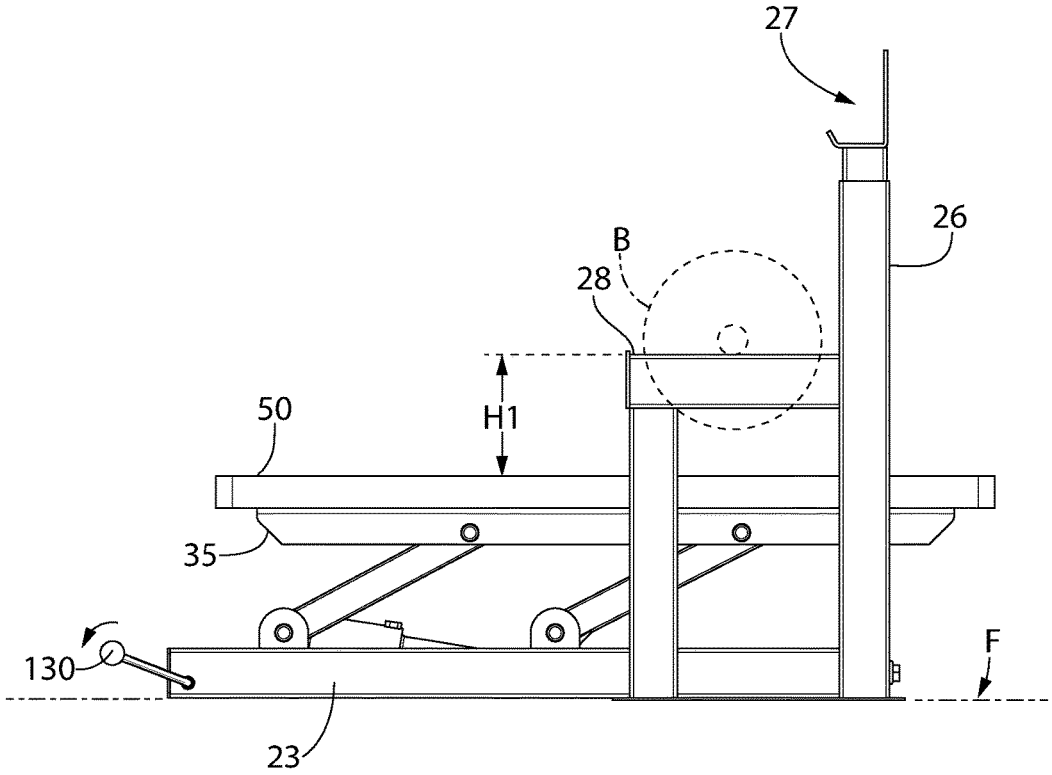
FIG. 5B is the first side view thereof showing the bench in a second position.
Figure 6:
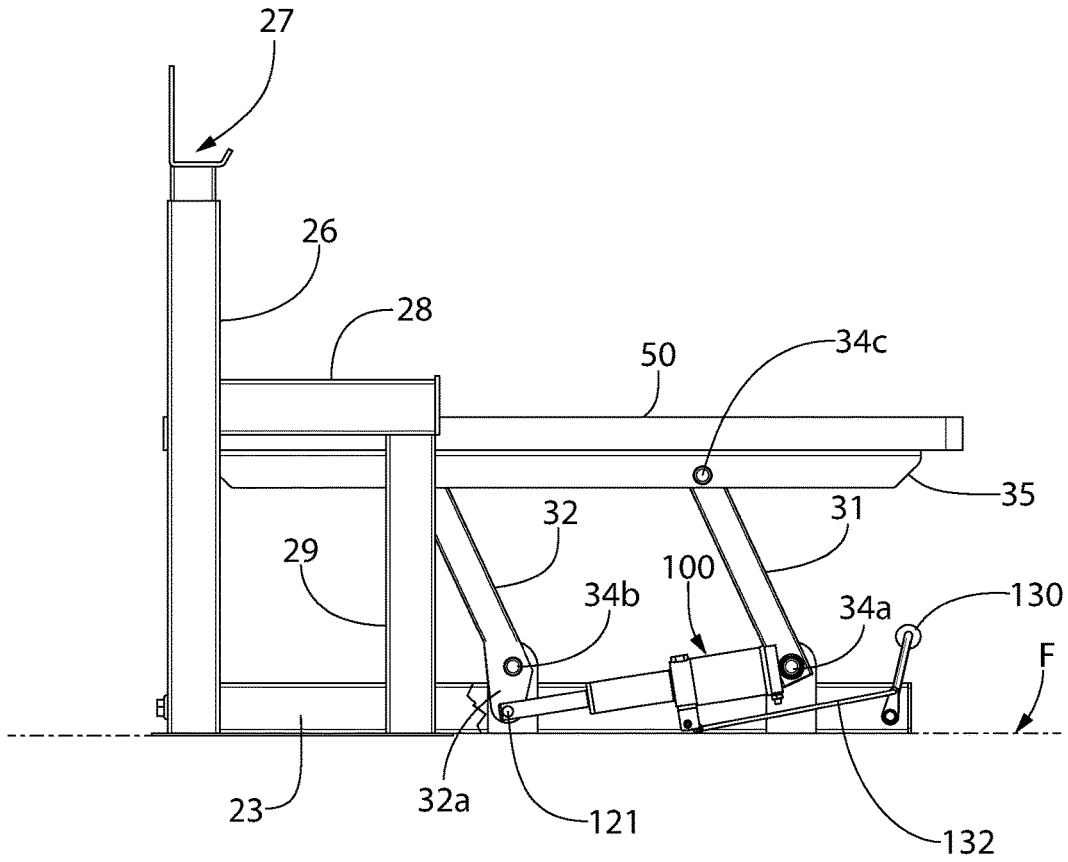
FIG. 6 is a second side view thereof.
Figure 7:
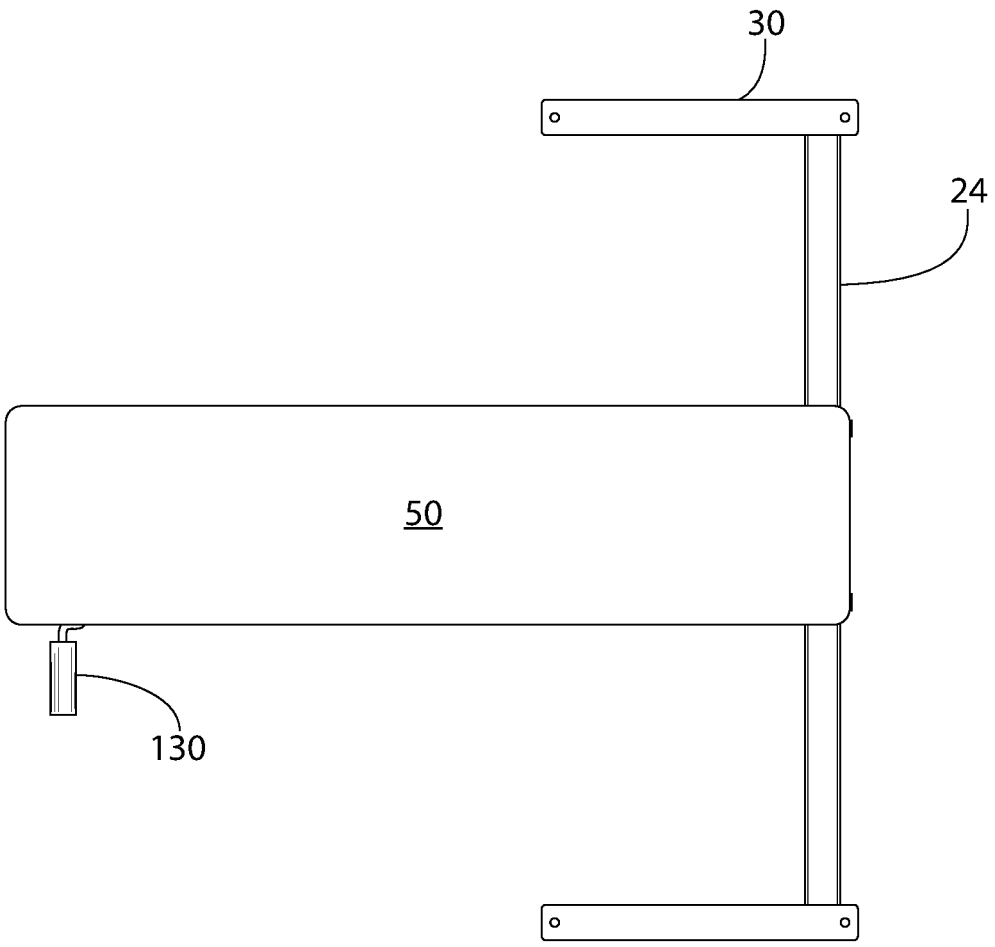
FIG. 7 is a top plan view thereof.
Figure 8:
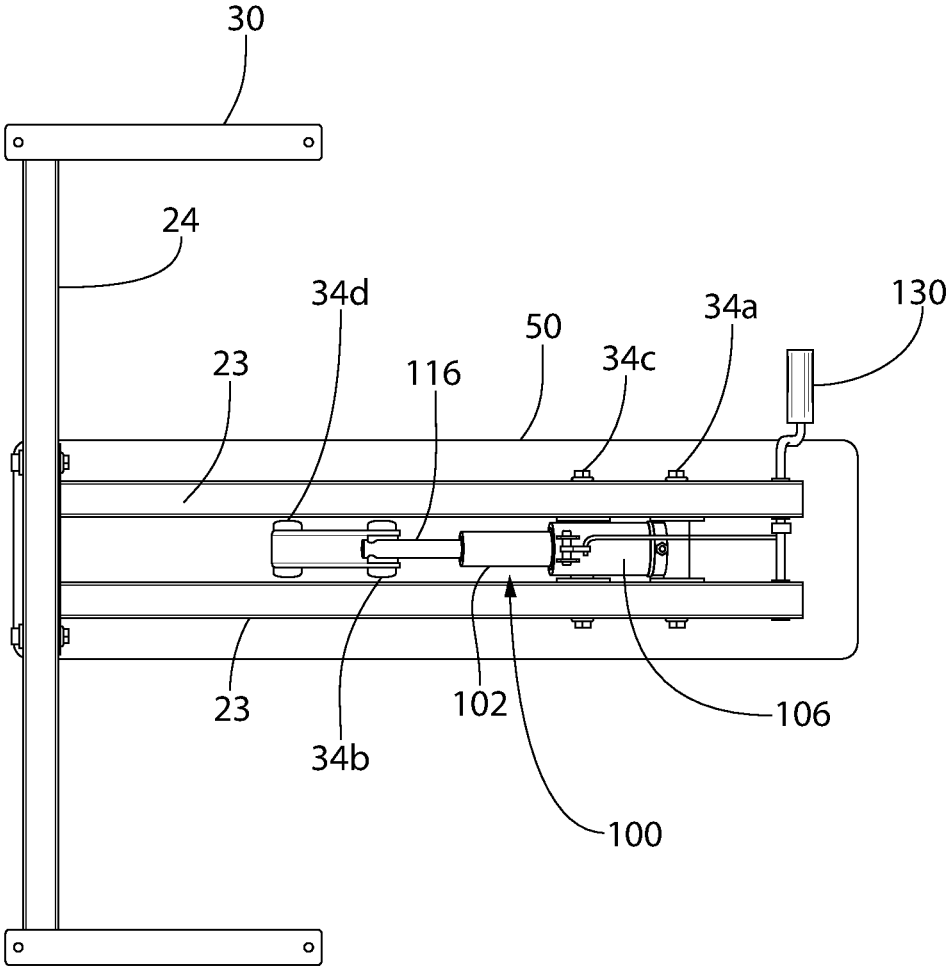
FIG. 8 is a bottom plan view thereof.
Figure 9A:
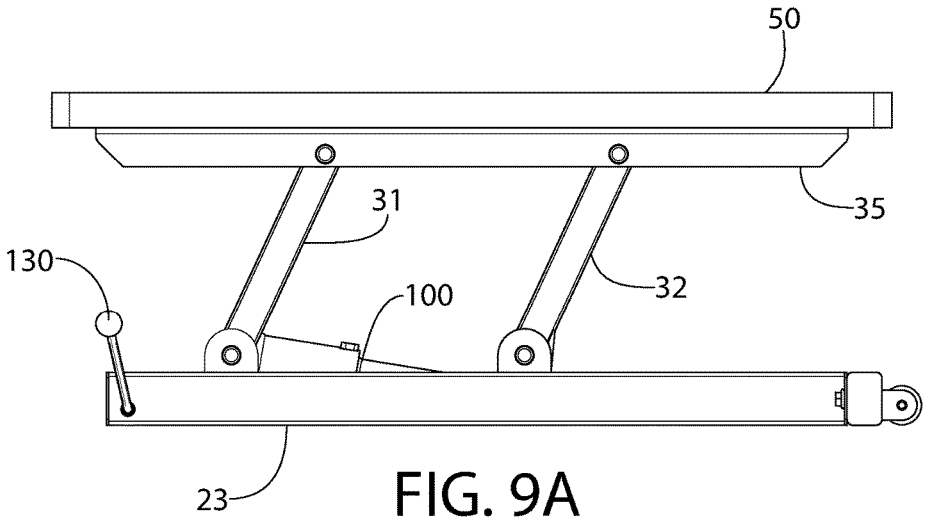
Figure 9B:
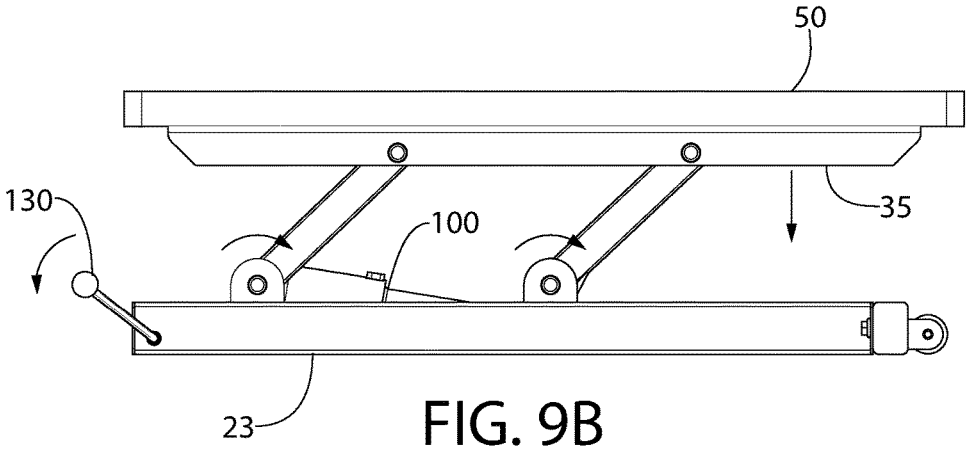
Figure 9C:
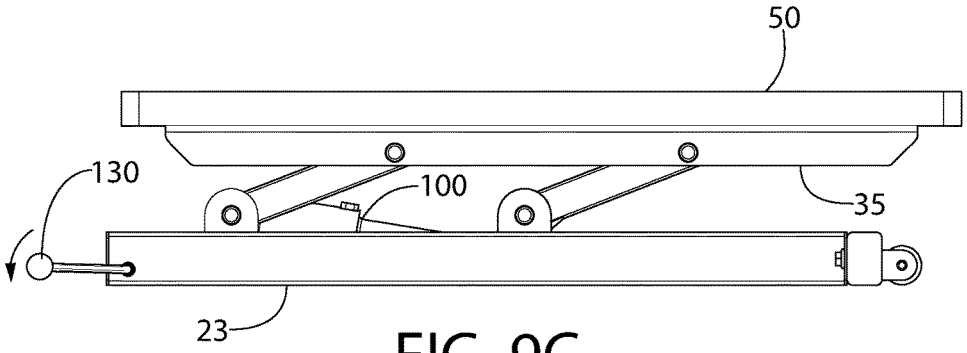
Figure 10:
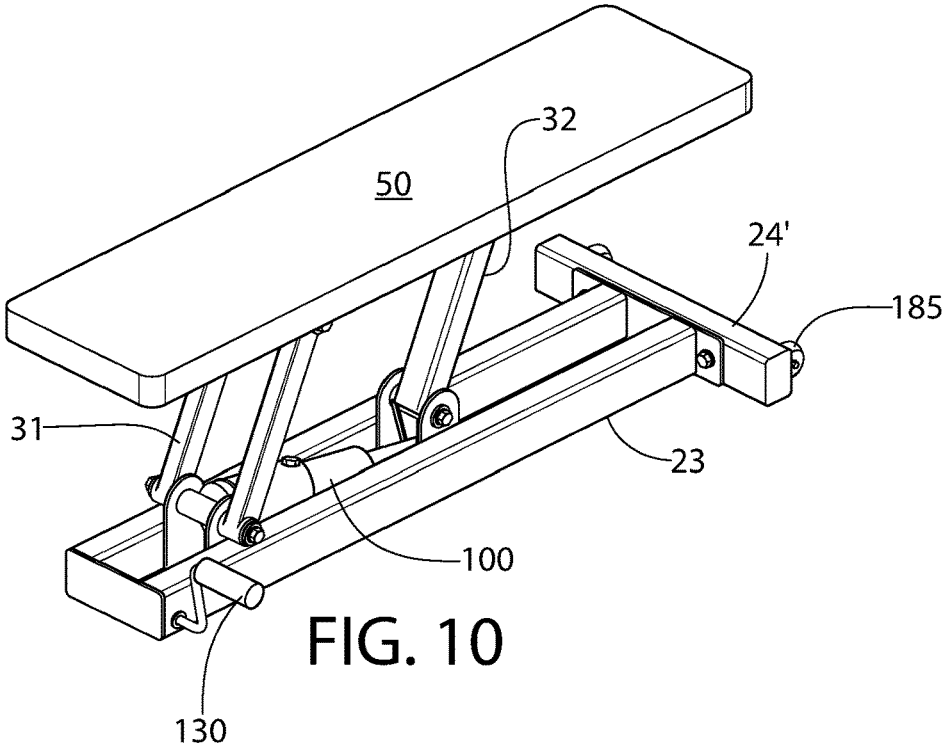
FIG. 10 is a front perspective view of the bench of FIGS. 9A to 9C.
Figure 11:
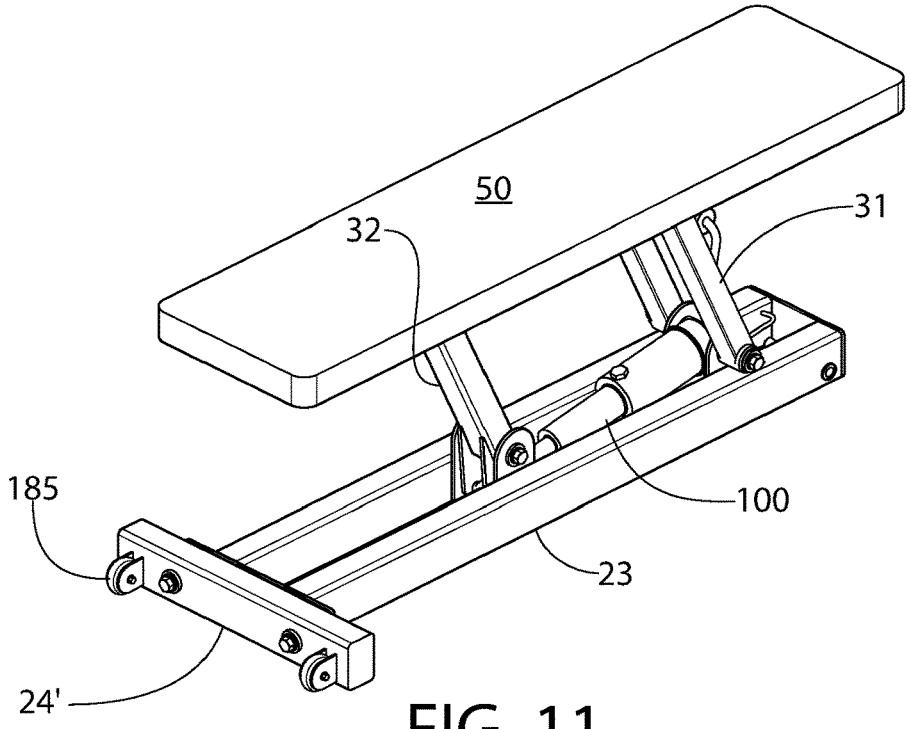
FIG. 11 is a rear perspective view of the bench of FIGS. 9A to 9C.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

FIGS. 1-8 depict a non-limiting embodiment of an exercise bench in the form of weight lifting bench 20 according to the present disclosure. Structurally, bench 20 generally includes a hollow tubular frame 21 configured for placement on a floor and an elongated user bench pad 50 pivotably coupled to the frame. Pad 50 supports a user and defines a longitudinal axis LA and corresponding axial direction. A lateral or transverse direction is defined transverse to the longitudinal axis for reference.

Frame 21 may include a substantially horizontal base 22 which in one embodiment may be comprised of a bench portion or sub-frame 37 and a weight rack portion or sub-frame 38. The bench sub-frame comprises a pair of laterally spaced apart axially extending longitudinal members 23 to which the bench pad 50 is pivotably coupled for upward and downward movement. The weight rack sub-frame 38 comprises an elongated cross member 24 to which proximal ends 23*a* of the longitudinal members 23 are attached in one embodiment forming a one-piece frame after assembly and/or construction. This defines a head end of the bench.

In other possible embodiments, a two-piece frame may be provided in which the bench pad 50 assembly and supporting bench sub-frame 37 including longitudinal members 23 are a separate component from and unattached to the cross member 24 and weight rack sub-frame 38. In such an embodiment, shown for example in FIGS. 9A-C, 10, and 11, the proximal ends 23*a* of the longitudinal members 23 may be positioned proximate but unconnected to cross member 24 in use during the exercise routine. This forms a separable free standing "utility" bench which is useable on its own or with multiple different weight rack configurations for performing different types of weight lifting exercise routines. In the portable bench embodiment, the proximal ends 23*a* of the longitudinal members 23 may be attached to a second cross member 24' that may be positioned against or proximate to cross member 24 of the frame 22. A pair of wheels 185 may be fitted to cross member 24' to enhance the mobility of the free standing bench assembly.

Referring back to FIGS. 1-8 now, the longitudinal and cross members 23, 24 respectively are configured for positioning or resting on the horizontal floor. Cross member 24 defines the head end of the frame 21 and bench 50, and the distal free ends 23*b* of the longitudinal members 23 define a foot end of the bench. Cross member 24 may be arranged perpendicular to the longitudinal members 23 in one embodiment. A cavity 25 is formed between the longitudinal members 23 for mounting the hydraulic system components further describe herein.

It will be appreciated that numerous variations of the frame configuration may be provided. Accordingly, the invention is expressly not limited by the configuration.

The weight rack sub-frame 38 of frame 21 further includes a pair of laterally spaced apart vertical posts or stanchions 26 configured for supporting a barbell via appropriately configured weight rests 27. Stanchions 26 have a lower end 26*a* to engage the floor which are attached to the cross member 24 and a free upper end 26*b*. The weight rests 27 may be attached to the upper end 26*b* of each stanchion as shown or at any other suitable location along the stanchion. Rests 27 may have any suitable shape but include primarily a horizontal section for placement of the round or other shaped bar of the barbell (the weights being attached to each end of the bar in typical fashion). In the non-limiting illustrated embodiment, the weight rests 27 may have a generally truncated U-shape with a horizontal section and two opposing upright or vertical sections one of which may be shorter than the other to allow for easy ready removal of the barbell by the user during the weight lifting routine. In other possible embodiments, the weight rests 27 may be cup shaped or have another shape. Numerous variations are possible and do not limit the invention.

The position of the weight rests 27 on the stanchions 26 may be adjustable in some embodiments such as via a telescoping and pinned arrangement. Weight rests 27 may each be formed on the top or another part of slidable inner tubes 36 which are insertable inside and through open upper ends 26*b* of stanchions 26 for adjusting the height of the rests. The rests 27 may be locked in the desired position via a plurality of height adjustment holes 39 formed through the inner tubes 36 and stanchions 26 through which cylindrical lock pins 39*a* (e.g. straight or L-shape) are insertable (see, e.g. FIGS. 1 and 2). Such pinned arrangements are known in the art without further elaboration.

Figure 12:
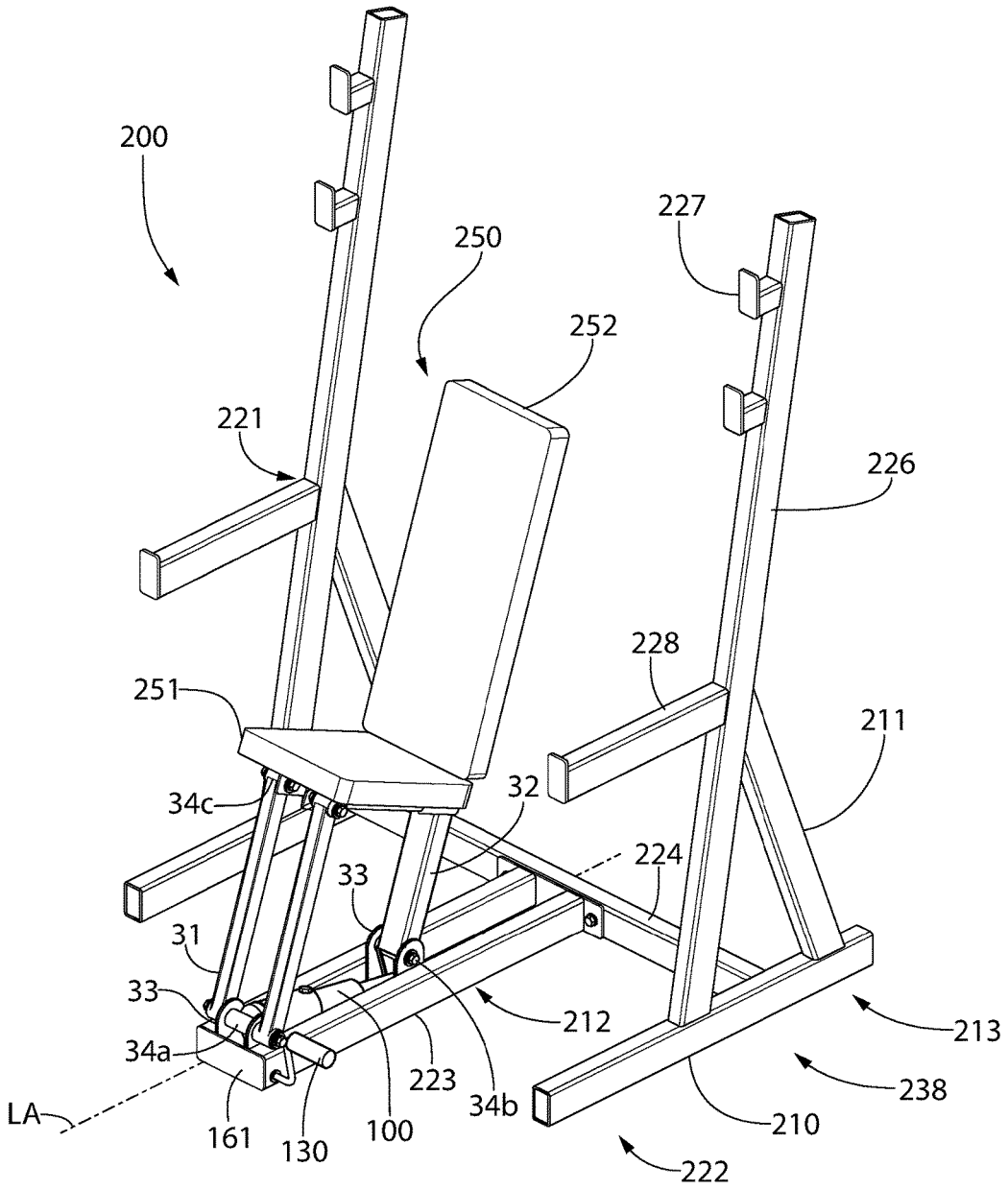
FIG. 12 is a front perspective view of an embodiment of an inclined weight lifting bench with automatic bench return and bench descent control mechanisms according to the present disclosure including a weight rack and attached bench pad assembly.
Figure 13:
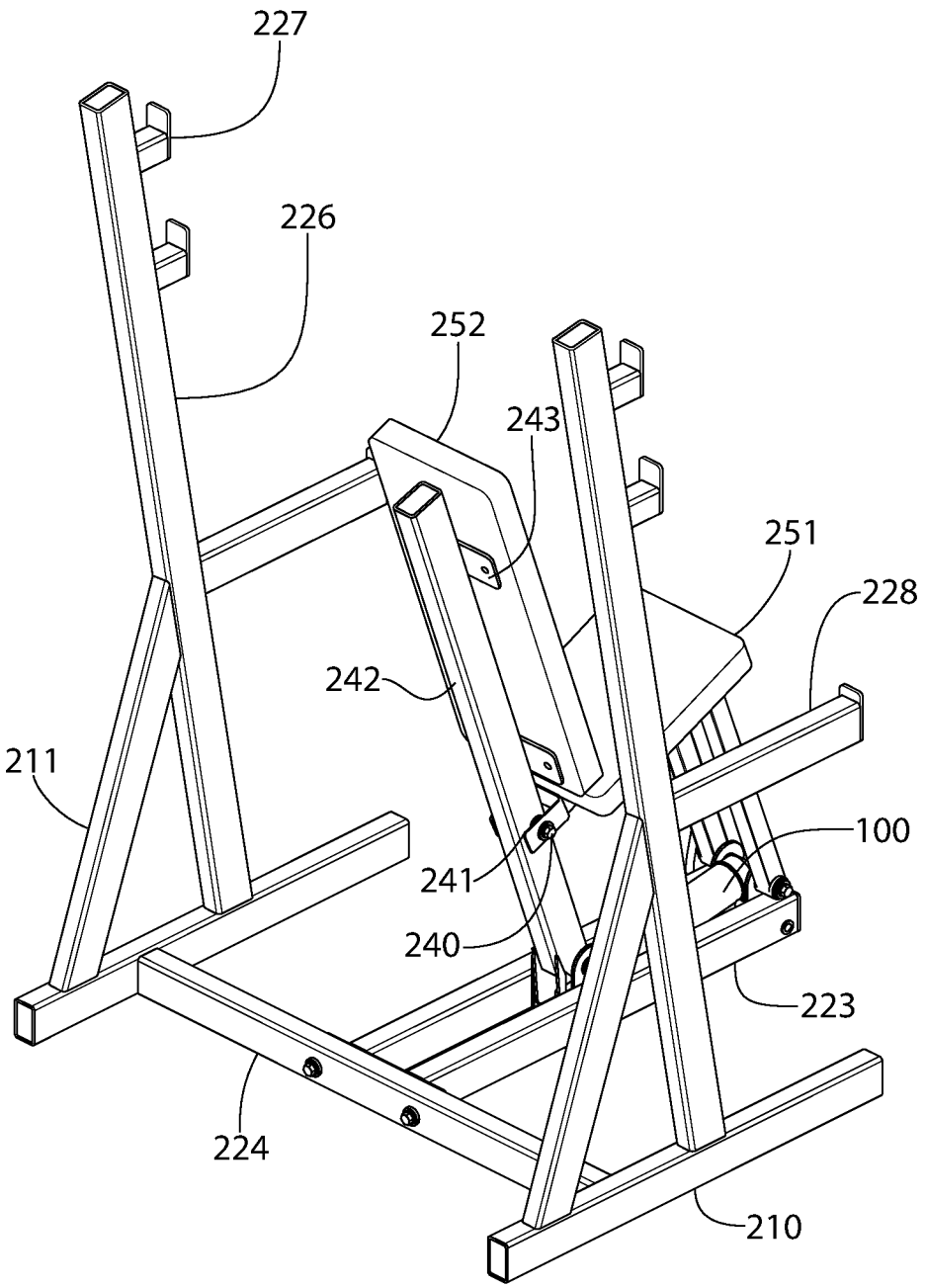
FIG. 13 is a rear perspective view thereof.
Figure 14:
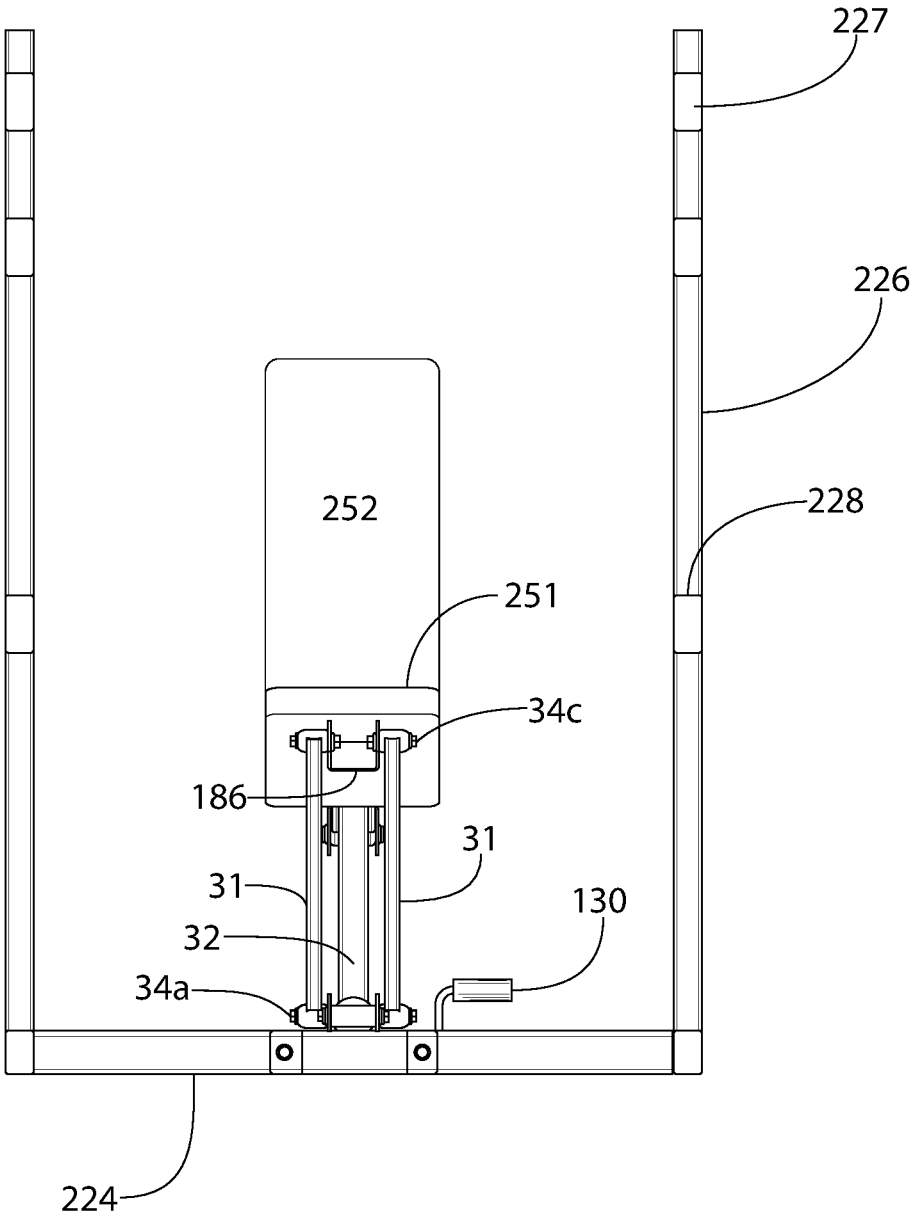
FIG. 14 is a front view thereof.
Figure 15:
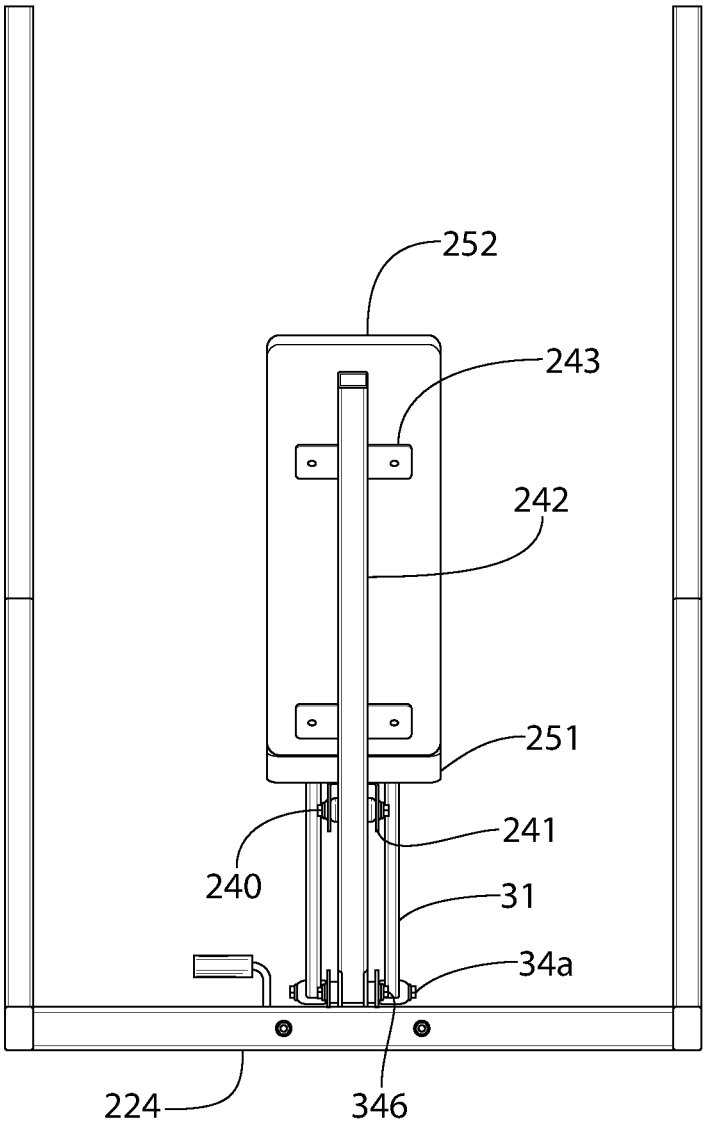
FIG. 15 is a rear view thereof.

Frame 21 (e.g. weight rack sub-frame 38) further includes a safety rack 28 comprising a substantially horizontal member attached at one proximal end 28*a* to stanchion 26 and an opposite distal end 28*b*. In some embodiments, distal end 28*b* may be a cantilevered free end unattached to another part of the frame 21 (see, e.g. FIG. 12 and safety rack 228). In the present illustrated embodiment discussed, however, a vertical member 29 is shown which is connected at an upper end 29*a* to distal end 28*b* of the rack and has a lower end 29*b* contacting the floor. A tie member 30 such as a strap or a tube may be provided which ties the lower end 29*b* into the stanchion 26 for added stability in some configurations.

The frame 21 and its members described herein may have any suitable transverse cross-sectional tubular shape such as rectangular shapes (e.g. square with equal sides or rectangle with unequal adjacent sides), other polygonal shapes, non-polygonal shapes (e.g. circular), and combinations thereof. Although tubular structural members are preferred in certain embodiments for the main loading carrying elements of frame 21 to reduce transport weight, some or all of the members of the frame may be solid structural members in some embodiments depending on their expected service conditions and load. Plate members may also be used for certain portions of frame 21. Frame 21 may be made of any suitable material, preferably metal including for example without limitation aluminum, steel, titanium, etc. The structural members may be interconnected via any suitable means used in the art such as without limitation welded connections, bolted connections, adhesives, mechanical interference fits, frictional fits, combinations thereof, or other. The frame cross-sectional shape, choice of metallic material, and connection methods are thus not limiting of the invention.

To pivotably couple the bench pad 50 to the longitudinal members 23 of frame 21, the bench 20 may further include a pivotable linkage mechanism comprising a front (foot-end) strut 31 and a rear (head-end) strut 32. In the illustrated embodiment, a pair of laterally spaced apart front struts is provided. A pair of rear struts 32 may alternatively be provided in other embodiments. The struts 31, 32 are pivotably coupled at their respective upper and lower ends to the support pad 50 and longitudinal members 23 of the frame 21 (see, e.g. FIGS. 1-11). Cross bolts 34*a*, 34*b* may be used to couple the lower ends of the struts 31, 32 respectively to the longitudinal members 23. The cross bolts are inserted through laterally open round holes in the frame and form fixed pivot joints or points. In one embodiment, a pair of upward extending mounting tabs 33 may be attached to each the longitudinal members 23 to facilitate bolting the lower ends of struts 31 and 32 to the longitudinal members.

The upper ends of the front and rear struts 31, 32 are similarly pivotably coupled to a pair of longitudinally extending and laterally spaced apart pad support members 35 to which the support pad 50 is attached. The struts 31, 32 may also be bolted to the pad support members 35 via cross bolts 34*c*, 34*d* respectively in some embodiments to form the pivotable coupling system. The cross bolts 34*c*, 34*d* are inserted through laterally open round holes in the pad support members and form fixed pivot joints or points. Support members 35 are oriented substantially horizontal and arranged parallel to the longitudinal axis LA and longitudinal members 23. In one embodiment, the pad support members 35 may be made of elongated structural angles; however, other types and shapes of structural members (e.g. tubular, C-channels, etc.) may be used. The support members 35 may be made of the same metallic materials as the frame 21 discussed above.

Although the front (foot-end) struts 31 may comprise two struts in the illustrated embodiments, other embodiments may employ a single strut. Similarly, although the rear (head-end) strut 32 comprises a single strut in the illustrated embodiment, other embodiments may employ a pair of struts. Accordingly, the invention is not limited to use of either single or double struts for each of the front or rear struts 31, 32 so long as the functionality described herein is provided for the pivotable linkage mechanism. It further bears noting that in certain embodiments, pins, rods, shafts, bolts, or other similar elements useable to make a pivotable coupling may be used instead of any pivot elements specifically identified by type herein which represents only some non-limiting examples of pivot joint.

Using the foregoing pivotable coupling system, the bench pad 50 is vertically movable in position with respect to the frame 21 including the longitudinal members 23 and safety rack 28. This provides the rescue feature of the bench 20.

Support pad 50 is movable from an upper exercise position (see, e.g. FIG. 5A) in which the user lifts the barbell B during an exercise routine, to a lower escape position (see, e.g. FIG. 5B) via a pivoting toggle-like action created between the pad and frame provided by the front and rear struts 31, 32. The struts 31, 32 may be approximately equal in length and substantially parallel to each other in some embodiments. In other embodiments the struts may be of different lengths but preferably are arranged and connected to the longitudinal members 23 and pad support members 35 to maintain the support pad 50 in a level horizontal position in both the upper exercise and lower escape positions. In moving between the upper and lower positions, the struts 31, 32 may be obliquely angled in relation to the pad support members 35 and longitudinal members 23, and have lengths selected to maintain the bench pad 50 in a substantially horizontal orientation during its vertical motion.

Hydraulic Control System

A support mechanism operably coupled between the sets of struts 31, 32 both maintains the position of the bench support pad 50 in the upper and lower positions and controls the movement of the pad therebetween. In addition, the support mechanism controls the bench descent rate as further described herein. The support mechanism may be hydraulic, pneumatic, electrical, or mechanical in nature. In one embodiment, a hydraulic control system described herein provides the support mechanism for the bench pad. According to one aspect of the invention, the hydraulic control system is additionally configured to provide an auto-return mechanism for automatically returning the bench pad 50 to the upper position from the lower position after a user escape sequence is initiated.

FIGS. 22-32 depict one embodiment of a hydraulic control system and arrangement in greater detail. The system may include a hybrid hydraulic-pneumatic operator which includes a hydraulic cylinder assembly 100 generally comprising a single-acting hydraulic cylinder 102 and an accumulator 106 in fluid communication with the cylinder. In single-acting cylinder designs, the cylinder piston rod extends under hydraulic pressure and retracts under an externally applied force (e.g. gravity weight of equipment, user, etc.) acting against the rod.

The hydraulic cylinder 102 has an axial centerline CL1 and accumulator 106 has an axial centerline CL2. In the illustrated embodiment, the axial centerlines are coaxially aligned forming an end-to-end mounting relationship between the hydraulic cylinder and accumulator. The hydraulic cylinder 102 comprises an elongated tubular body or barrel 108 forming an internal bore 110 which holds hydraulic fluid 101 and an axially movable piston 112 comprising a piston head 114 and cylinder rod 116 having one end rigidly coupled thereto inside the bore. Piston head 114 is sealed at its peripheral edges to the bore 110 by a suitable annular seal 114*a* to keep oil from leaking past the head into the part of the cylinder bore behind the head (space on the left side of the head in FIG. 29). A transversely oriented aperture 120 is formed in an opposite end of the rod 116 which pivotably couples the rod to a downwardly extending pivot extension 32*a* disposed on the lower end of strut 32 below cross bolt 34*b*. Extension 32*a* may have a bifurcated clevis shape in one embodiment having two sides spaced laterally apart which receives cylinder rod 116 therebetween. A cross pin 121 completes coupling the pivot extension 32*a* to strut 32 and defines a pivot axis. Pin 121 is located on strut 32 below cross bolt 34*b* and offset from the axial centerline of the rear strut 32 to provide leverage so that the cylinder rod 116 acts to pivot the extension 32*a* about bolt 34*b* for raising/lowering bench pad 50 and holding the pad in stationary position via the hydraulic system.

The accumulator 106 in one embodiment comprises an elongated body forming an internal chamber 104 for holding hydraulic fluid 101 and a compressible gas. The internal chamber 104 of the accumulator 106 is fluidly connected to the cylinder bore 110 by one or more flow conduits 118 configured to provide bidirectional exchange and flow of hydraulic fluid between the accumulator 106 and cylinder 102. In one non-limiting embodiment, the accumulator 106 may physically be directly coupled to the cylinder 102 to form a compact cylinder assembly 100. A unique flow control valve assembly 145 may be provided which internally incorporates the flow conduits 118 and is configured to control the flow and exchange of hydraulic fluid between the accumulator 106 and hydraulic cylinder 102 as shown in FIGS. 22-29. Advantageously, this eliminates the need for external tubing to form the flow conduits which may be exposed to damage during shipping or use of the bench.

In one embodiment, the valve assembly 145 may be designed directly as part of the hydraulic cylinder assembly. The valve assembly 145 may be interspersed directly between the accumulator 106 and hydraulic cylinder 102 to provide a compact hydraulic assembly. In this arrangement, one proximal end of hydraulic cylinder barrel 108 is coupled to one side of the valve assembly body and one proximal end of the accumulator 106 is coupled to the other side of the valve assembly body. The accumulator and barrel may be welded to the valve assembly 145 to provide a leak-proof seal in one embodiment; however, other mounting methods may be used such as without limitation bolting or other. The flow conduits 118 extend through the valve assembly 145 which fluidly connects the cylinder bore 110 to the accumulator chamber 104 as describe below.

Referring to FIGS. 28-32, valve assembly 145 includes a spring-biased plunger valve 122, check valve 147, and optionally a pressure compensating valve 146. The pressure compensating valve 146 provides an automatic means for controlling the rate of descent of the bench pad 50 when an escape scenario is initiated by a user. One flow conduit circuit 118*a* fluidly connects the plunger valve 122 and pressure compensating valve 146. Flow conduit circuit 118*a* fluidly communicates with and extends through the body of valve assembly 145 in order from: the hydraulic cylinder bore 110 to the plunger valve 122, to the pressure compensating valve 146, and finally to the accumulator chamber 104. This provides a first fluid or flow path for exchange of hydraulic fluid between the hydraulic cylinder 102 and accumulator 106. Plunger valve 122 and pressure compensating valve 146 may be removably disposed in suitably configured bores 148 formed in the body of the valve assembly 145 to facilitate installation and replacement if needed. In one embodiment, the bores 148 may open downwards through the body of the valve assembly 145 for insertion of the valves 122, 146 into their respective bores.

Check valve 147 is disposed in a separate flow conduit circuit 118*b* that extends through the body of the valve assembly 145 and which is fluidly isolated from flow conduit circuit 118*a*. Circuit 118*b* extends from in order hydraulic cylinder bore 110 through the check valve 147 and to the accumulator chamber 104. The check valve 147 is arranged to permit one-way flow from the accumulator 106 into to the hydraulic cylinder 102. Flow in the reverse direction is blocked by the check valve. In one embodiment, check valve 147 may be a ball check type comprising a spring 147*b* and biased ball 147*c* which is seated against a valve seat 147*a*. Valve seat 147*a* may be formed by or include an O-ring in some embodiments.

Plunger valve 122 comprises a spring-biased movable stem or plunger assembly including elongated plunger 124 and compression spring 123 which is manually operated to open and close the valve. Other suitable type springs may be used. The plunger 124 is disposed 90 degrees to the axial centerline hydraulic cylinder 102 in this embodiment. The plunger 124 functions to shut off the flow of hydraulic fluid between the accumulator 106 and hydraulic cylinder 102 by moving the plunger 124 to a closed or blocking position, thereby obstructing flow conduit circuit 118*a*. Conversely, withdrawing the plunger 124 from the flow conduit circuit 118*a* to an open position permits the exchange of hydraulic fluid between the accumulator 106 and hydraulic cylinder 102. The valve 122 and plunger assembly is operated via an operating lever assembly which in one non-limiting preferred embodiment is configured as a foot lever 130. Alternatively, a hand-operated lever may be provided. Foot lever 130 is pivotably mounted to longitudinal members 23 of the frame 21 and comprises a generally S-shaped lever in the form of a cylindrical rod comprising a horizontal mounting section 130*a* which extends through openings in the longitudinal members, a horizontal operating section 130*b* offset but parallel to section 130*a* which is configured for operation by the foot or hand of a user to rotate the foot lever, and an intermediate section 130*c* extending orthogonally therebetween. An enlarged pedal as shown may be provided with operating section 130*b* in some embodiment for easier operation by the user.

Mounting section 130*a* defines a pivot axis for the foot lever 130 and includes an elongated cantilevered lever arm 131 fixedly connected to and protruding outwards from lever section 130*a* in a perpendicular radial direction. A mechanical linkage 132 which may be a solid shaft, spring, cable, or other type linkage connects lever arm 131 of the foot lever to a toggle cam 133 pivotably mounted proximate to plunger valve 122. In the present embodiment, mechanical linkage 132 is shown as a rod. Toggle cam 133 has a generally flattened plate-like body in the illustrated embodiment defining a cam surface 133*a* at a working end which acts on a cam follower 134 coupled to plunger 124. An opposite operating end of the cam is pivotably connected to mechanical linkage 132, and two opposing lateral sides extends between the working and operating ends. In one embodiment as shown, the cam follower 134 may be defined by a distal cylindrical end portion of the plunger 124 which projects outward and below the valve 122 body. Retracting or projecting the cam follower 134 from valve 122 therefore selectively closes or opens the valve 122, respectively.

The cylindrical cam follower 134 protrudes downwards from and below the body of valve assembly 145 to engage the toggle cam 133. The cam follower 134 formed as an integral part of the valve plunger 124 (or separate part coupled thereto) operates such that pivoting the foot lever 130 in opposite rotational directions open or closes the plunger valve 122 since arcuately curved cam surface 133*a* is asymmetrically offset from pivot 135 which mounts the toggle cam 133 to the body of the valve assembly 145 (see, e.g. FIGS. 28-29). The pivot hole formed in toggle cam 133 which receives pivot 135 is asymmetrically located between the lateral sides of the toggle cam body as shown so that the distance from the pivot to either of the lateral sides is unequal. In one embodiment, pivot 135 may be formed by a transverse pin which is supported by a support bracket such as inverted U-shaped clevis 138 attached to the bottom of the valve assembly 145 body. Other style mounting brackets and arrangements may be used for the pivotable connection.

Figure 29:
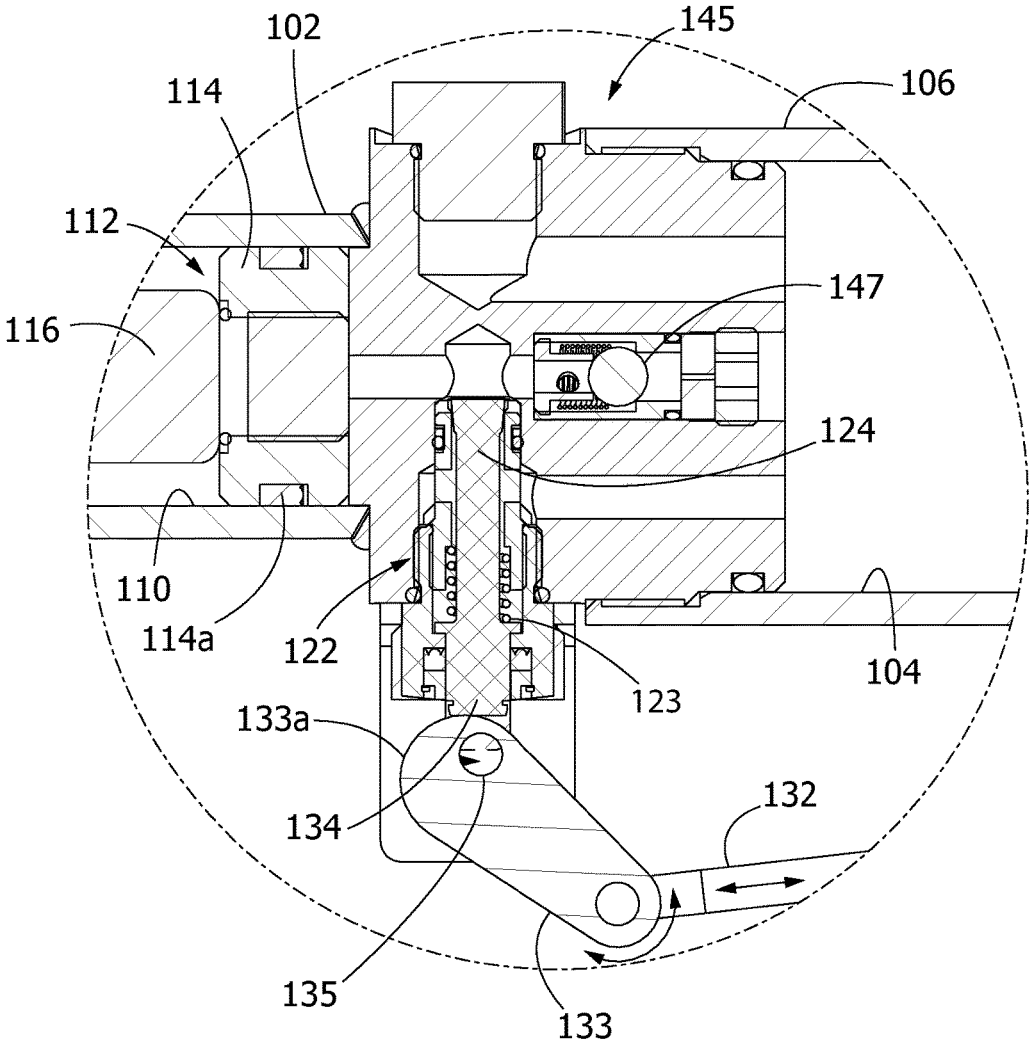
FIG. 29 is a detail view taken from FIG. 28.
Figure 30:
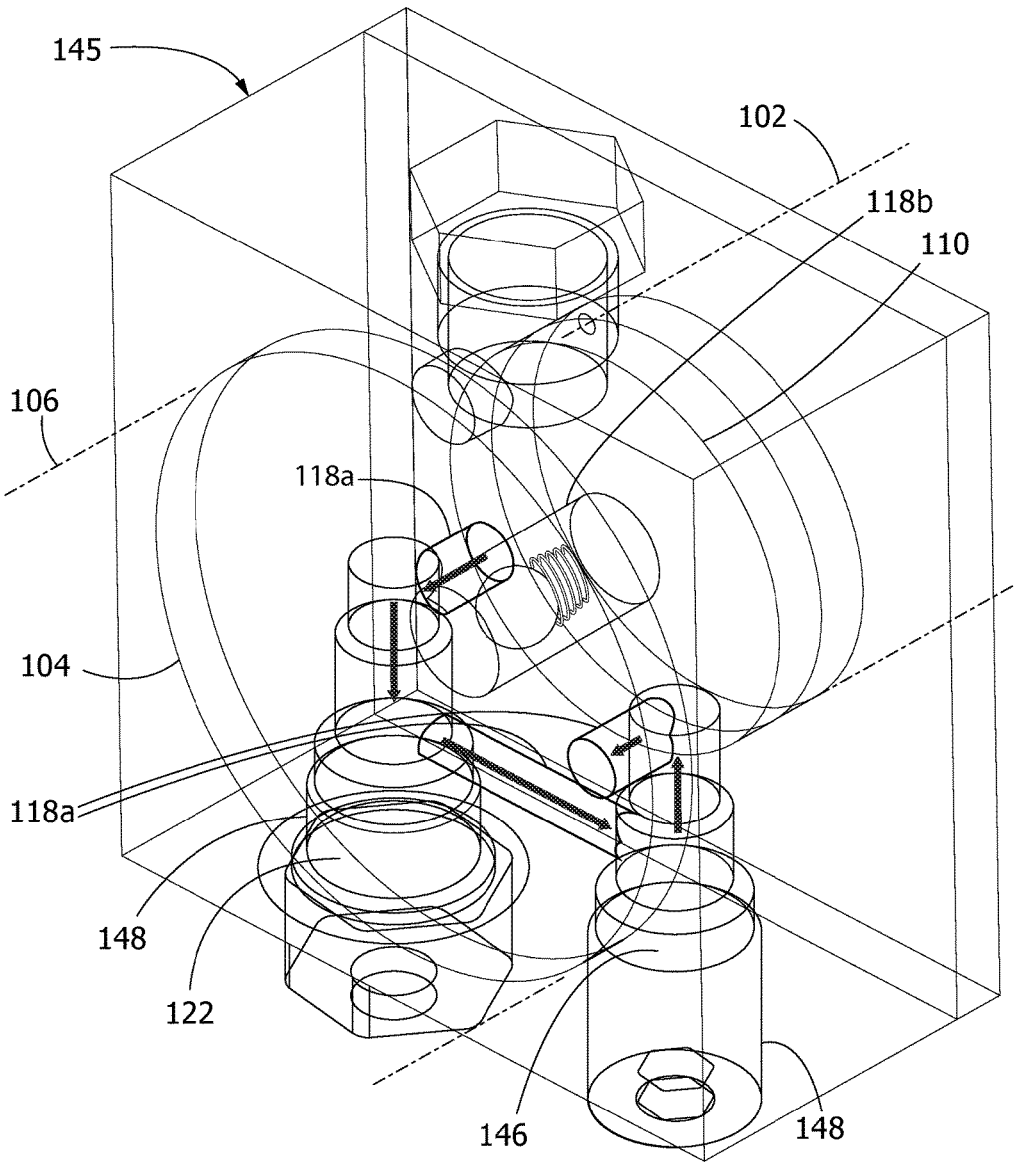
FIG. 30 is a perspective view of the valve assembly of FIG. 22.
Figure 31:
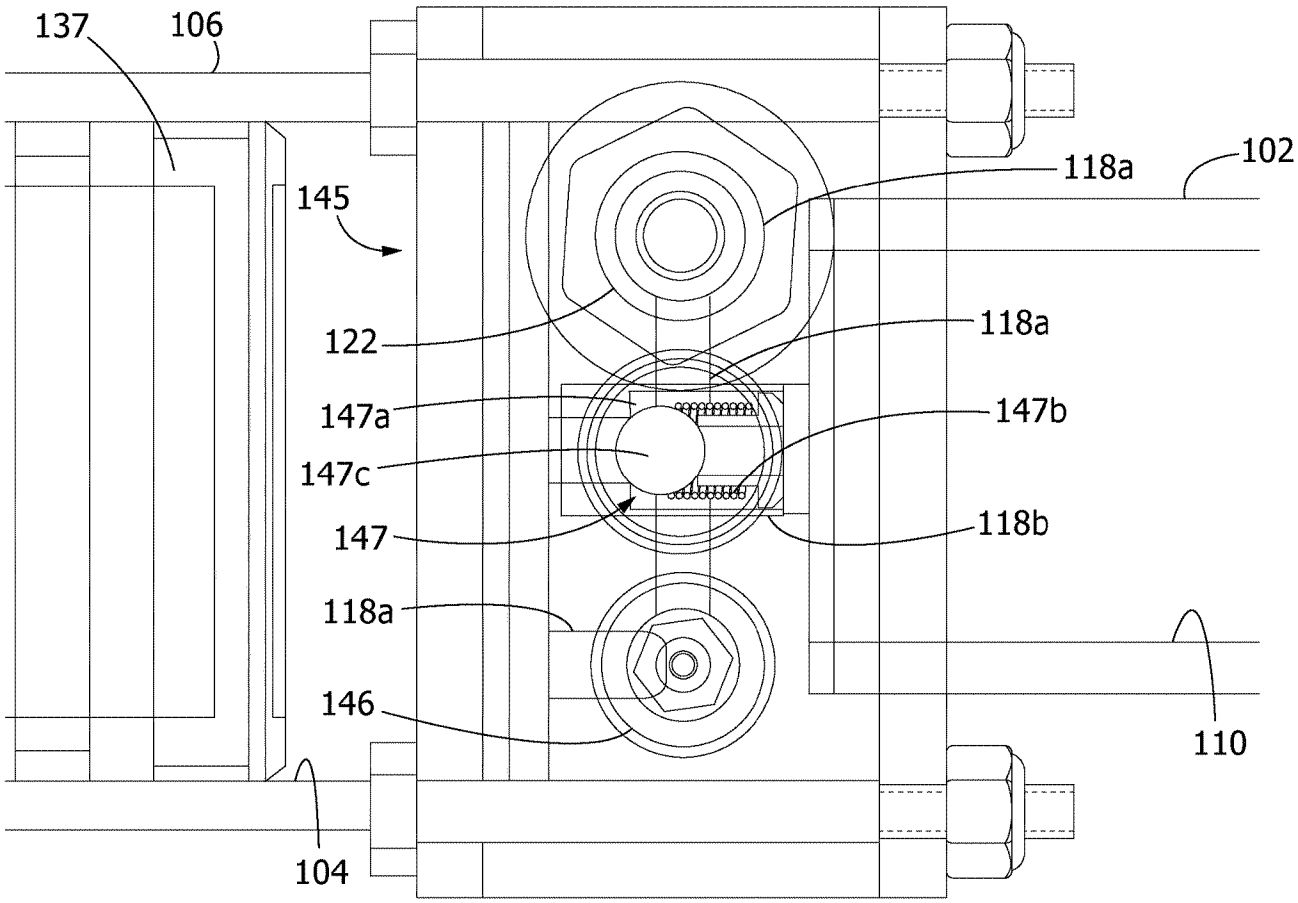
FIG. 31 is a top plan view thereof showing the valve assembly interior.
Figure 32:
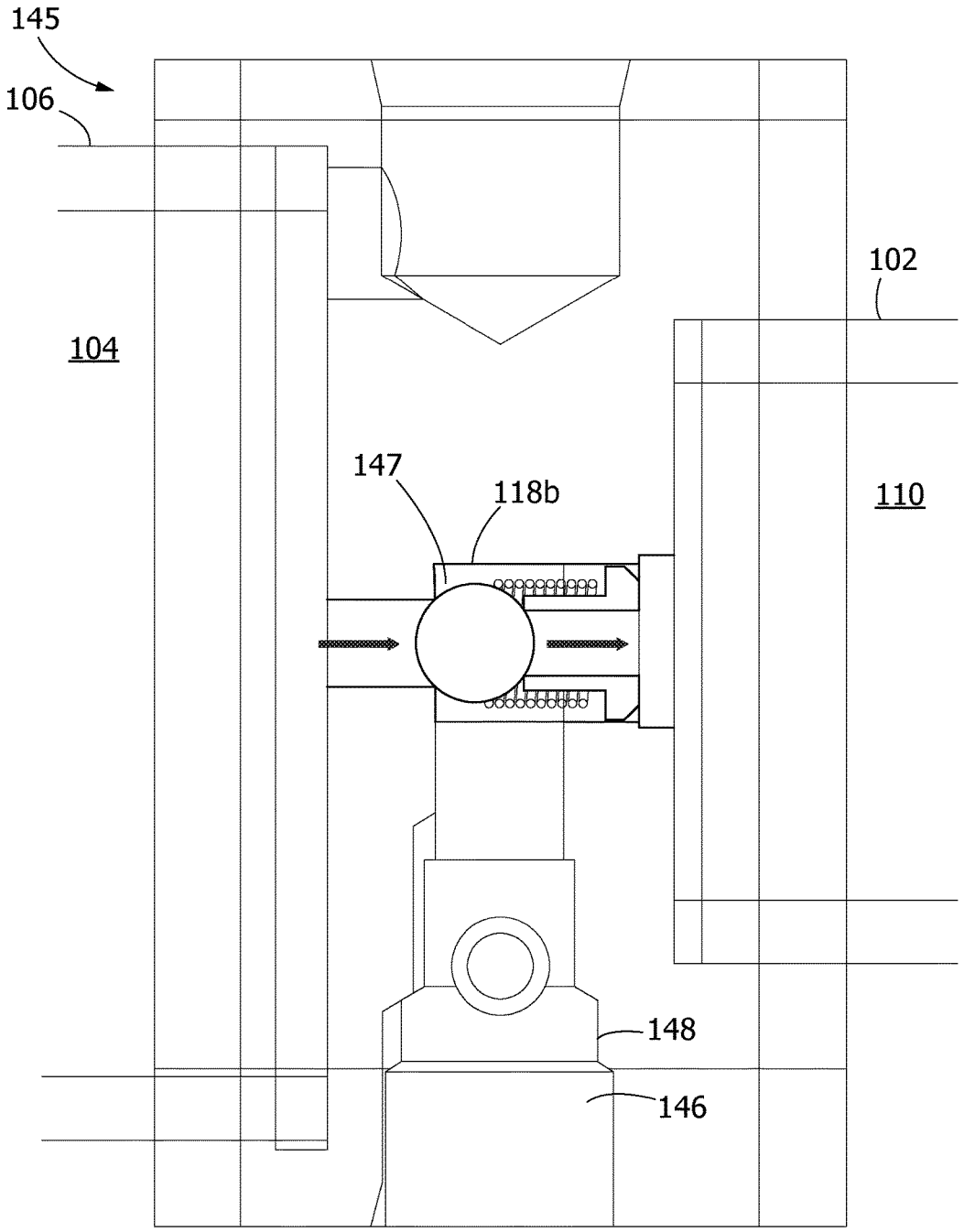
FIG. 32 is a side view thereof showing the valve assembly interior
Figure 33:
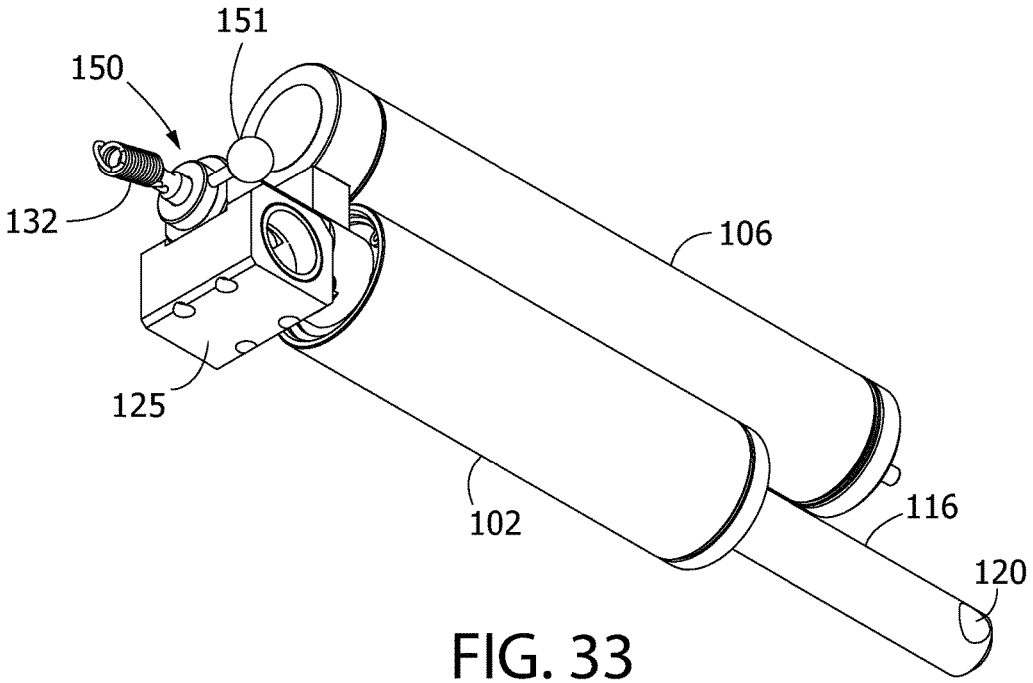
FIG. 33 is a front bottom perspective view of another embodiment of a hybrid hydraulic cylinder system for operating any of the weight lifting benches and/or pad assemblies disclosed herein that comprises an integrated hydraulic cylinder, accumulator, and operating valve assembly in which the accumulator is arranged parallel to the cylinder.
Figure 34:
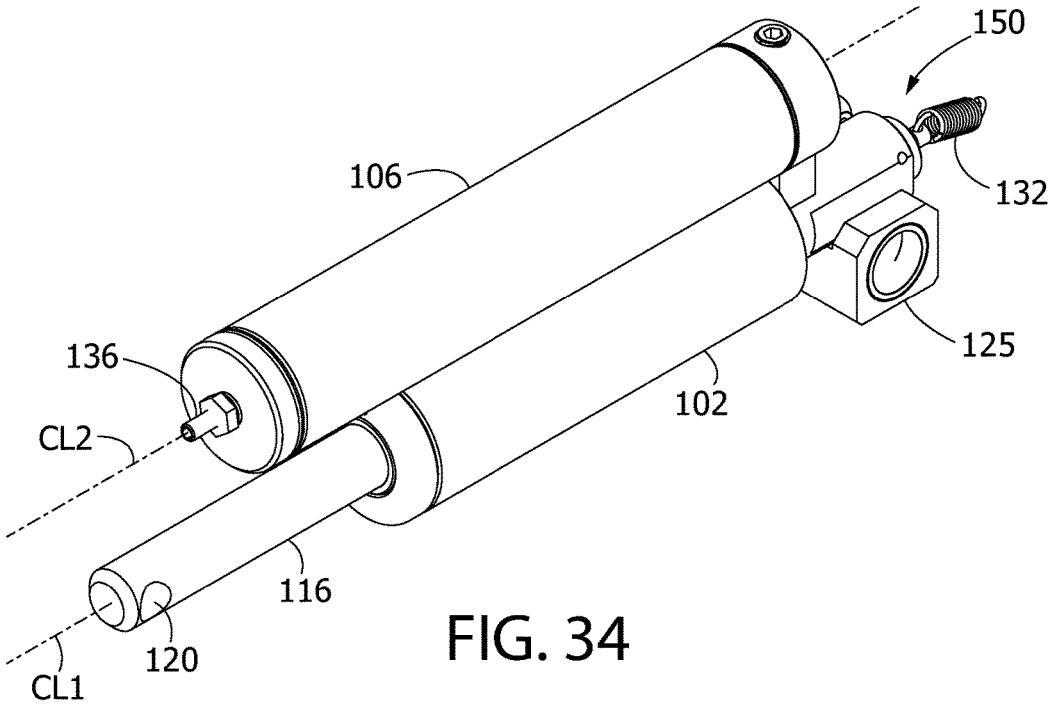
FIG. 34 is a rear bottom perspective view thereof.
Figure 35:
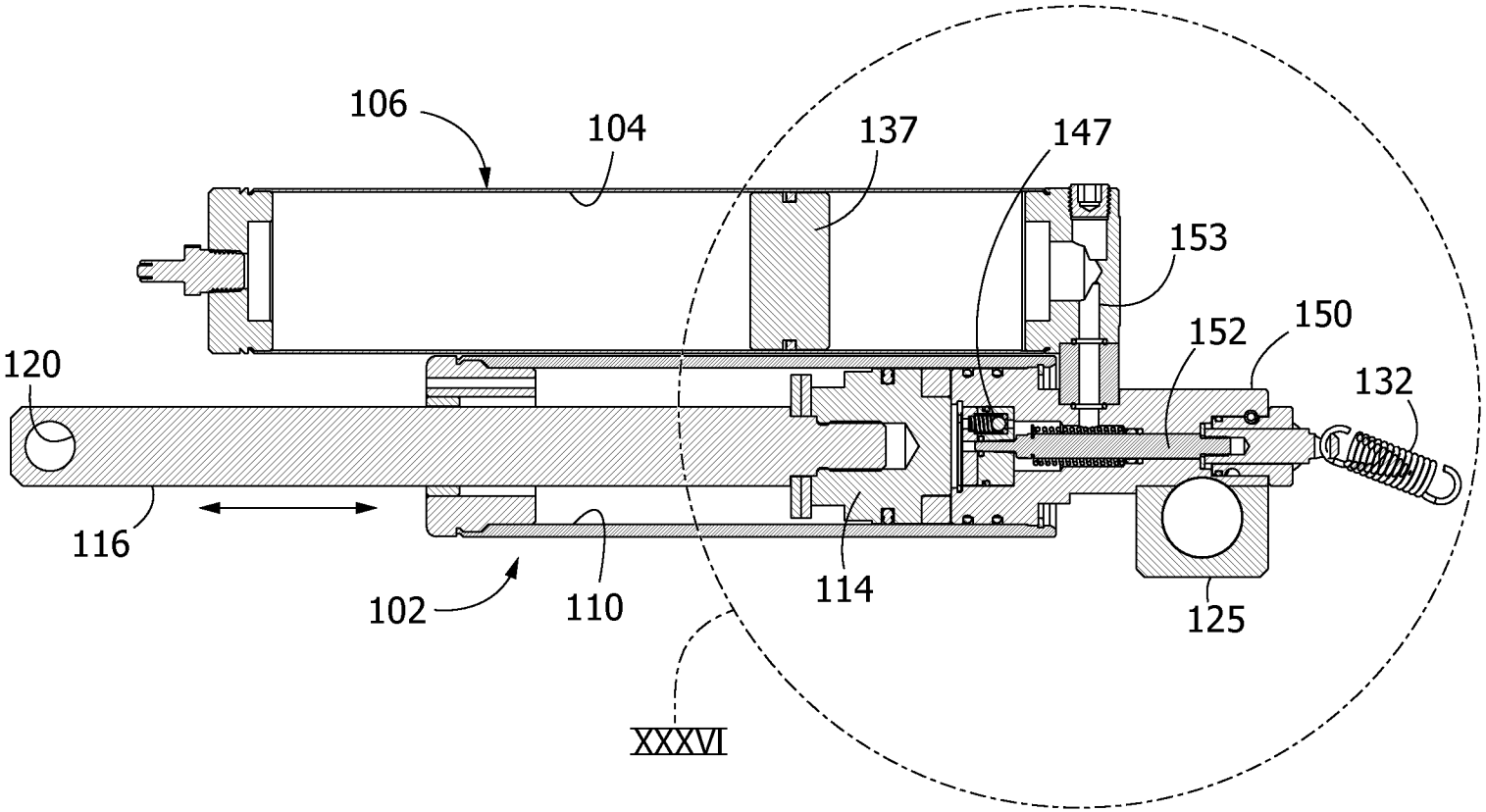
FIG. 35 is a longitudinal cross sectional view thereof.
Figure 36:
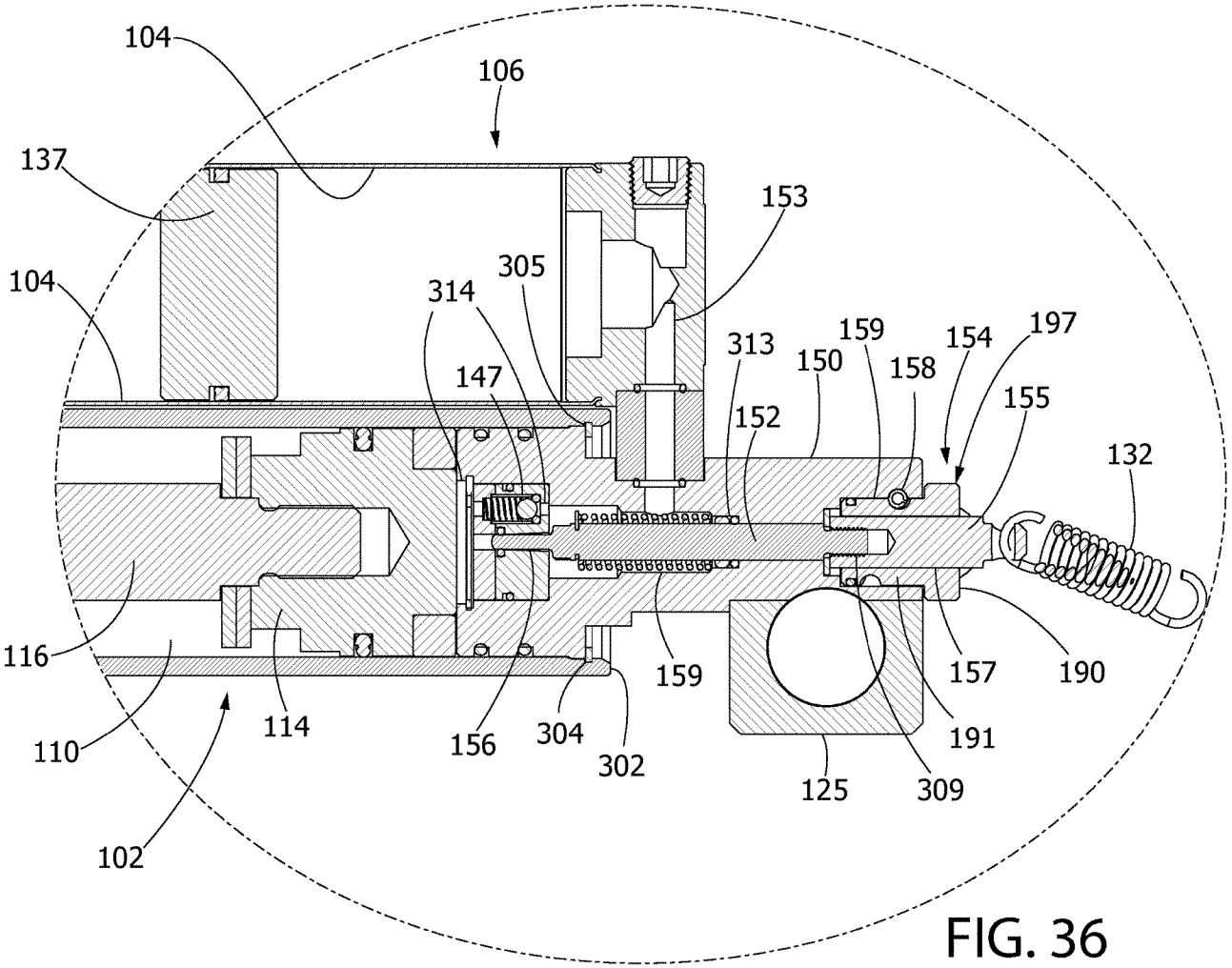
FIG. 36 is a detail view taken from FIG. 35.

FIG. 29 shows the toggle cam 133 in a first inactive position with spring-biased cam follower 134 contacting an outer lateral region of cam surface 133*a* closest to pivot 135. The cam follower 134 is biased downward by plunger spring 123 to maintain contact with the cam surface 133*a* on the toggle cam and bias valve 122 into a closed position. Rotating the toggle cam 133 in a clockwise direction (in FIG. 29) via foot lever 130 and mechanical linkage 132 brings the central portion of cam surface 133*a* into engagement with the bottom end of the cam follower 134. This pushes the cam follower 134 and plunger 124 upward into the plunger valve 122 against the biasing force of the plunger spring 123. The plunger 124 is actuated and raised to move plunger valve 122 into a closed position.

Referring to FIG. 22-28, the hydraulic cylinder assembly 100 may utilize a suitable incompressible hydraulic oil used in such cylinders as the working fluid. In one implementation, the accumulator 106 may be a hydro-pneumatic gas-over-oil type in one embodiment incorporating a compressible gas with the hydraulic fluid oil. The gas may be compressed air or other suitable compressible inert gas (e.g. nitrogen, etc.) which is pre-charged (i.e. pre-pressurized) to an appropriate initial pre-charge pressure. The oil 101 occupies the hydraulic cylinder bore 110 and air 103 at least partially fills the accumulator chamber 104 (depending on whether the cylinder rod 116 is retracted or extended). An air-oil interface is formed between the air and oil within the chamber by an axially slidable piston 137 which shifts position in response to movement of the cylinder rod 116 and connected piston head 114 in hydraulic cylinder 102. Piston 137 is sealed at its peripheral edges to the chamber 104 by suitable annular seals to keep air oil from leaking past the piston into the oil. The air 103 may be filled into the chamber 104 at a pre-charge pressure via an air fill or charging valve 136 fluidly connected to the accumulator 106. Valve 136 may be a Schraeder type valve in one embodiment; however, other type valves may be used.

It should be noted that an air/oil accumulator is preferable over other designs due to lower manufacturing costs and added longevity of life. The rubber bladder used in other air or gas-over-oil type accumulators may be problematic for this design and application. Particularly when the hydraulic cylinder used in a substantially horizontal position as illustrated herein, the rubber bladder can rub and wear over time against the interior of the accumulator chamber, thereby ultimately leading to failure and leakage. However, rubber bladder type accumulators may viably be used nonetheless. Still in other embodiments contemplated, weight-loaded piston or spring type accumulators may be used. Accordingly, the choice of accumulator type does not limited the invention.

In operating principle, compressed air 103 at a pressure higher than atmospheric stores useable potential energy which is converted to kinetic energy to displace piston head 114 and automatically return the bench pad 50 to an upright position, as further described herein. The compressed air exerts pressure against a distal side of the piston 137 (farthest from valve 122) in accumulator 106 that separates the air and hydraulic fluid. Piston 137 in turn exerts force against the hydraulic oil 101 on the proximal side of piston 137 (closest to valve assembly 145). The oil acts in a rigid manner (due to the incompressible nature of the hydraulic oil) against the proximal side of the piston head 114 in the cylinder bore 110 when the bore and accumulator chamber 104 are fluidly connected. This pressure force is used to extend the cylinder rod 116 for forming the support pad auto-return feature of the present invention.

The hydraulic cylinder 102 with cylinder rod 116 is the support mechanism between the sets of struts 31, 32 that maintains the upright position of the bench pad 50. When the cylinder rod 116 is fully extended, the bench pad 50 is in its highest position relative to the floor or ground At this point, the hydraulic fluid fills the cylinder bore 110 in the hydraulic cylinder 102 pushing and extending the rod outwards from the cylinder. The transfer of hydraulic fluid between the cylinder bore 110 and the air/oil accumulator chamber 104 controls the cylinder rod and hence bench pad 50 position. When the cylinder rod 116 is fully retracted inwards into the cylinder 102, the bench pad 50 is in the lowest position relative to the floor or ground. At this point, the hydraulic fluid fills the accumulator 106 and the rod is completely retracted. To adjust the vertical position of the bench pad 50, the user may press the foot lever 130. The foot lever controls the position of flow control valve 122 (e.g. open or closed) which allows or prevents the exchange and flow of hydraulic fluid between the hydraulic cylinder 102 and accumulator 106.

Figure 39A:
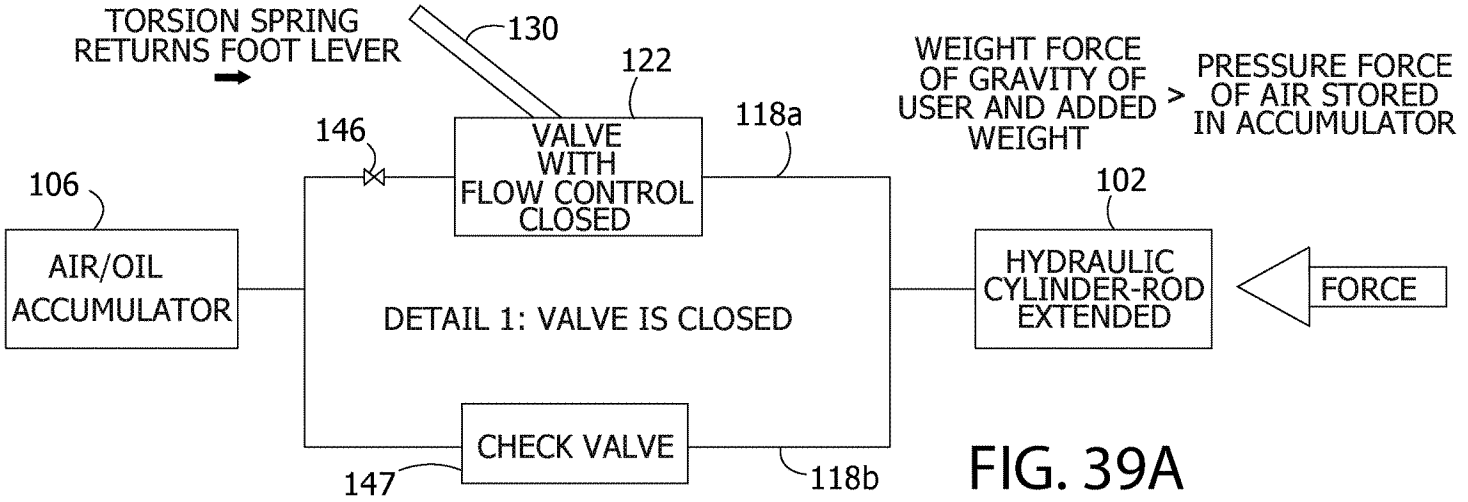
FIG. 39A is a schematic flow diagram of the hydraulic control system in a state when the bench pad is in the extended normal upper exercise position in which the exchange of hydraulic fluid between the hydraulic cylinder and accumulator is stopped by a closed lever actuated plunger valve.

Operation of the hydraulic control system will now be described. FIG. 39A corresponds to bench pad 50 in an upper exercise position (see, e.g. FIG. 5A or 9A for the portable bench). Plunger valve 122 is closed in which foot lever 130 is in an upward position and the toggle cam 133 is in a corresponding upward position to close the valve. While the bench pad 50 is in an upper exercise position with a weight lifter seated thereon, the gravity force from the weight of the user and the added weights of the barbell act as force against the hydraulic cylinder 102 in a direction towards retracting the rod 116 therein. With the foot lever 130 in the upward unactuated position shown in the hydraulic flow diagram of FIG. 39A, however, the plunger valve 122 remains closed and does not permit hydraulic fluid to flow or exchange between the cylinder 102 and accumulator 106, thereby preventing the bench pad from dropping. Accordingly, the hydraulic cylinder 102 is not in fluid communication with the accumulator 106 at this time. In this position, the weight training equipment is ready and operational for exercise. Due to the fact that hydraulic fluid is non-compressible, the hydraulic cylinder set-up provides the same rock solid feel as a rigidly welded piece of equipment. It should be noted that the bench pad 50 may be in its highest adjustment position or somewhat lower but still upward to suit the size of the user and preferences.

Figure 39B:
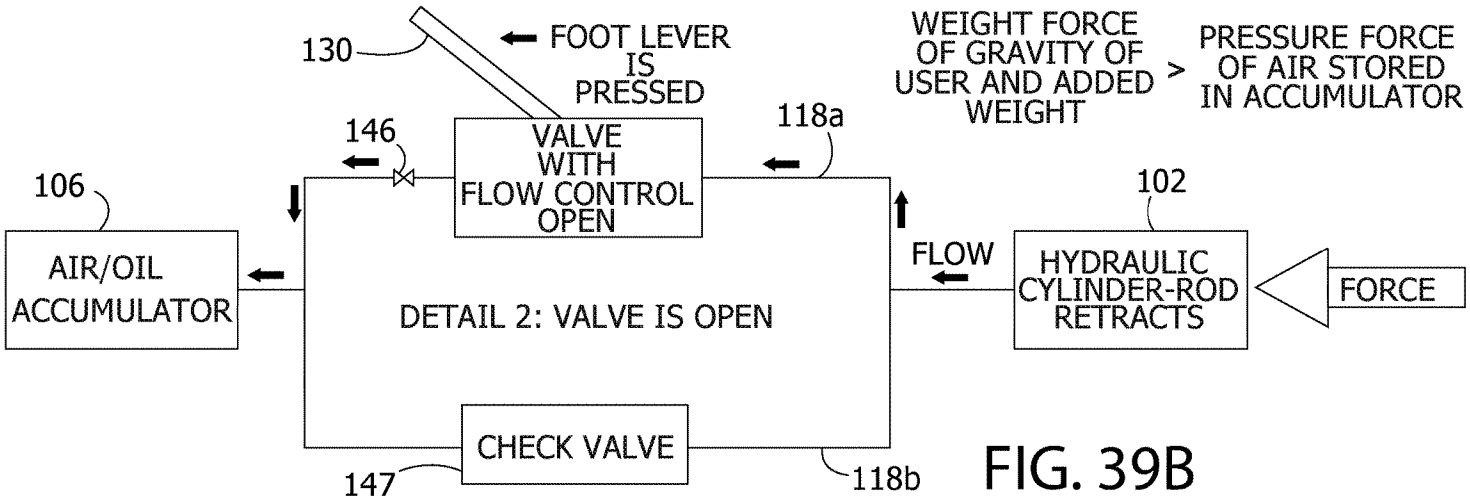
FIG. 39B is a schematic flow diagram of the hydraulic control system in a state when the bench pad is in the process of descending to the collapsed lower escape position in which hydraulic fluid flows from the hydraulic cylinder into the accumulator via an open plunger valve.

When the foot lever 130 is pressed downward and rotated towards the floor or ground to a downward actuated position, the plunger valve 122 opens as shown in flow diagram of FIG. 39B to implement the escape scenario. The downward motion of the foot lever 130 pulls the mechanical linkage 132 towards the front foot-end of the bench to open the valve 122. The toggle cam 133 coupled to the valve rotates laterally and upward causing the valve plunger 124 to be urged downwards by spring 123 to open the valve 122. The gravity force of weight from the user and added weight of the barbell on the equipment forces the cylinder rod 116 to retract inwards into hydraulic cylinder 102 and the hydraulic fluid 101 to now flow from the cylinder 102 to the accumulator 106. As the rod 116 retracts into the cylinder 102, the downward gravity force on the struts 31, 32 cause them to pivot at the fixed pivot points (i.e. cross bolts 34*a*, 34*b*), and the angles of the struts change relative to the ground and base 22 causing the bench pad 50 to lower. If the user intends to simply partially lower the bench pad 50 for an exercise routine, releasing the foot lever 130 at any point during the descending bench motion will close the plunger valve 122 and hold the bench pad in the respective position. If the user tires during the lifting routine and becomes trapped beneath the barbell, the escape scenario may be implemented such that the user holds down the foot lever until the bench pad 50 drops to its lowest escape position (see, e.g. FIG. 5B or 9C for the portable bench). The barbell will come to rest on the safety rack 28, thereby creating a vertical gap between the bar of the barbell and user's chest allowing the user to escape. The barbell rests on the safety racks and provides a stable hold for the user to grip and slide themselves out from under the weights. The force against the horizontal safety racks and upright support racks allows the user to pull themselves forward, and up and off the equipment.

Figure 22:
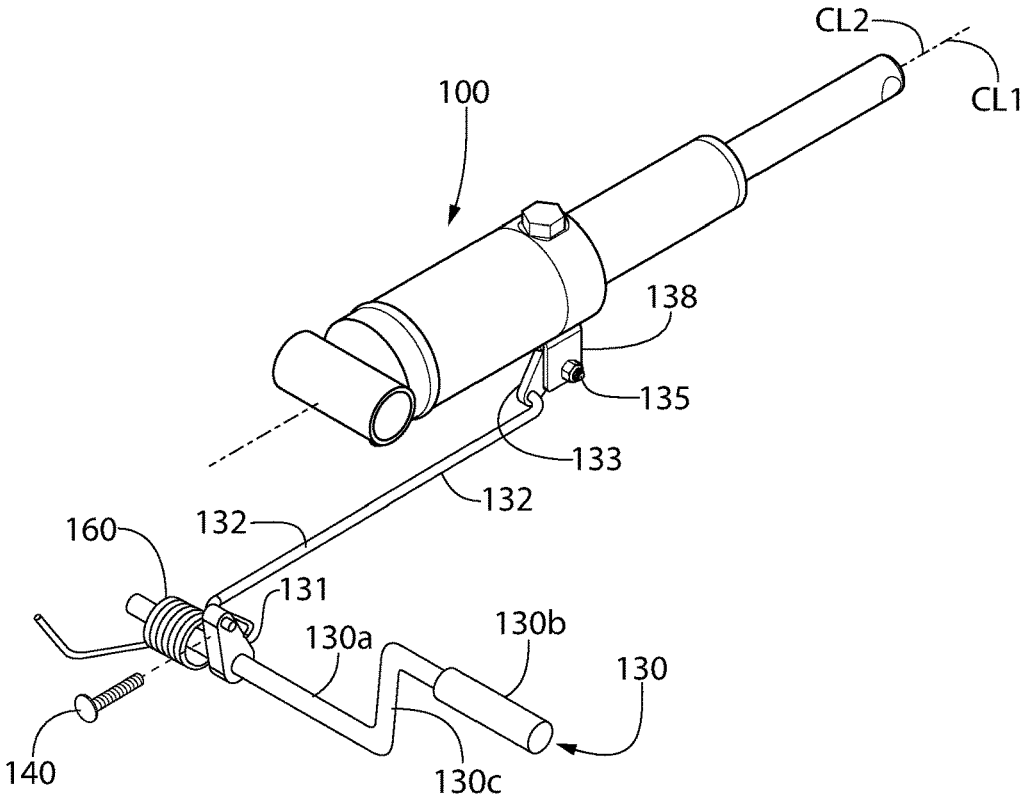
FIG. 22 is a front perspective view of one embodiment of a hybrid hydraulic cylinder system for operating any of the weight lifting benches and/or pad assemblies disclosed herein that comprises an integrated hydraulic cylinder, accumulator, and operating valve assembly in axial alignment.
Figure 23:
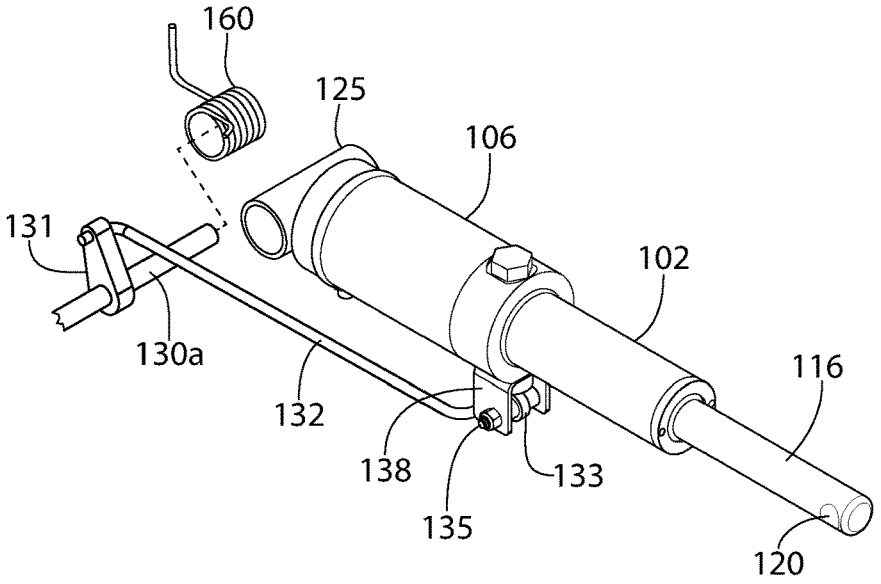
FIG. 23 is a rear perspective view thereof.
Figure 24:
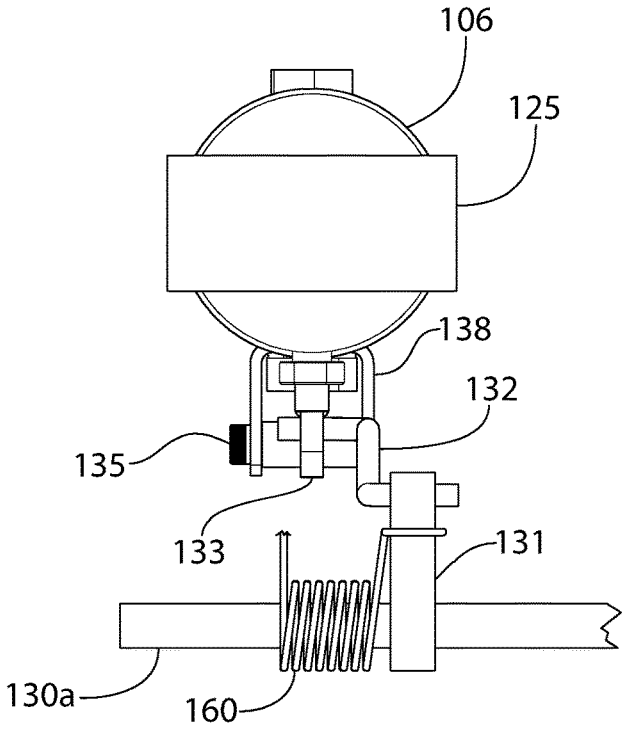
FIG. 24 is a front view thereof.
Figure 25:
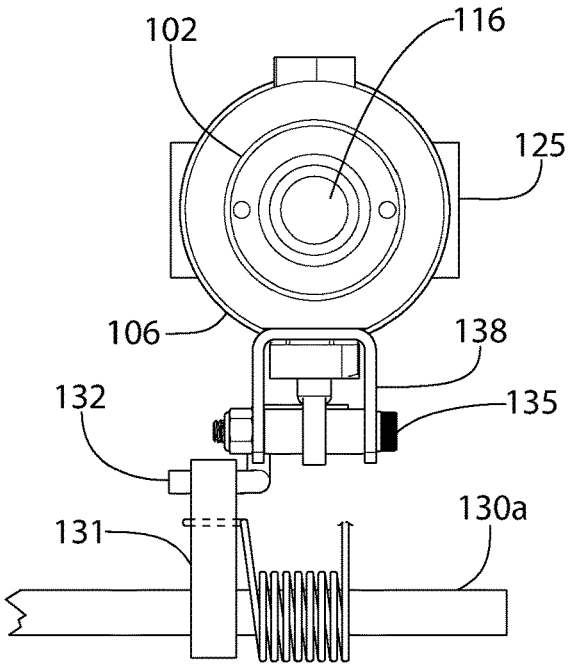
FIG. 25 is a rear view thereof.
Figure 26:
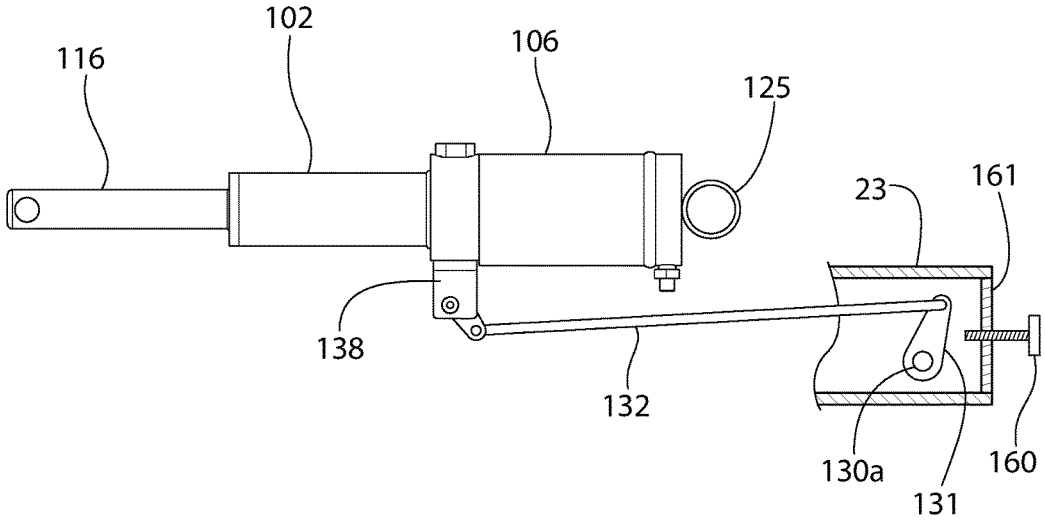
FIG. 26 is a side view thereof.
Figure 27:
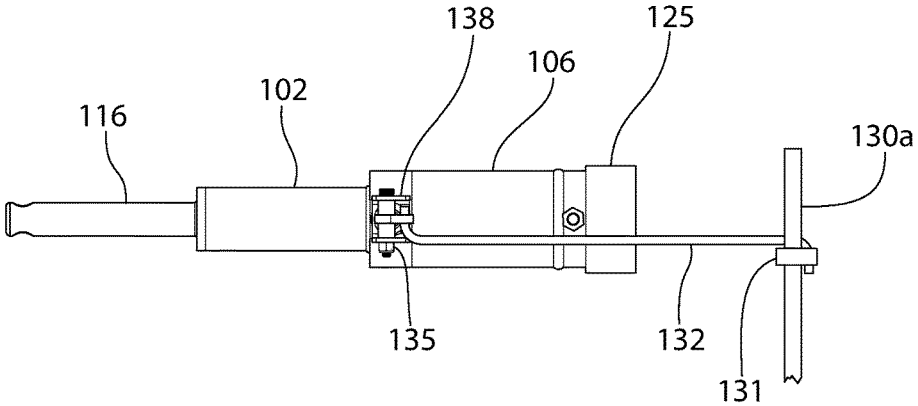
FIG. 27 is a top plan view thereof.
Figure 37:
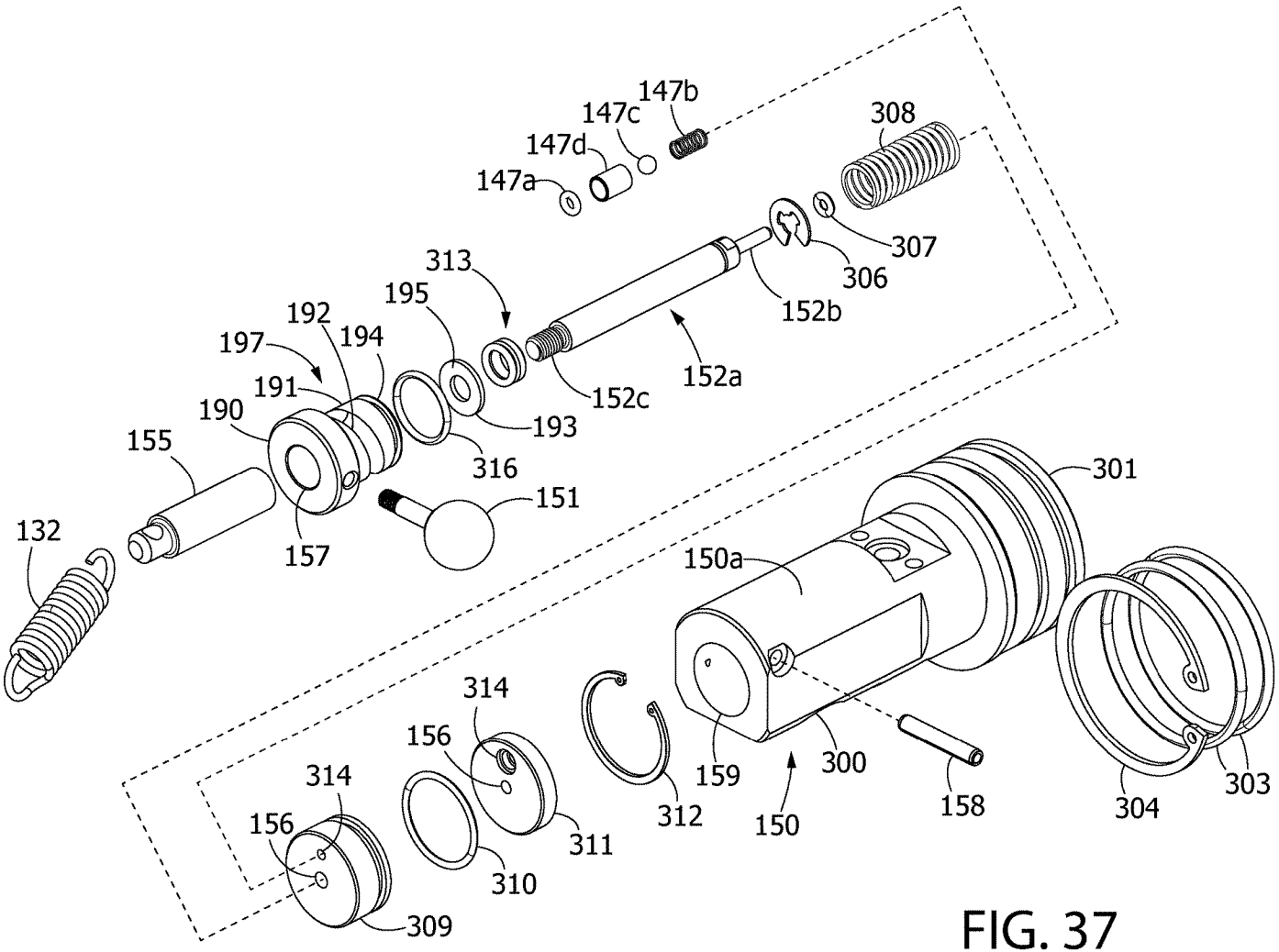
FIG. 37 is an exploded perspective view of the hydraulic cylinder system of FIG. 33.
Figure 38:
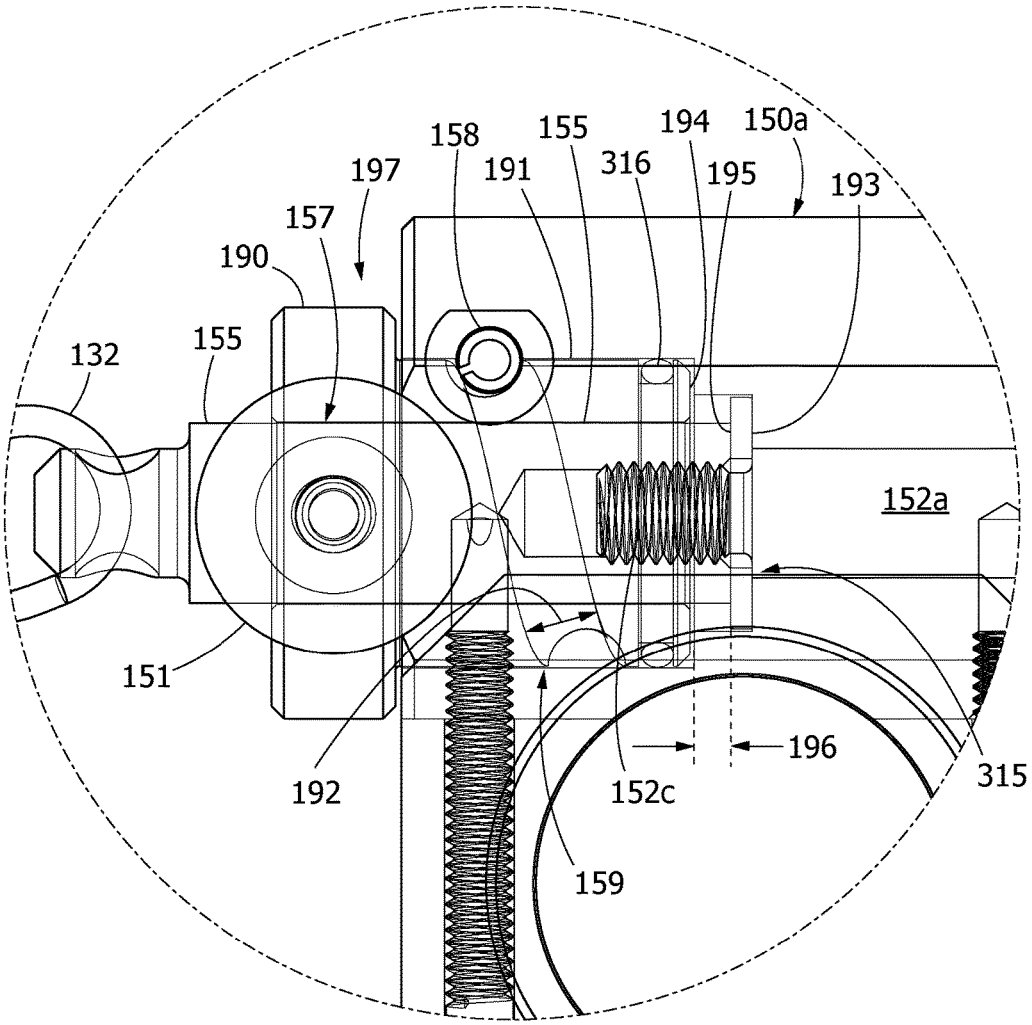
FIG. 38 is an enlarged rear side view of the hydraulic cylinder thereof showing the internals.
Figure 42:
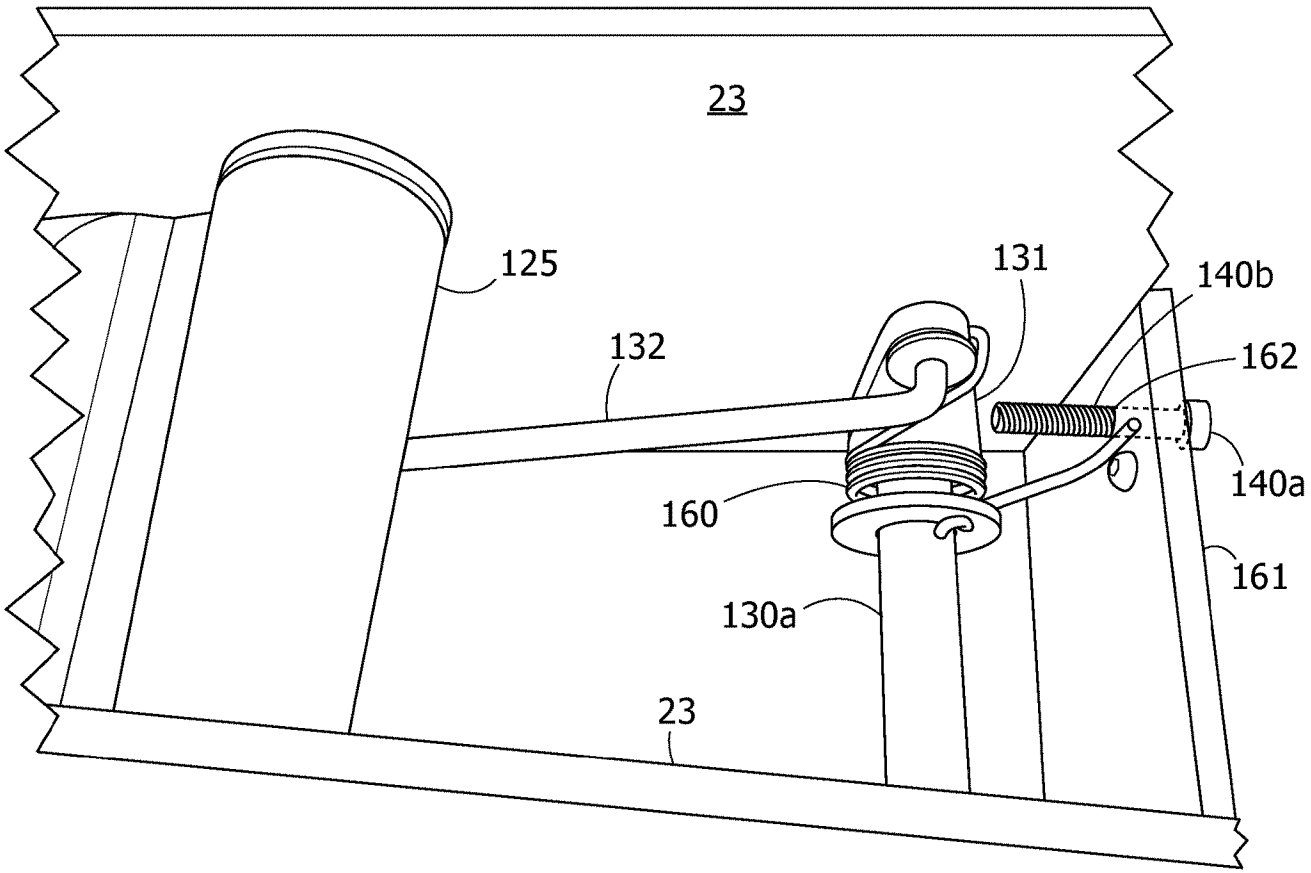
FIG. 42 is a top perspective view showing a portion of an operating lever assembly for the automatic bench return mechanism including an automatic operating lever return mechanism and adjustable bench pad speed control stop.

When the foot lever 130 is then released by the user, the lever automatically rotates back into the upward unactuated position under the biasing action of return spring 160 thereby moving the mechanical linkage 132 in an opposite direction back towards the rear head end of the bench. FIGS. 22, 26, and 37 show the return spring arrangement. In one embodiment, the return spring 160 may be torsion spring arranged around the mounting section 130*a* of the foot lever rod as best shown in FIG. 42. One leg of the spring engages transverse member 161 and the opposing leg engages the lever arm 131 of the foot lever 130 assembly. This biases the lever arm 131 towards the head end (rack end) of the bench (counterclockwise in FIG. 42), which in turn biases the foot lever 130 into the upwards unactuated position associated with full closure of the plunger valve 122. Without the return spring 160, the user would have to not only press the foot lever to open the valve, but then manually pull it back to close the valve. The automatic return of the foot lever is not only easier for the user to operate, but it is less problematic for the equipment to function as designed. In other possible arrangements, the torsion return spring 160 may alternatively be mounted around the pivot pin 135 supported by the support bracket or clevis 138 attached to the hydraulic cylinder assembly 100 such as the valve assembly 145. One leg of the spring may engage the toggle cam 133 and the opposing leg engages the clevis 138 or other part of the hydraulic cylinder assembly 100. The foot pedal 130 biasing action remains the same in this embodiment as described above, but the spring is mounted on the other end of the mechanical linkage 132 closest to the hydraulic cylinder instead of the foot pedal. It will be appreciated that other types of springs including helical compression springs, extension springs, etc. may alternatively be used to bias the foot lever into its upward unactuated position.

In order for the plunger valve 122 to stay open, the user must maintain pressure on the foot lever 130. If pressure is removed from the foot lever, the valve will close and the bench pad 50 will remain in a fixed position. This feature allows for adjustable positioning of the bench pad without ever having to get off the equipment. When the weight lifter experiences maximum fatigue, he/she has the option to press the foot lever and lower the bench pad 50 to the escape position closer to the ground until the weight (i.e. barbell) is removed safely by the support racks 28.

By operation of the foot lever 130, the plunger valve 122 configured to function as an on, off, or throttling valve, is operable to create full flow when in a fully opened position, no flow in a fully closed position, and partial flow in a throttled position therebetween. The rate of descent at which the bench pad 50 drops during an escape scenario initiated by a user is determined by the amount that the valve 122 is open and gravity force generally of the weights of both the user and barbell held by user. In various embodiments, the rate of decent may be controlled automatically or manually by the user to suit both user preferences, and more importantly to achieve a safe controlled drop of the bench pad 50.

Bench Descent Speed Control Safety Mechanism

Prior weight lifting benches known having mechanisms for lowering the bench upon activation of a release mechanism did not provide a means for controlling the drop rate of the bench in an exercise escape scenario, thereby overlooking this important safety issue. The bench descent speed or rate control safety system according to the present disclosure however prevents the bench pad 50 from slamming down when the foot lever 130 is depressed to initiate an escape scenario which may otherwise jolt the user creating a potential for injury. An automatic means for controlling the rate of descent for bench pad 50 to achieve a safe motion is provided in one embodiment by the pressure compensating valve 146 (which in the present embodiment is part of the valve assembly 145 described above). Valve 146 is preferably designed and set to maintain a preset pressure differential across the valve and hence flow rate through the valve regardless of pressure variations in the inlet hydraulic fluid stream that may be caused by users of different physical weights or handling barbell loads which may vary. Accordingly, the rate at which the bench pad 50 will drop when foot lever 130 is depressed downwards will always remain constant thereby reflecting a factory preset pressure differential regardless of whether a heavy or light user is seated on and using the bench, which affects the upstream pressure acting against the valve from the hydraulic cylinder 102 side of the valve. The preset pressure which coincides with the maximum predetermined speed or descent rate for bench pad 50 may preferably be set at the factory as a safeguard and is not adjustable by the user; however, the user may be provided with some ability to adjust the descent rate up to the maximum descent speed. The predetermined maximum descent rate of the bench is therefore independent of the weight load applied to the bench pad. Pressure compensating valves have a cartridge acted on by a spring that regulates the degree that the valve is open. The valve preset pressure differential/flow rate is preferably selected to provide flow of hydraulic fluid through the valve which provides a reasonable rate of descent for the bench pad 50 thereby avoiding a rapid uncontrolled drop jarring the user. Pressure compensating valves are available from numerous commercial sources such as Parker Hannifin Corporation and others.

One possible type of manual speed control mechanism that may be used in lieu of a pressure compensating valve comprises an adjustable speed control stop 140 that limits the distance the foot lever 130 can travel, thus limiting the amount the plunger valve 122 can open. Speed control stop 140 is shown for example in FIGS. 22, 26, and 37. A valve assembly 145 for bench having a speed control stop may comprise only the plunger valve 122 and check valve 147, and eliminates the pressure compensating valve 146 shown schematically in FIGS. 39A-B. However, in other embodiments contemplated, both a speed control stop 140 and pressure compensating valve 146 may be provided to achieve redundancy and a backup for limiting the descent rate to a safe speed. In such an alternative arrangement, the pressure compensating valve may be factory preset to establish a maximum safe rate of descent for the bench pad 50. The speed control 140 stop may provide a user adjustment to adjust the descent rate at which the bench pad 50 drops up to a point that is less than the factory preset maximum limit of pressure compensating valve 146.

By limiting the amount the plunger valve 122 can open using the speed control stop 140, the bench pad 50 in essence can always be set to drop at a slow and safe controlled rate without reliance on a pressure compensating valve which can be omitted in some embodiments. The adjustable descent speed control stop 140 gives users the ability to adjust the lowering speed of the bench pad 50 depending on their size and weight lifting ability. Light weight users can adjust the stop to allow less resistance of the lowering of the bench. Heaver lifters can add more resistance with the stop, adding more resistance and thus slowing down the speed of the bench lowering. The maximum range of motion of the speed control stop 140 is preferably preset at the factory to a value which will always provide a controlled slow bench descent rate regardless of the physical weight of the user and amount of weights being handled during the exercise routine. If in less preferred but satisfactory implementations the user is provided with complete control over the adjustment of bench pad descent rate with only a speed control stop 140, reasonably responsible weight lifters will adjust the rate of descent properly when setting up the bench equipment before exercising and the need ever arises to use the foot lever and activate an escape scenario during an exercise routine.

In practice, heavy users that lift heavy weights create a larger gravity force than light users that lift light weights. The difference in the force of weight from gravity changes the rate at which the bench is lowered. The adjustable speed control stop 140 provides one mechanical means that allows the user to manually adjust the amount of hydraulic fluid that passes through the plunger valve 122 and control the rate at which the bench is lowered. This feature gives all users, regardless of size and strength, the ability to control the equipment at a comfortable rate.

Referring to FIGS. 22, 26, and 37, speed control stop 140 may comprise an enlarged knob 140*a* of any suitable configuration having a threaded stem 140*b* protruding outwards from the knob towards the head end of the bench and lever arm 131 of the foot lever 130. The stem threadably engages a threaded hole 162 formed in a foot end transverse member 161 of the frame 21 that extends between the longitudinal members 23. In one embodiment, transverse member 161 may have a substantially flat plate-like form and be attached to or proximate the distal free ends 23*b* of the longitudinal members 23 at the foot end of the bench. The free end of the stem 140*b* is positioned to engage the lever arm 131 mounted on the mounting section 130*a* of the foot lever rod between the longitudinal members 23. By rotating the speed control stop 140 in opposing directions, the stem 140*b* advances towards or retracts from the lever arm 131. When the foot lever is activated and depressed downwards by a user, the free end of stem 140*b* engages the lever arm 131 to arrest rotation of the foot lever 130, thereby limiting in turn the amount that plunger valve 122 may be opened and drop rate of bench pad 50. In operation, the closer the stem 140*b* of speed control stop 140 is spaced apart from foot pedal lever arm 131 before the foot lever is activated, the sooner the stem will engage the lever arm resulting in a slower bench pad rate of descent. The farther the stem 140*b* of speed control stop 140 is spaced apart from foot pedal lever arm 131 before the foot lever is activated, the later the stem will engage the lever arm resulting in a faster bench pad rate of descent.

Hybrid Hydraulic Cylinder Valve Assembly

FIGS. 57-70 depict the hydraulic cylinder assembly 100 of FIGS. 22-29 described in detail above with an alternative embodiment of a unique hybrid and pressure compensating flow control valve assembly 500 having a compact design. Functionally, the compact valve assembly 500 operates under the same principles as but replaces pressure compensating flow control valve assembly 145 shown in FIGS. 28-32, with important differences in the valve internals. In the compact valve assembly 500 design, the pressure compensating valve 502 interacts directly with and is engageable with the ball check valve 147 to control the position of the check valve. Advantageously, the separate plunger valve 122 is eliminated allowing for a more compact and mechanically simpler hydraulic cylinder design that achieves the same functionality with fewer parts due to the unique arrangement of valve elements.

Referring to FIGS. 57-70, pressure compensating flow control valve assembly 500 includes a valve body which defines a flow manifold block 504 comprising a vertically elongated axial central bore 506 for housing the pressure compensating valve 502 and check valve 147 components. Axial bore 506 defines a vertical centerline CL3 of the valve assembly. A plurality of internal fluid conduits defined by hydraulic cylinder and accumulator ports 507, 508 is formed by additional bores in the manifold block 504. Flow ports 507 and 508 may be oriented perpendicular to axial central bore 506 and centerline CL3 in one embodiment as illustrated; however, other orientations are possible. Flow port 508 creates a flow path between accumulator 106 and axial central bore 506. Flow port 507 creates a flow path between hydraulic cylinder 102 and the axial bore 506. Collectively, the axial central bore 506 and flow ports 507, 508 establish a fluid flow path between hydraulic cylinder 102 and accumulator 106 which is controlled by the pressure compensating valve 502 and check valve 147, as further described herein.

In one implementation, manifold block 504 further includes a first side recess 563 which receives an end of the cylindrical tube of the accumulator 106 and an opposing second side recess 564 which receives an end of the cylindrical tube of the hydraulic cylinder 102. The accumulator and hydraulic cylinder tubes may be inserted into the recess and sealed to the manifold block 504 to prevent leakage of hydraulic fluid by any suitable means. Forms of providing a leak-proof seal include without limitation bolted radial flanges and gaskets/seals, circumferential seal welds, shrink fitting, etc. The hydraulic cylinder 102 and accumulator 106 are cantilevered from the manifold block 504 in opposing directions in which the hydraulic cylinder and accumulator are coaxially aligned as illustrated. Other arrangements are possible.

Check valve 147 includes essentially the same cylindrical check body 503 that defines annular valve seat 147*a*, ball 147*c*, and spring 147*b* already described herein with respect to control valve assembly 145 shown in FIGS. 28-32. The valve seat 147*a* is defined by an internal annular shoulder formed inside the central passage 529 of the check body 503 which defines a flow orifice 562 therethrough which is alternatingly closed by the check ball 147*c* to prevent flow in one operating position, and opens in another operating position to permit flow through the check valve. In one embodiment, the check valve 147 may be disposed proximate to the lower of the manifold block 504 and in direct flow communication with flow port 507 which may similarly be disposed near the lower end of the valve body. Check valve 147 is oriented in a vertical position with the seat 147*a* being at the top and the ball and spring immediately below. Spring 147*b* biases the ball 147*c* upwards against the seat to close off the central flow passage 503 of and flow through the check body 503.

Figure 60:
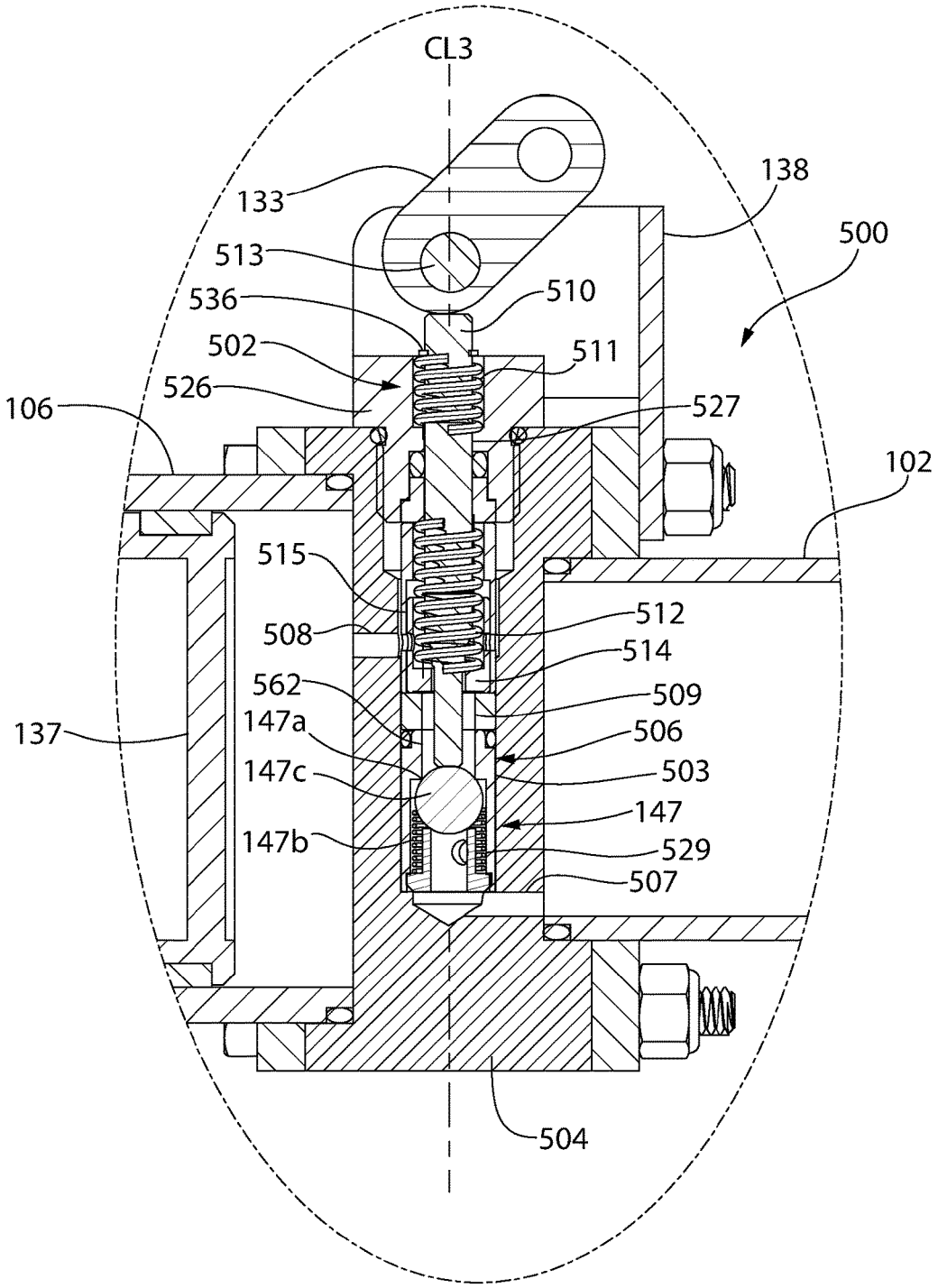
FIG. 60 is a detail side cross sectional view taken from FIG. 59 of the flow control valve assembly of FIGS. 57 and 58.
Figure 61:
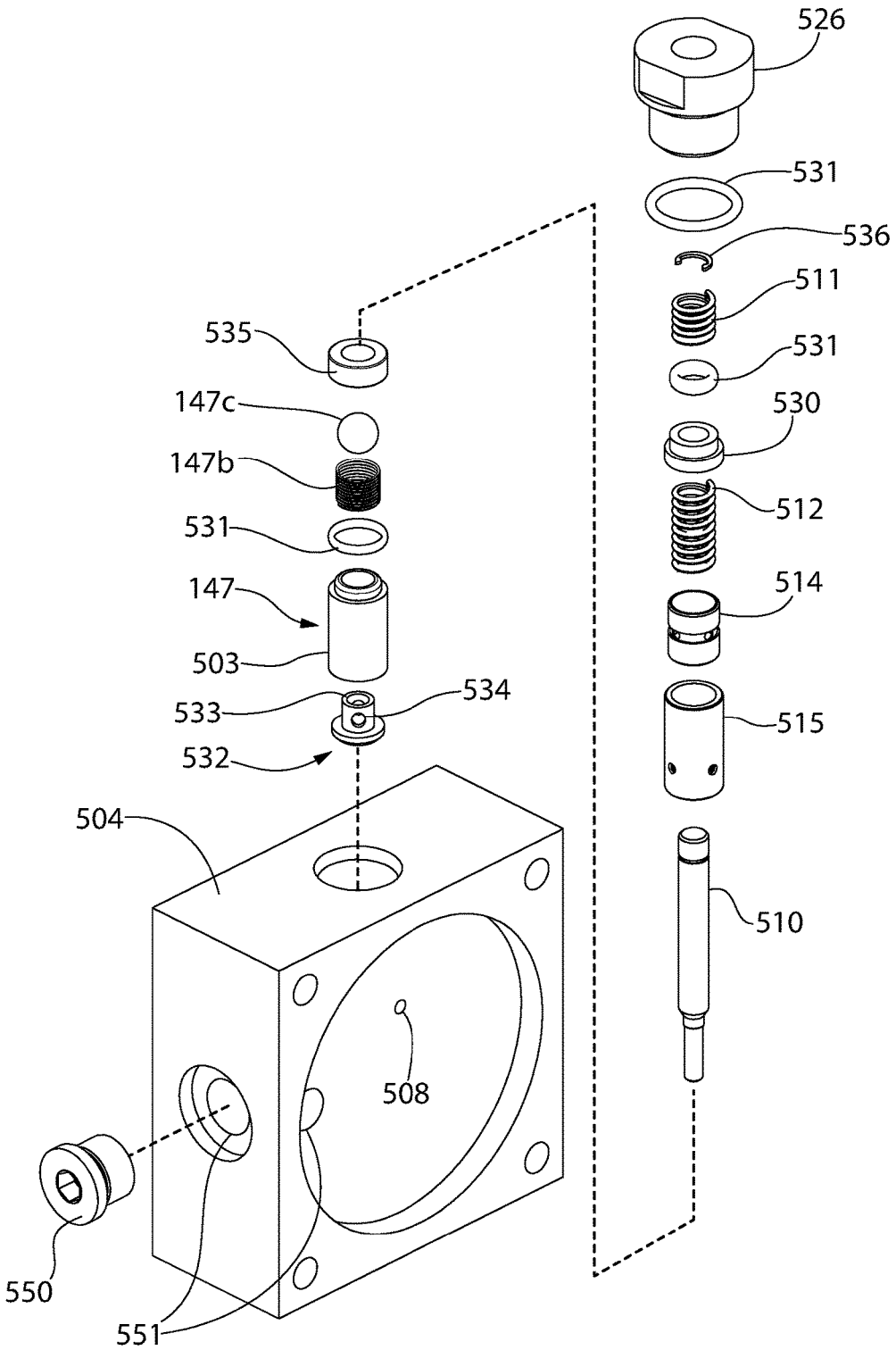
FIG. 61 is an exploded perspective view thereof.
Figure 62:
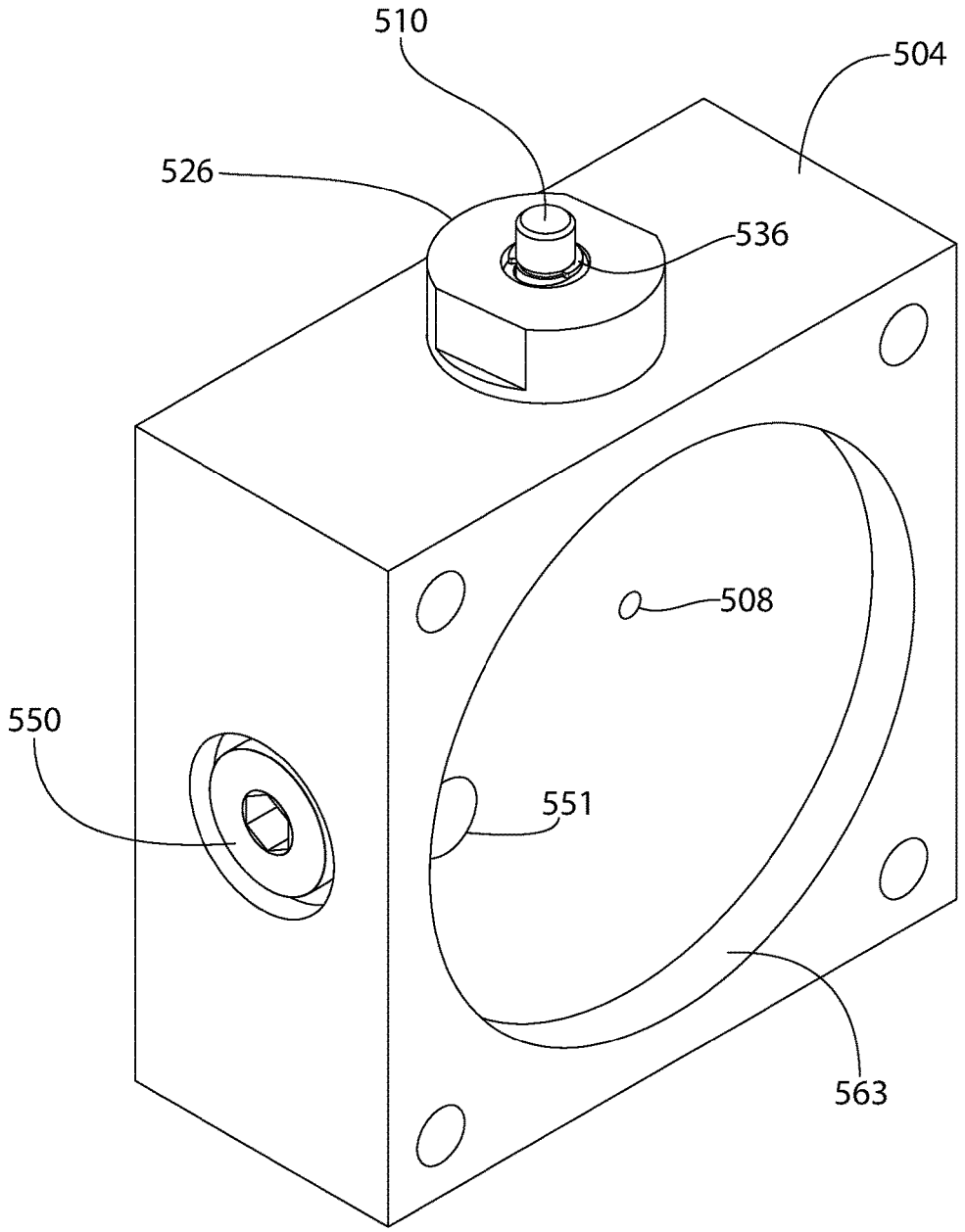
FIG. 62 is a first side perspective views thereof.
Figure 63:
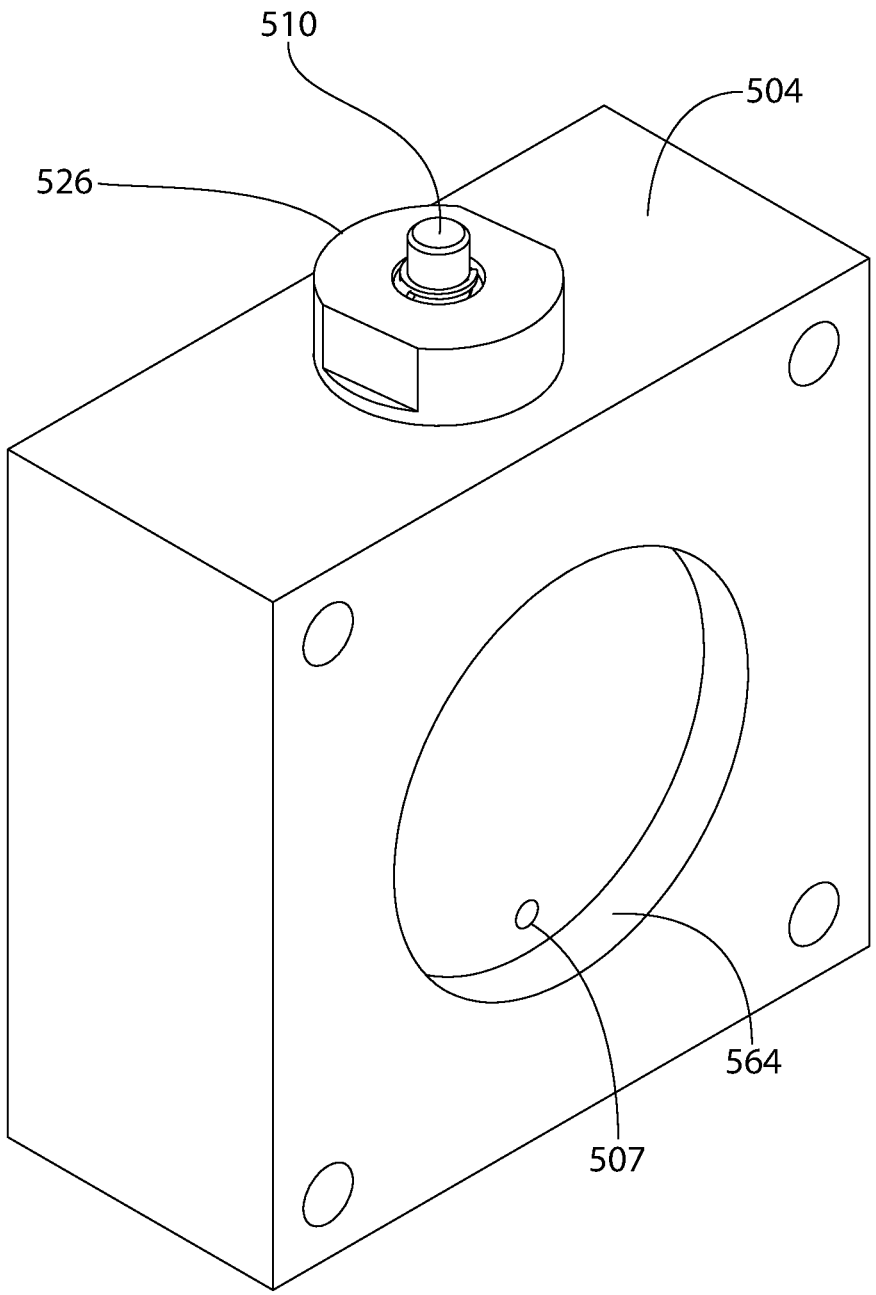
FIG. 63 is a second side perspective view thereof.
Figure 64:
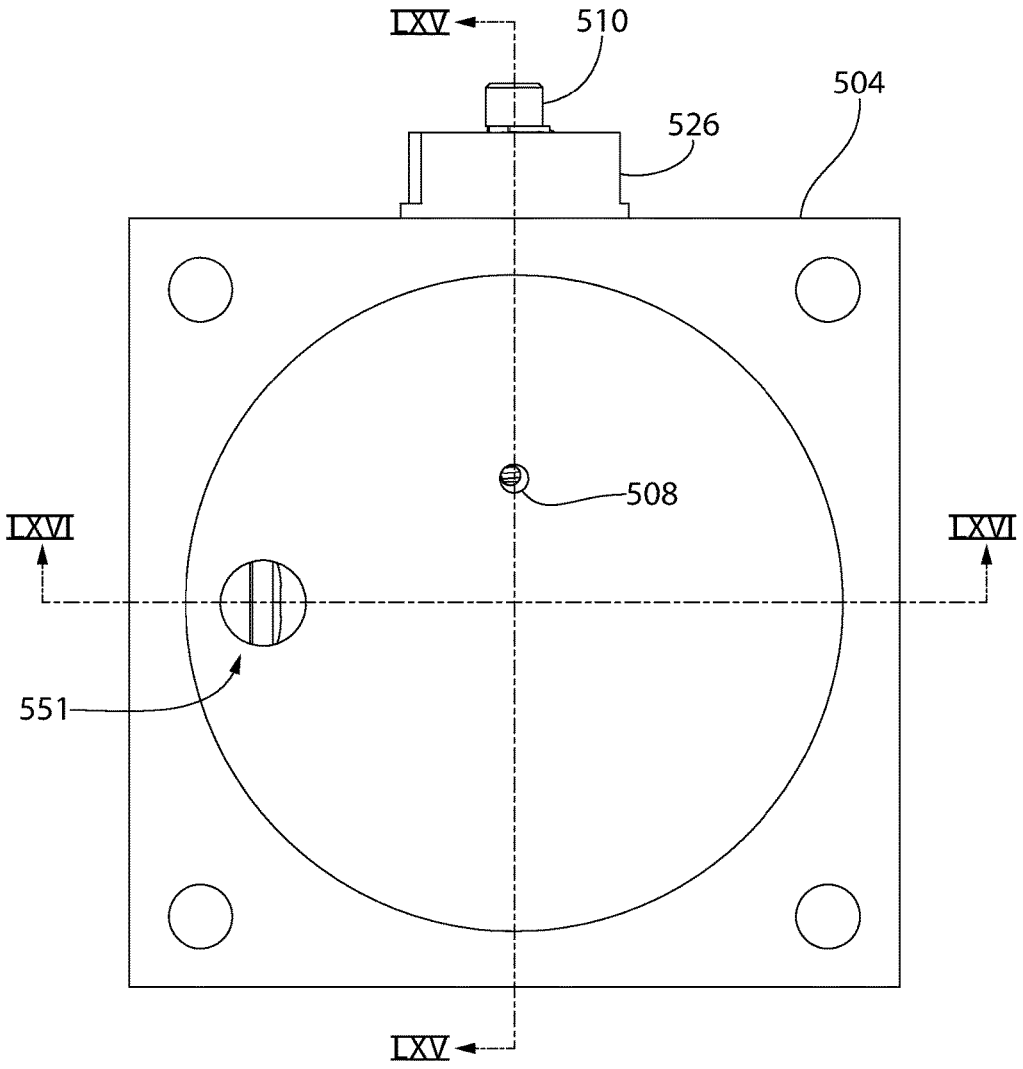
FIG. 64 is a front view thereof.

A generally cylindrical exhaust retainer 532 (see, e.g. FIG. 69) is positioned in the bottom of the axial central bore 506 of the manifold block 504. Retainer 532 has an axial through passage 533 and plurality of lateral flow openings 534 which communicate with the through passage 533. The exhaust retainer 532 nests inside the check body 503 as best shown in FIGS. 60 and 65. The retainer 532 may have a diametrically enlarged head at the bottom end that may include chamfered sides to conform to the shape of the central axial passage 503 closed bottom end.

The pressure compensating valve 502 includes elongated cylindrical plunger 510 movable disposed in manifold block 504 for axial upward and downward movement between extended and retracted positions relative to the manifold block 504. Plunger 510 is biased in an upwards outward direction towards the extended position by return spring 511 toward toggle cam 133 pivotably mounted via pivot 513 to the manifold block 504 above the plunger. In this embodiment, the toggle cam 133 defines a valve operator whose position is changed by mechanism linkage 132 as previously described herein. The bottom end of spring 511 engages a socket disposed in the top of cap housing 526 and top end of the spring may be retained by a retainer clip 536 which engages an annular groove 537 in the plunger 510 (see, e.g. FIG. 70). The top end of the plunger 510 is acted on by the toggle cam 133 (i.e. cam surface 133*a*) and bottom end of the plunger acts on and engages check ball 147*c* as illustrated. Plunger 510 is alternatingly movable between (1) a lower unblocking position (see, e.g. FIG. 65B) to unseat the check ball 147*c* from its seat 147*c* to permit flow through the check valve, and (2) an upper blocking position (see, e.g. FIG. 65A) in which the ball 147*c* is seated to prevent or block flow through the check valve. Accordingly, plunger 510 is coaxially aligned with check valve 147 (and ball 147*c*) in one embodiment.

Figure 70:
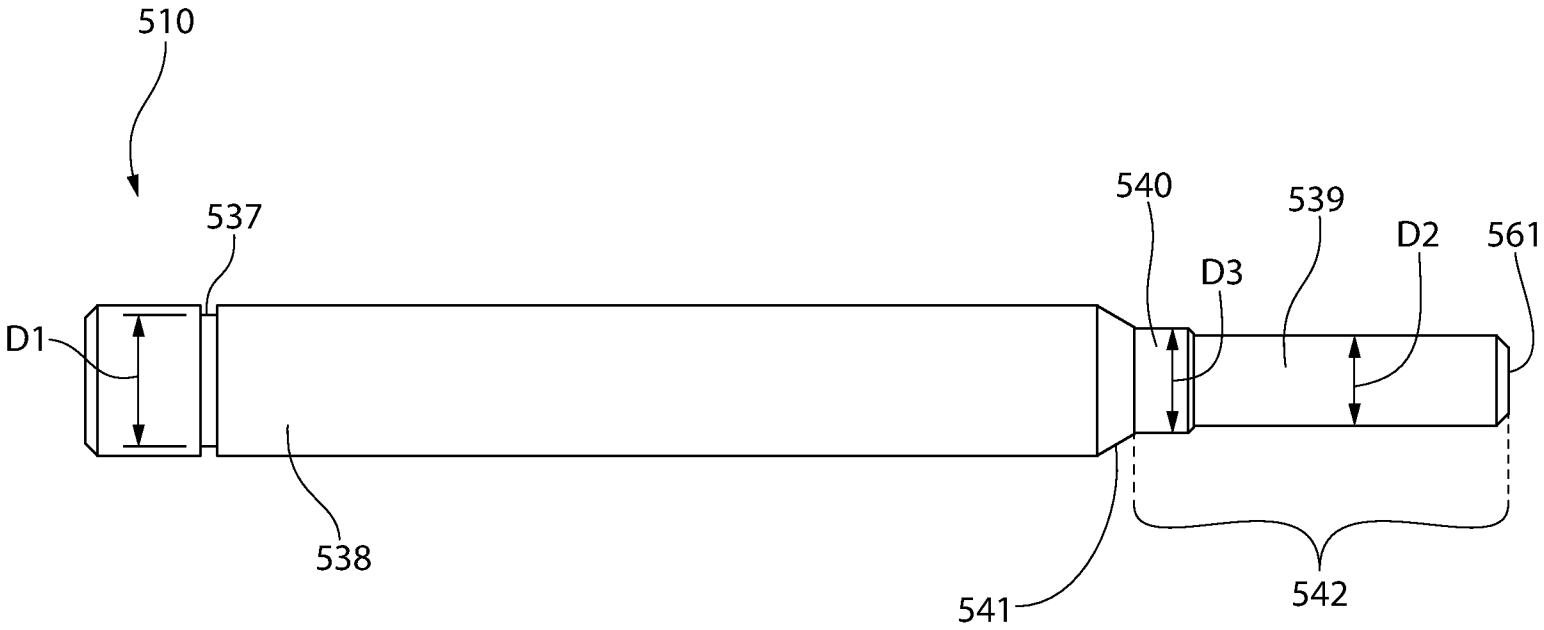
FIG. 70 is a side view of the plunger of the flow control valve assembly.

In one embodiment with reference to FIG. 70, plunger 510 includes an upper operating end 538 having a diameter D1 and a diametrically narrowed and stepped lower working end 542 of various diameters. The working end includes a terminal end segment 539 distal-most to the operating end and having a diameter D2, and an intermediate segment 540 spaced apart from the working end tip 561 of the plunger and adjoining the end segment 539. The terminal end segment 539 defines tip 561. The intermediate segment 540 has a diameter D3 which is larger than D2. Both D2 and D3 are smaller than D1. A frustoconical-shaped shoulder 541 forms a transition between the operating end 538 and working end 542 of plunger 510.

The working end 542 of plunger 510 interfaces with and is alternatingly projectable and retractable in a flow control orifice 543 defined by the head 525 of piston 514 (further described below and shown in FIG. 67) to control the flow of the hydraulic fluid through pressure compensating flow control valve assembly 500 between hydraulic cylinder 102 and accumulator 106. The plunger 510 thereby provides a variable flow control orifice 543 in which the flow rate of hydraulic fluid depends on the position of the plunger in the orifice. Orifice 543 has a diameter D4 slightly larger than both diameters D2 and D3 to allow the working end 542 of plunger 510 to be received through the orifice. In one illustrative example, without limitation, orifice diameter D4 may be 0.180 inches, and the plunger working end diameters D2 and D3 may be 0.150 inches and 0.175 inches. In each instance, the flow area through flow control orifice 543 is defined by the diameter D4 minus diameters D2 or D3, as further described herein.

Figure 67A:
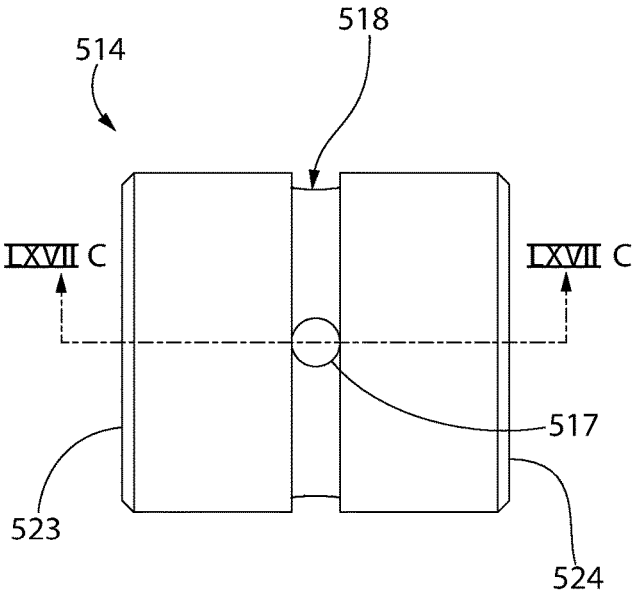
FIG. 67A is a side view of the piston of the flow control valve assembly.
Figure 67B:
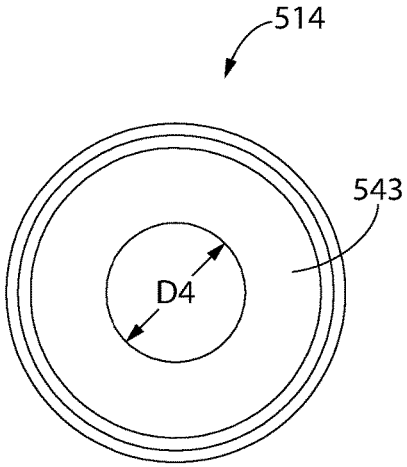
FIG. 67B is an end view thereof.
Figure 67C:
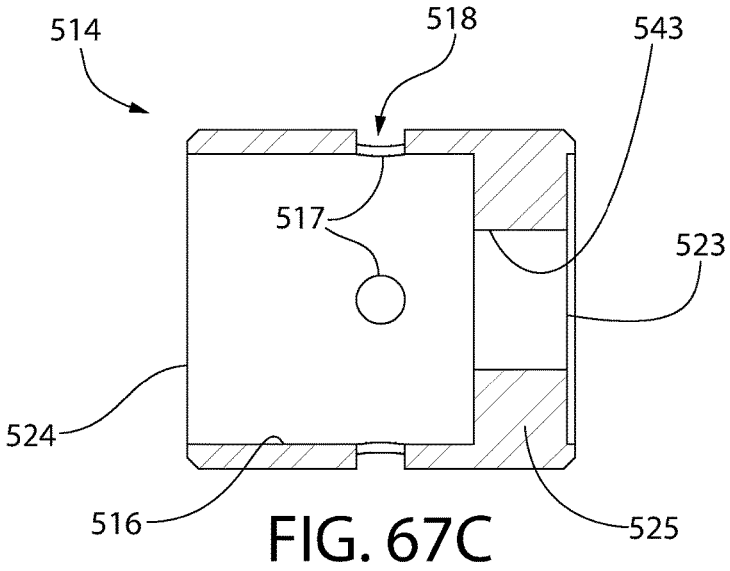
FIG. 67C is a side cross sectional view thereof.
Figure 68A:
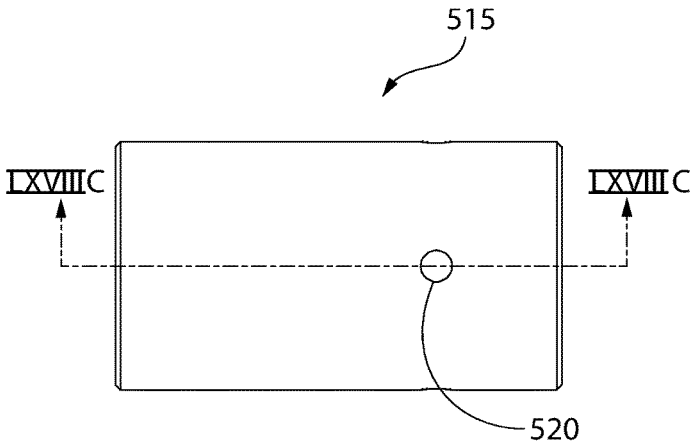
FIG. 68A is a side view of the piston sleeve of the flow control valve assembly.
Figure 68B:
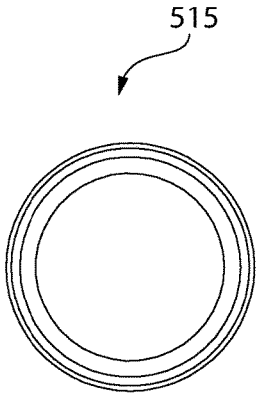
FIG. 68B is an end view thereof.
Figure 68C:
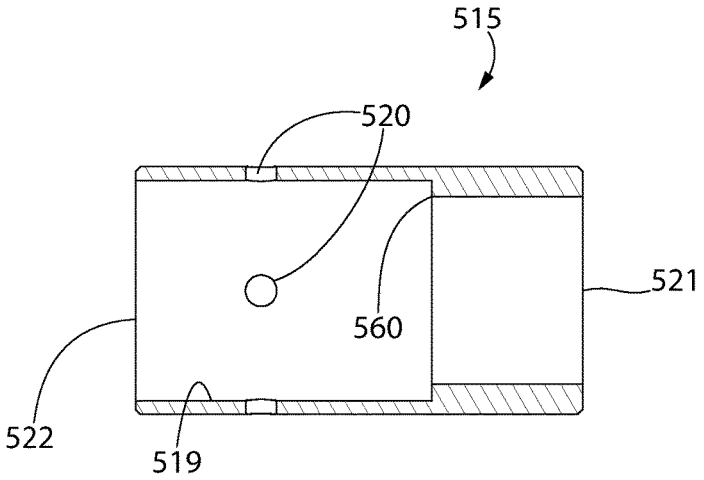
FIG. 68C is a side cross sectional view thereof.
Figure 69A:
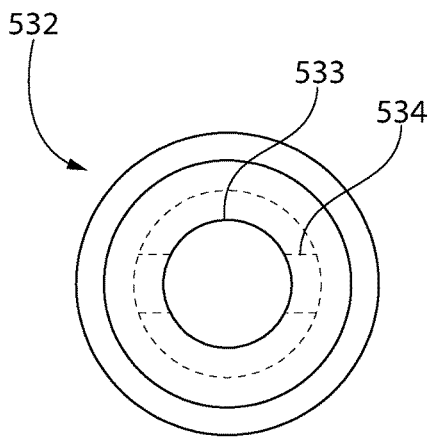
FIG. 69A is an end view of the exhaust retainer of the flow control valve assembly.
Figure 69B:
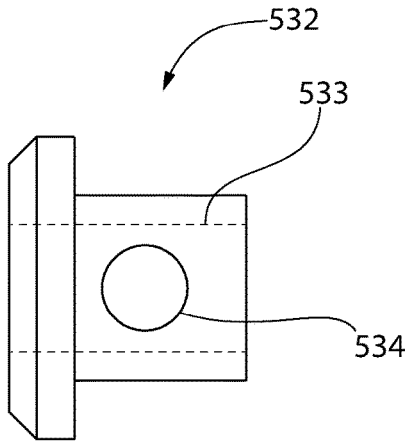
FIG. 69B is a side view thereof.

Pressure compensating valve 502 further includes flow control spring 512, a flow modulation device such as flow control piston 514, and flow control outer sleeve 515. The piston 514 is axially movable in a reciprocating quickly cycling fashion to alternatingly open and close the flow path between the hydraulic cylinder 102 and accumulator 106 when the flow control valve is in the open position with check ball 147 unseated. As best shown in FIGS. 67 and 68, flow control piston 514 and sleeve 515 may each generally have a cylindrical tubular shape. Piston 514 has cylindrical sidewalls which define an internal flow control cavity 516 extending from and through bottom end 523 to top end 524 of the piston. The diameter of the flow control cavity 516 is smaller at bottom end 523 than the top end 524 and defines the flow control orifice 543 formed by a hole through piston head 525 at the bottom end, as illustrated. Similarly, flow control sleeve 515 has an open interior defining central passage 519 extending from bottom end 522 to top end 521. The diameter of the central passage 519 is smaller at bottom end 522 than the top end 521 forming an internal annular shoulder 560 of the sleeve. When the valve is assembled, the piston 514 nests inside sleeve 515 (i.e. passage 519) and is slideably movable therein with respect to the sleeve.

Flow control spring 512 is positioned inside axial central bore 506 of the pressure compensating flow control valve assembly 500 and acts on the piston 514. This biases the piston downwards inside the sleeve 515 in a direction towards the bottom of the valve axial central bore 506 (see, e.g. FIG. 65A). Spring 512 extends through both the piston and sleeve. The spring 512 is retained in the manifold block 504 by cap housing 526 removably mounted to the top end of the body in axial central bore 506. Cap housing 526 may include an upwardly/downwardly open central bore 527 through which the plunger 510 extends and is movable upwards/downwards therethrough. Return spring 511 is seated in the bore 527 around the upper portion of the plunger 510.

Plunger 510, piston 514, and ball check valve 147 are coaxially aligned and mounted in axial central bore 506 as for example in FIG. 60. Hydraulic fluid flows axially through these components and within the central passage parallel to the valve assembly centerline CL3 and both enters and leaves the central passage in a transverse direction to the centerline, as further described herein.

In one embodiment, flow control piston 514 includes circumferentially spaced apart lateral flow orifices 517 extending completely through the sidewalls of the piston from central passage 516. Similarly, flow control sleeve 515 includes circumferentially spaced apart lateral flow orifices 520 extending completely through the sidewalls of the piston from central passage 519. The outer surface of the piston sidewalls may include an annular slot 518 recessed into the sidewalls which is in fluid communication with the lateral flow orifices 517. Slot 518 extends only partially through the piston sidewalls.

The pressure compensating flow control valve assembly 500 further includes other valve appurtenances such as multiple seals 531 such as O-rings, an O-ring retainer 530 inserted into the cap housing 526 as shown, and check O-ring retainer 535. A bleed port 551 extending through the manifold block 504 and fluidly coupling the accumulator 106 to the ambient environment is provided for initially bleeding air from the hydraulic cylinder assembly. In one embodiment, the bleed port may be L-shaped; however, other shapes and orientations of a bleed portion may be used. A plug 550 which may be threaded into the manifold block 504 is provided which seals the bleed port 551 off during normal operation of the hydraulic cylinder assembly.

Operation of the hybrid pressure compensating flow control valve assembly 500 will now be briefly described. The bench auto-return and controlled descent features previously described herein function in the same general manner as before; the primary difference being in the hydraulic and air fluids flow control and path provided by the hybrid valve assembly. Accordingly, the flow schematic diagrams of FIGS. 39-40 remain applicable except plunger valve 122 shown therein is replaced by the present pressure compensating flow control valve assembly 500.

Figure 65A:
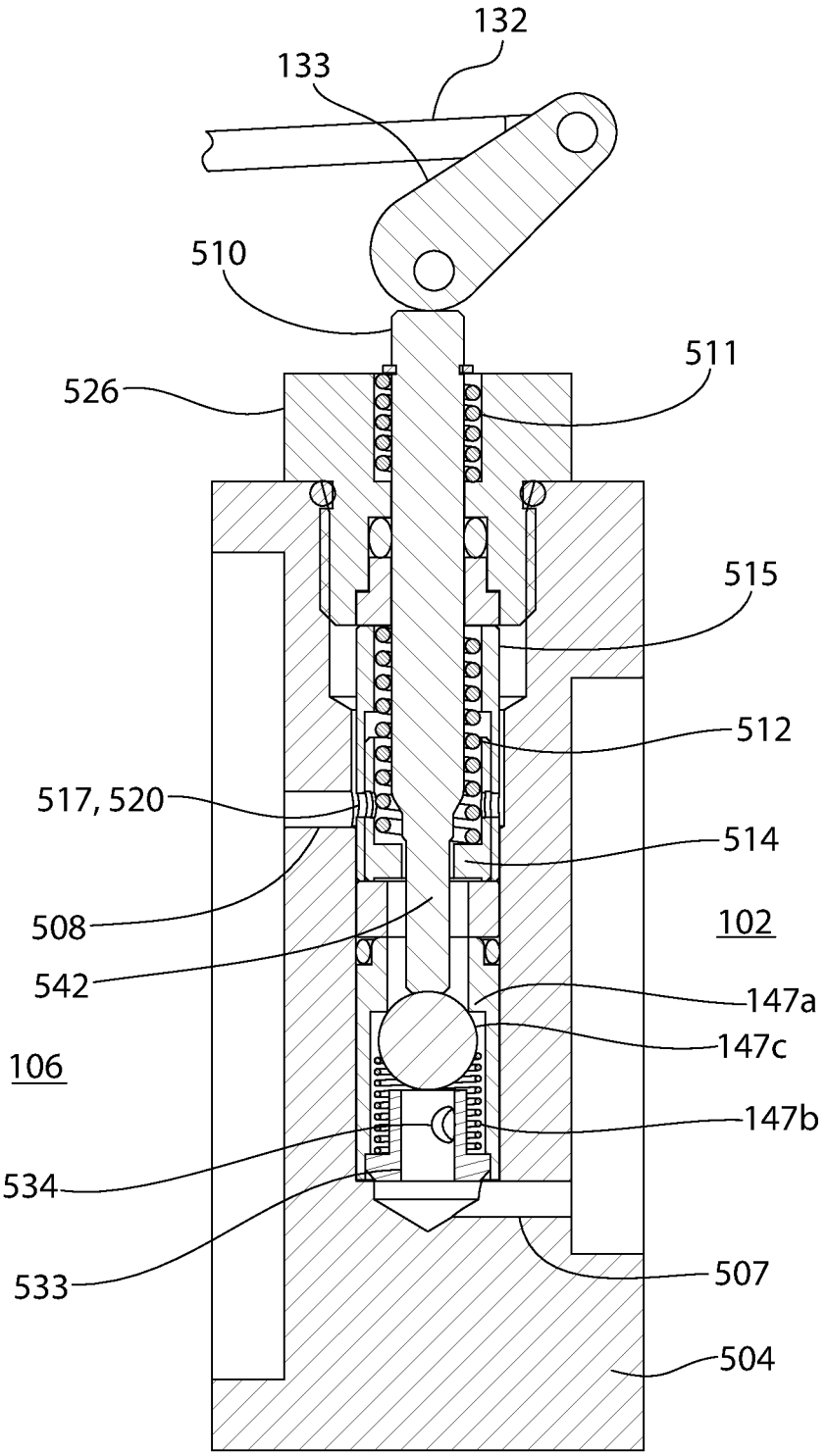
Figure 65B:
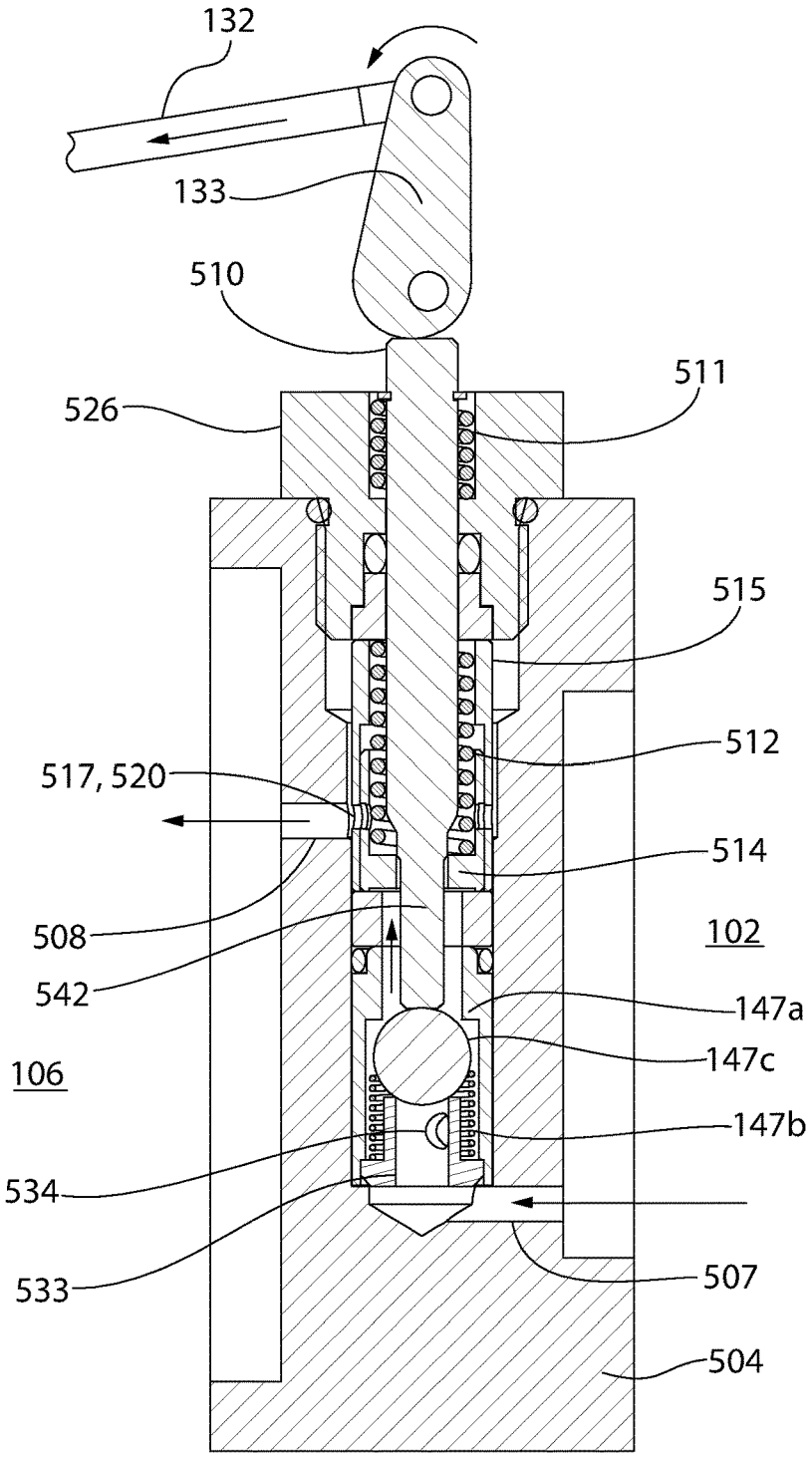

FIGS. 65A-D show sequential cross sectional images of the pressure compensating flow control valve assembly 500 during operation. FIG. 65A shows the valve assembly 500 in its initial position prior to a user seated on the bench initiating an escape scenario via activation of the foot pedal 130. The hydraulic control system is in the state shown in FIG. 39A. Bench pad 50 is in the fully extended normal upper exercise position in which the exchange of hydraulic fluid 101 between the hydraulic cylinder 102 and accumulator 106 is stopped by a closed pressure compensating valve 502 and check valve 147. In this static state, plunger 510 is in the normally "valve closed" extended position and the cylinder rod 116 is fully extended and locked (bench in the full upright position). The flow control piston 514 is in it lower proximal position with piston head 525 abuttingly engaging the top of the check O-ring retainer 535. The lateral flow orifice 517 and annular groove/slot 518 of the flow control piston 514 are horizontally aligned with the lateral flow orifices 520 of flow control sleeve 515. It bears noting that the annular slot 518 eliminates the need for the lateral flow orifices 517 and 520 of the piston and sleeve respectively to be concentrically aligned to enable flow therethrough. Similarly, an annular gap is formed by clearance between the sleeve 515 and inside of the central axial cavity 506 of the flow manifold block 504 eliminating the need for the sleeve's lateral flow orifices 520 to be concentrically aligned with the accumulator port 508.

At this point in the bench descent operating process, the working end 542 of the plunger 510 is positioned in flow control orifice 543 of the piston 514. The working end tip 561 of the plunger is positioned proximate to (i.e. contacting or slightly spaced apart from) the check ball 147*c*. Check valve 147 is closed and its ball is fully biased upwards and seated on valve seat 147*a* via spring 147*b*, thereby blocking the flow path of and preventing hydraulic fluid from flowing from the hydraulic cylinder 102 to the accumulator 106 through valve 502. The hydraulic fluid 101 is pressurized by the weight of the user, added equipment weight of the bench pad assembly, and any free weights being held by the user at the time.

When the user then initiates an escape scenario as already described herein by pressing down on the foot pedal 130, the bench pad 50 and user will begin to descend at a regulated controlled rate as a result of the pressure compensating flow control valve assembly 500. The flow diagram of FIG. 39B is applicable to this stage in the benches' operation. The plunger 510 is pushed downwards via rotation of the toggle cam 133 to the "valve open" retracted positon shown in FIG. 65B (noting that the operated end of the plunger need not be even flush with the outer surface of the manifold block 504 or recessed therein in the retracted position). The bottom tip of the plunger 510 if not previously contacting the check valve ball 147*c* engages and displaces the ball downwards pushing it off of its annular valve seat 147*a*. This opens flow control orifice 543 allowing hydraulic fluid flow in the path shown in FIG. 39B from the hydraulic cylinder 102, through the open check valve, into the pressure compensating valve 502, and finally then into the accumulator cavity. This causes the cylinder rod 116 to retract into the cylinder at a constant speed rate regardless of weight/force on the bench and cylinder rod. Because the pressure in the hydraulic cylinder 102 is initially greater than inside the piston flow control cavity 516 and air 103 in accumulator 106, hydraulic fluid flows through the lower port 507 and upwards through the check valve 147. The hydraulic fluid flows into exhaust retainer 532 from port 507 and laterally outwards therefrom through the lateral openings 534 of the exhaust retainer, around the ball 147*c*, and then upwards in the valve through the flow control orifice 543 and into the flow control cavity 516 of piston 514. At this point, the lowermost terminal end segment 539 of plunger 510 remains positioned in the flow control orifice 543, thereby defining a first flow area formed by the open annular space between the plunger and orifice.

It bears noting that the constant speed rate of descent of the bench pad 50 under compression is achieved by the upwards/downward axial reciprocating motion of the flow control piston 514, which in some embodiments may cycle on a nearly continuous basis as and until the bench moves from the upper position to lower escape position. When the piston is pressurized initially by the hydraulic fluid as described immediately above, the hydraulic fluid pressure acts on the bottom face (end 523) of the piston head 525 causing the piston 514 to move upwards against and compressing flow control spring 512 because the pressure on the face of the piston is greater than the initial pressure inside the piston flow control cavity 516 (see FIG. 65C). This temporarily partially or fully closes the port 508 to the accumulator chamber 104 since the lateral flow orifices 517 and annular slot 518 of the piston 514 become horizontally misaligned with the lateral flow orifices 520 of sleeve 515, thereby partially or fully blocking flow from the piston flow control cavity 516 to the port 508 (see, e.g. FIG. 65C). Hydraulic fluid flow from hydraulic cylinder 102 into the pressure compensating valve 502 is thus restricted and minimized, thereby reducing the bench descent rate. As further seen in FIG. 65C, the diametrically larger flow intermediate segment 540 of the plunger 510 is now positioned in the flow control orifice 543 of the piston 514, creating a second flow arear between the orifice and plunger which is less than the first flow area created when the terminal end segment 539 was positioned in the orifice. This further acts to instantaneously reduce hydraulic fluid flow and slow the bench descent rate.

Figure 65C:
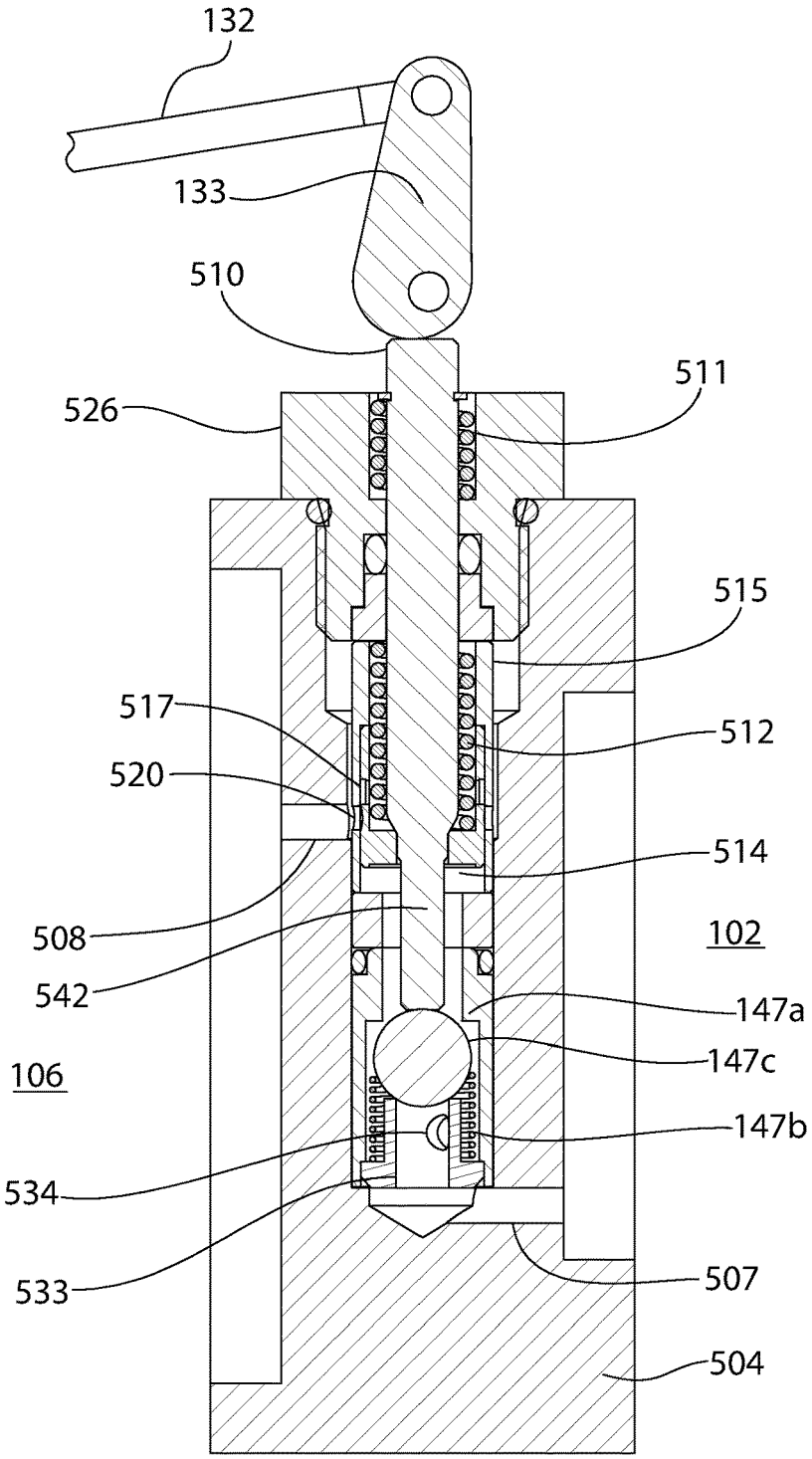
Figure 65D:
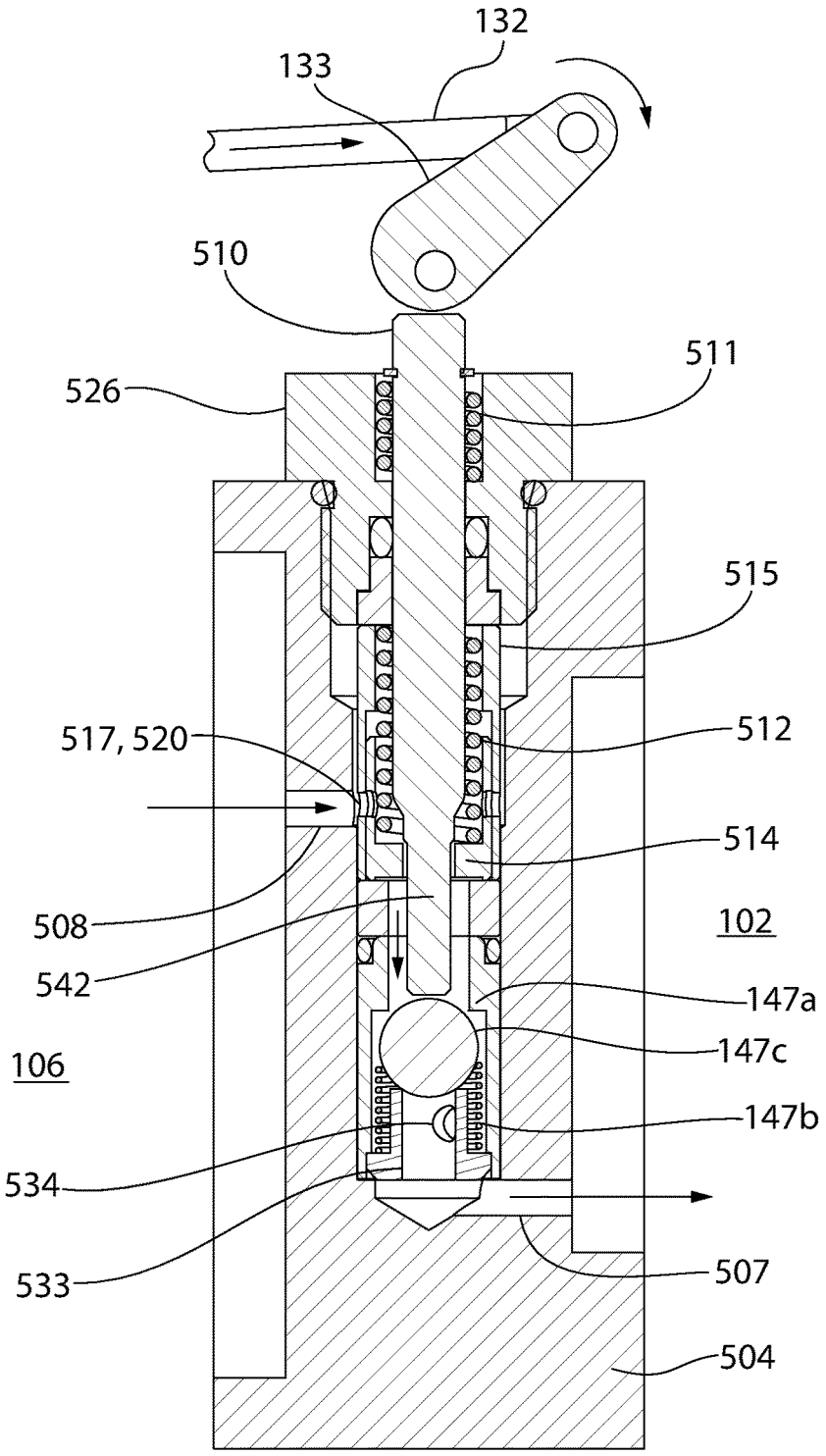
Figure 66:
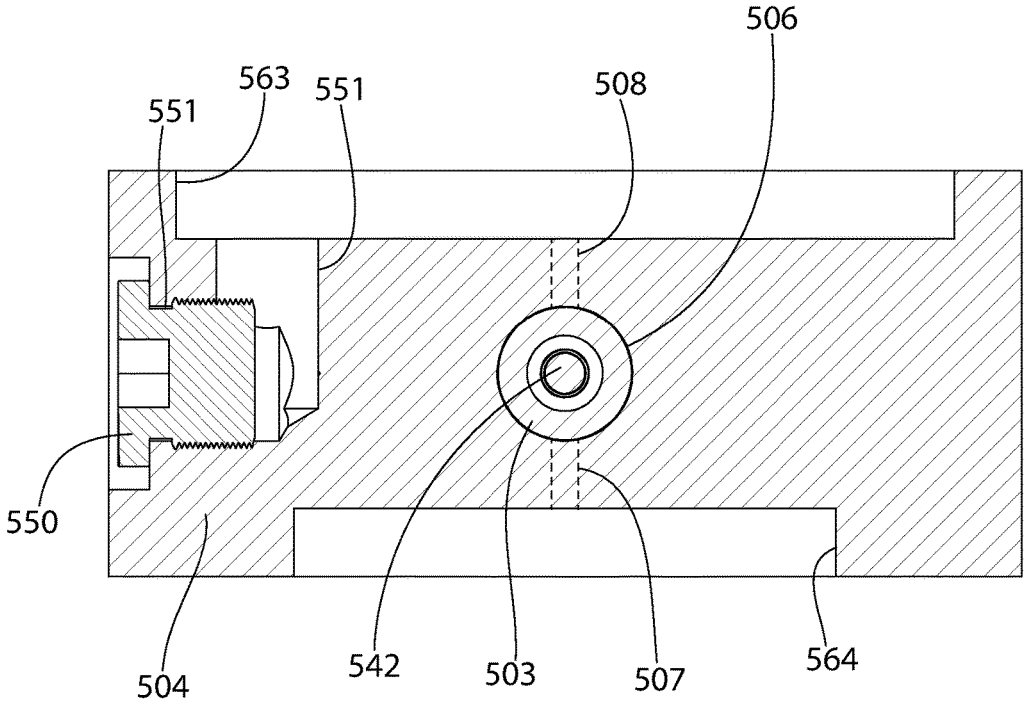
FIG. 66 is a top cross sectional view of the flow control valve assembly taken from FIG. 64.

It bears noting that the maximum upward travel of the piston 514 within outer sleeve 515 is limited by the vertical gap shown in FIG. 65A between the top end 524 of the piston and internal annular shoulder 560 of the sleeve (see also FIGS. 67 and 68) which is formed when the piston is in its lower proximal position relative to check valve 147. In FIG. 65C, this gap is eliminated when the piston 514 is in its upper distal position relative to the check valve.

As the pressure in the piston internal flow control cavity 516 becomes equalized and balanced with the hydraulic pressure on the hydraulic cylinder side of the piston head 525, the biasing action of the flow control spring 512 now is enable to actively press the flow control piston 514 back down to its lower proximal position in a downward movement which again opens the accumulator port 508 as the lateral flow orifices 517, 520 of the piston and outer sleeve 515 become horizontally aligned again. This allows greater hydraulic fluid flow from the hydraulic cylinder 102 into the accumulator chamber 104. This causes the cylinder rod 116 compression/retraction rate and bench descent rate to increase slightly temporarily until the pressure in the piston internal flow control cavity 516 decreases enough to move the flow control piston upward again as describe above when the piston once again partially or fully closes the accumulator port 508 to hydraulic fluid flow.

This foregoing reciprocating piston motion and feedback loop is achieved by the unique design of the pressure compensating valve 502 that provides a constant hydraulic cylinder compression/retraction rate regardless of how much pressure/force is applied to the cylinder rod by the bench and user's weight. Advantageously, this minimizes the possibility of injury to the user caused by rapid dropping and stopping of the bench. It bears noting that the foregoing cyclical motion of the reciprocating piston occurs relatively rapidly and repeats sequentially during the time that the bench pad 50 is in the process of descending until the lower escape position is reached.

Figure 40:
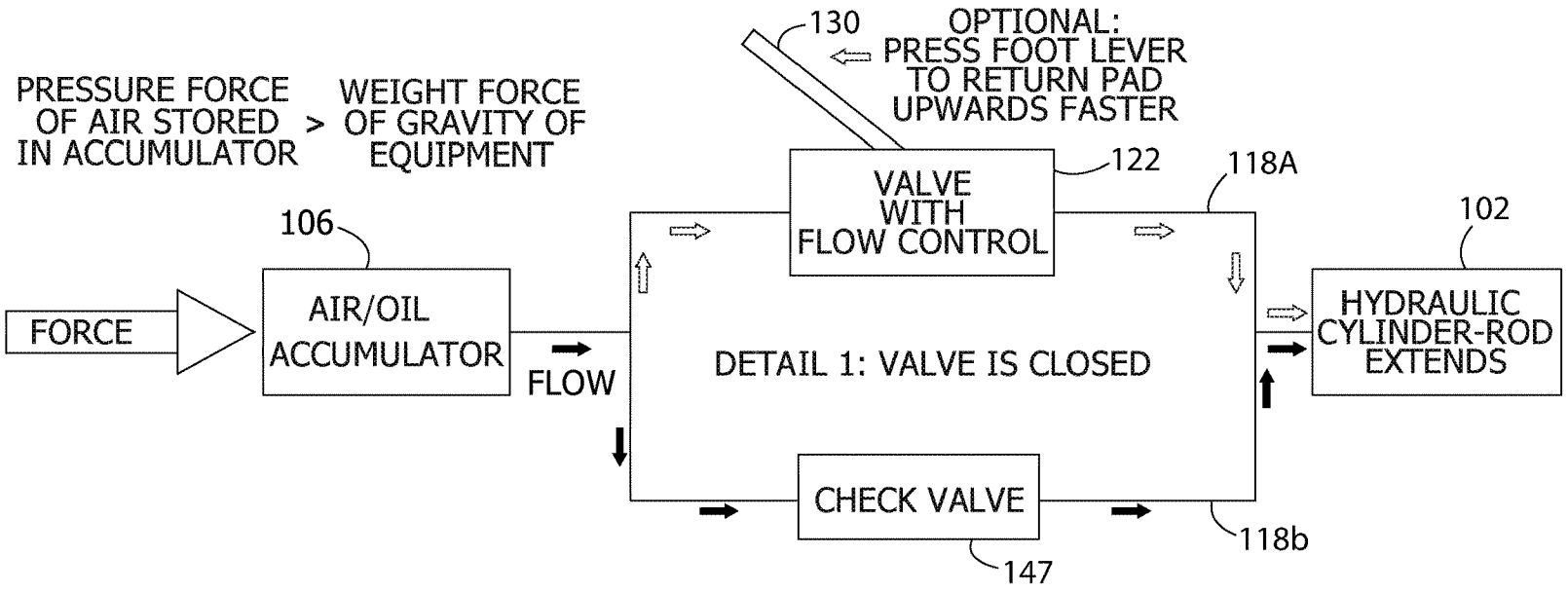
FIG. 40 is a schematic flow diagram of the hydraulic control system in a state when the automatic bench return mechanism is activated and the bench pad is in the process of ascending to the extended upper exercise position in which hydraulic fluid flows from the accumulator to the hydraulic cylinder via a check valve and/or an open plunger valve.

After the bench pad 50 reaches it lowermost escape position, the user may then exit the bench and release the foot pedal 130 to activate the bench auto return feature. The flow diagram of FIG. 40 is applicable to this stage in the benches' operation which initiates the bench auto-return feature. The pressure compensating flow control valve assembly 500 now returns to the position shown in FIG. 65D. When the cylinder rod 116 becomes unloaded (user removed from bench), and is in partial or full compression/retraction into the cylinder 102, and plunger 510 is returned upward via urging by return spring 511 back to its normally extended position, the pressurized hydraulic fluid in and from the accumulator 106 is forced back through check valve 147 causing the cylinder rod to extend and lock in the fully extended position. The bench pad 50 return Because the pressure of the hydraulic fluid in the accumulator is greater than on the hydraulic cylinder side of the pressure compensating valve 502, the fluid from the accumulator is able to displace downward and unseat the ball 147*c* of the check valve 147 permitting flow through the valve to the hydraulic cylinder as shown despite the fact that the plunger 510 is upward and not forcing the ball from its seat. Once the pressure balances between the hydraulic cylinder and accumulator side of the pressure compensating valve 502, the ball will again return upward via the spring and seat, thereby closing the flow path through the valve as seen in FIG. 65A at the beginning of the process.

Although the flow control valve assembly 500 is shown for convenience of description without limitation in a vertical oriented herein, it will be appreciated that the valve assembly may be used in any other suitable angular orientation because the foregoing valve components do not rely on gravity for operation of the valve as described above. The piston 514, plunger 510, and ball check valve 147 are spring biased which allows multiple possible orientations of the valve assembly while still retaining its full functionality. For example, the hydraulic cylinder assembly 100 shown in the weight lifting bench 20 of FIGS. 1-6 herein is disposed obliquely to the vertical and horizontal. Accordingly, the flow control valve assembly 500 is expressly not limited in its applicability to any particular orientation.

Adjustable Flow Control Valve

In another example of a manual type speed control mechanism to regulate the rate of descent of the bench pad 50 shown in FIGS. 33-38, a manually adjustable flow control plunger valve 150 assembly may be provided instead of or in addition to the speed stop 140 described above for fail safe redundancy. The pressure compensating valve 146 is omitted in this design. The adjustable flow control plunger valve 150 may be similar to plunger valve 122, but also includes a rotary stop cam 197 configured to permit external adjustment of the amount of hydraulic fluid flow between the hydraulic cylinder 102 to the accumulator 106. This allows the user to manually adjust the maximum flow rate of hydraulic fluid that passes through the valve to in turn control the rate at which the bench drops when the foot lever 130 is activated. In one embodiment, the rotary stop cam 197 may be a rotary type knob having a working end inside the valve which interfaces with the plug assembly 152, as further described below.

Figure 28:
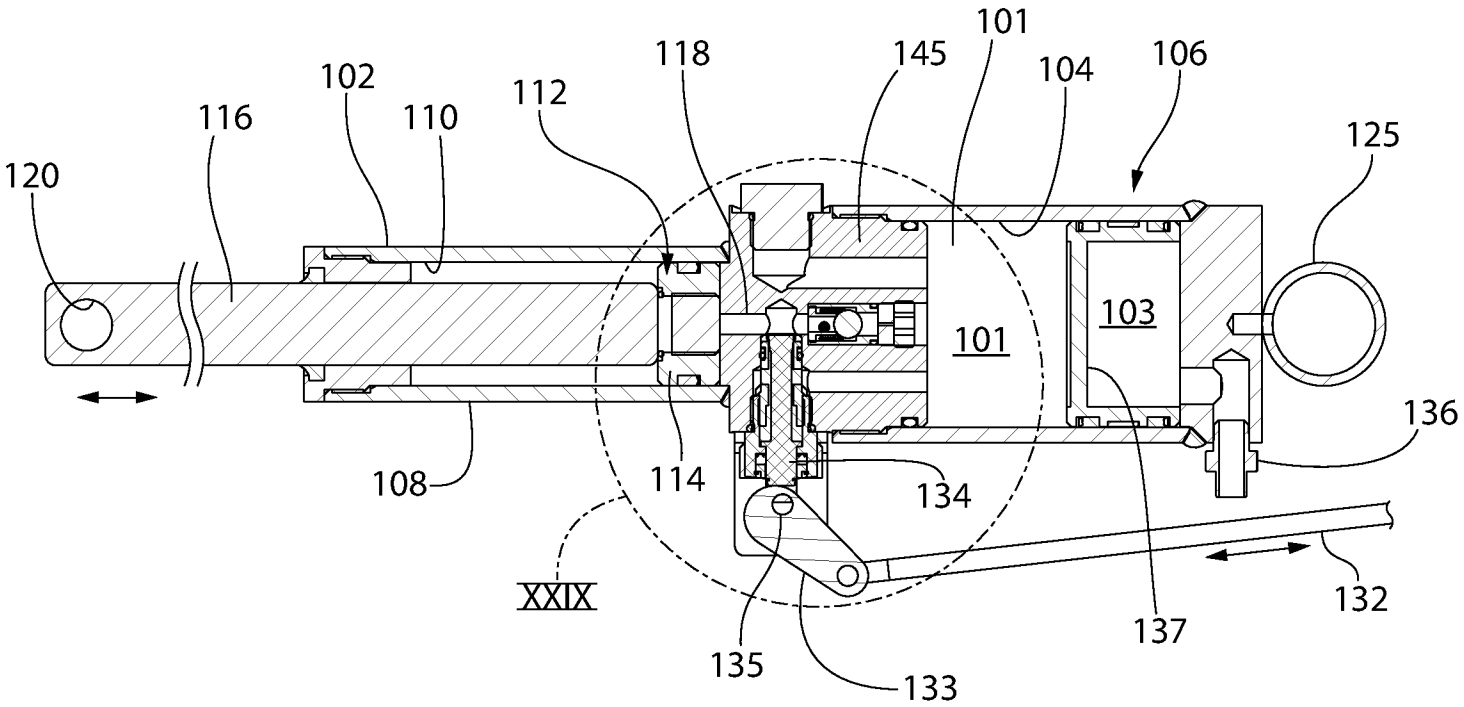
FIG. 28 is a longitudinal cross sectional view thereof.

Referring still to FIGS. 33-38, a hydraulic cylinder assembly 100 comprising adjustable flow control plunger valve 150 is shown having an accumulator 106 which is not coaxially aligned with the hydraulic cylinder 102 like that shown in FIG. 28. Instead, the accumulator 106 is mounted alongside the hydraulic cylinder such as on the top (shown), bottom, or either lateral side such that the axial centerline CL2 of accumulator 106 is parallel to but spaced radially apart from axial centerline CL1 of the hydraulic cylinder 102 in a "piggy-back" type mounting arrangement. In other possible embodiments, the accumulator 106 may be disposed at a 90 degree or oblique angle to the hydraulic cylinder. In yet other possible embodiments, the accumulator 106 may be mounted separately from the hydraulic cylinder 102 in any position and on any appropriate part of the frame 21, and further fluidly connected to the hydraulic cylinder by a flow conduit such as tubing or piping. The mounting position and arrangement of the accumulator with respect to the hydraulic cylinder is not limiting of the invention.

Referring to FIGS. 35-38, the adjustable flow control plunger valve 150 may be mounted on the front or foot end of the hydraulic cylinder 102 as shown. Valve 150 has an axially elongated body 150*a* comprising a cylindrical front end 300 and a diametrically enlarged rear end 301. Rear end 301 is inserted into the open front end 302 of hydraulic cylinder 102 and interfaces with the piston head 114. A pair of annular seals 303 such as O-rings seals the interface between the valve body and cylinder 102 to prevent outleakage of hydraulic fluid. A snap ring 304 fitted to an annular groove 305 on the interior of the hydraulic cylinder 102 proximate to rear front end 302 to removably lock the rear end 301 of the valve body 150*a* to the cylinder.

In the present embodiment, the valve 150 has a spring-biased cylindrical plug assembly 152 comprising elongated shaft 152*a* disposed in an axial bore 159 extending completely through valve body 150*a* from front to rear end. A portion of bore 110 fluidly coupled to the hydraulic cylinder 102 forms a flow conduit between the accumulator 106 and cylinder. Shaft 152*a* is concentrically aligned with the bore 110 of the hydraulic cylinder 102. The shaft includes a diametrically narrow front end 152*b* and opposing threaded rear end 152*c* for threadable coupling to threaded bore 309 in the front end of plunger 155. Front end 152*b* is axially and removably insertable into flow orifice 156 formed through cylindrical valve seat member 309 of the valve seat assembly. An annular seal 307 such as an O-ring disposed around orifice 156 and between a cylindrical end cap 311 and valve seat member 309 is engaged with the terminal front end 152*b* of plug assembly shaft 152*a* when the flow control plunger valve 150 is in a fully closed position.

Compression spring 308 biases plug assembly 152 rearward towards the hydraulic cylinder 102 and closed position of flow control valve 150. External snap ring 306 fitted to the plug assembly shaft 152 engages the rear end of spring 308 and an opposite front end of the spring engages an annular seat formed in axial bore 159. An annular seal 313 between the axial bore 159 and shaft 152 at the front end of spring 308 prevents leakage of air and hydraulic fluid along the shaft outwards from the valve 150. Seal 313 may comprise two or more seals of the same or different type.

In one embodiment, the check valve 147 may be disposed in the valve seat assembly. The check valve which may be a ball type check valve in one embodiment that resides in a flow conduit 314 which extends completely through the valve seat member 309 and end cap 311. Flow conduit 314 fluidly communicates with the flow conduit portion of axial bore 159 (i.e. active portion between annular seal 313 and hydraulic cylinder 102) to form a flow path from the hydraulic cylinder through the check valve 147, and in turn to the accumulator 106 via flow conduit 153. Check valve 147 includes valve seat 147*a*, ball 147*c*, and spring 147*b*. The ball and spring may be movable disposed in an outer sleeve 147*d* in one embodiment.

The end cap 311 of the valve seat assembly traps and holds the valve seat member 309 and check valve 147 in the rear open end of axial bore 159 in the valve 150. A snap ring 312 fitted to the valve body 150*a* adjacent bore 159 locks the valve seat assembly into the valve 150. An annular seal 310 may be provided to seal the valve seat member 309 to valve body 150*a* inside bore 159, thereby ensuring flow exchange between the accumulator 106 and hydraulic cylinder 102 is either through the axial bore 159 or check valve flow conduit 314.

Referring to FIGS. 33-38, flow control valve 150 fluidly communicates with the accumulator 106 via a flow conduit 153 extending from the internal flow conduit portion of axial bore 159 in the valve 150 housing the plug assembly 152 to the accumulator chamber 104. Part of flow conduit 153 is therefore transversely oriented to the cylinder 102. The check valve 147 as shown is physically and fluidly disposed between the bore 110 of the hydraulic cylinder 102 and flow conduit 153 leading to the accumulator 106.

An actuator 154 is mounted on the front foot end of the adjustable flow control plunger valve 150 which includes an elongated and axially slidable cylindrical stem or plunger 155 partially disposed inside the valve. Plunger 155 is connected to the plug assembly 152 at one end internal to the valve 150 and to mechanical linkage 132 at the opposite end which protrudes outwards beyond the valve body. In this embodiment, the mechanical linkage 132 is shown in the form of an extension spring having one end loop connected to a through aperture in plunger 155 and an opposite end loop that connects to the lever arm 131 of the foot lever 130. Linear movement of plunger 155 in opposing axial directions via the foot lever in turn linearly moves the plug assembly 152 in the same manner to open or close the plunger valve 150.

With particular reference to FIGS. 35-38, the plunger 155 of plunger valve 150 is mounted inside an axial passageway 157 formed inside and through the rotary stop cam 197 for sliding movement. Rotary stop cam 152 includes an enlarged circular operator head 190 disposed outside the valve body 150*a* and an elongated cylindrical stem 191 inserted through a complementary configured end portion of axial bore 159 formed in the front foot end of the valve body 150*a* opposite the hydraulic cylinder 102. The stem 191 has a first diameter sized for insertion into bore 159 and operator 190 has a second diameter larger than the stem 191 and bore 159 such that the operator is not insertable into the bore and remains outside the valve body.

The rotary stop cam 197 cooperates with the operating stem 155 to limit the amount that the plunger valve 150 can be opened when the foot lever 130 is fully actuated (i.e. depressed downwards towards the floor). To achieve this, the stem 191 of plunger 155 includes a partial helical cam groove 192 extending partially around the circumference of the stem which receives a lateral cam follower pin 158 therein. Cam groove is obliquely oriented with respect to centerline axis CL1 of the hydraulic cylinder 102. Pin 158 is transversely mounted to axis CL1 in the valve body 150*a*. The pin 158 partially protrudes into axial bore 159 in the valve body that receives stem 191. The stem 191 advances or retracts axially by a small distance each time the actuator head 190 is rotated (depending which direction the head is turned) via cooperation between the cam groove 192 and cam follower pin 158.

The free end of the rotary stop cam stem 191 opposite operator head 190 defines a vertical annular stop surface 194 which faces towards hydraulic cylinder 102. Surface 194 interacts with a mating vertical annular abutment surface 195 defined by a diametrically enlarged washer 193 abuttingly engaging the rear end of the plunger 155 in axial bore 159 opposite the end of the plunger with through hole coupled to mechanical linkage 132. Washer 193 forms an operable part of plunger 155 being fixedly secured thereto and trapped between the rear end of the plunger and step 315 in shaft 152*a* between diametrically smaller front end 152*c* and main portion of the shaft (best shown in FIG. 38). When the plunger valve 150 is in a closed position, an axial gap 196 is formed between the stop and abutment surfaces 194, 195. The gap closes when valve 150 is opened causing stop surface 194 to abuttingly engage abutment surface 195. It bears noting that the washer 193 engaged with the rear end of plunger 155 further functions to prevent the mechanical linkage 132 connected to the opposite end of the plunger from completely pulling the plunger out of the valve body via the mutual engagement between the stop and abutment surfaces 194, 195. An annular seal 316 seals the rotary stop cam stem 191 to the axial bore 159 of the valve body 150*a* to prevent fluid or air leakage therebetween.

The axial position of the stop surface 194 is adjustable by the user via rotating actuator head 190 which activates the cam and follower features described above. The position of stop surface 194 limits the amount that the plunger 155 and plug assembly 152 connected thereto can move axially via mutual engagement between the stop and abutment surfaces 194, 195 when gap 196 is closed. This in turn limits the degree to which the working end of plug assembly 152 is inserted or removed from the flow orifice 156 at the hydraulic cylinder, thereby in effect limiting the amount that the plunger valve 150 is opened or closed which controls the flow rate of hydraulic fluid through the valve and importantly the drop rate of the bench pad 50. The greater amount that the rotary stop cam stem 191 is inserted into the valve body 150*a*, the lower the flow rate of hydraulic fluid through the flow orifice 156, and vice-versa.

The safety feature of a controlled bench pad 50 drop rate may be achieved in one possible approach by design of the circumferential extent or length of the helix of the helical cam groove 192 based on the foregoing discussion. The cam stem 191 can only be inserted or withdrawn from the valve body 150*a* by an amount commensurate with the extent or length of the groove 192 in which the cam follower pin 158 travels. A maximum safe amount that the valve 150 may be opened which controls drop rate of bench pad 50 is controlled by preselecting a circumferential extent/length of the cam groove 192 at the factory such that the pad will drop slow enough for a heavy user to avoid too rapid a descent and sudden stop when the bench fully lowers in the escape position, yet still function to allow the bench pad to drop if a light user is lifting weights on the bench. Other means for controlling the maximum degree to which the valve 150 may be opened to cause the bench pad 50 to drop at a safe rate may be used.

Operation of the adjustable flow control plunger valve 150 will now be briefly described. In use, the adjustable flow control plunger valve 150 is normally spring biased into the closed position which cuts off flow of hydraulic fluid from the cylinder 102 to the accumulator 106 (see, e.g. FIGS. 35 and 36). The plug assembly 152 is shown with the narrow front end 152*b* of plug assembly shaft 152*a* inserted into the flow orifice 156 between the hydraulic cylinder 102 bore and portion of the flow conduit 153 internal to the valve.

Valve 150 operates in a similar manner to plunger valve 122 described above and shown in the flow diagrams of FIGS. 39A-B. The plug assembly 152 in the present embodiment however is concentrically aligned with the hydraulic cylinder bore 110 instead of disposed at a 90 degree angle. In sum, pressing the foot lever 130 downwards pulls the mechanical linkage 132 (an extension spring in this embodiment) forward towards the front of the bench, thereby axially withdrawing the plug assembly 152 from the internal flow orifice 156. The plug assembly 152 is configured such that the rate of hydraulic fluid flowing through the valve 150 may be regulated by the degree to which the valve is opened via the foot lever.

The maximum amount that the valve 150 is able to open when actuated can be adjusted by the user in advance via the rotary stop cam 197 which acts as a speed limit stop to restrict the axial motion of the plunger 155, as described above. In short, rotating the rotary stop cam 197 in opposing directions moves the annular stop surface 194 of the stop cam closer or farther away from abutment surface 195 of the plunger assembly, thereby adjusting the width of the control gap 196 therebetween. When the foot lever 130 is fully depressed to implement an escape action, the gap 196 is eliminated as the plunger 155 moves axially towards the front of the bench bringing surfaces 194, 195 into contact. This restricts the amount that the plug assembly shaft 152*a* is withdrawn from the flow orifice 156 in the valve seat assembly to limit the flow rate of hydraulic fluid from the cylinder 102 to the accumulator 106. The greater the valve 150 opens, the faster the bench pad 50 will drop and vice-versa thereby controlling the rate of descent of the pad. The adjustable flow control plunger valve 150 is moveable between a fully open position allowing full flow, a closed position stopping flow, or a throttled position therebetween by action of the foot lever 130. Preferably, the rotary stop cam 197 is designed via the provided length of the cam groove 192 thereon as described above to limit the maximum width of the control gap 196 which will always provide a safe controlled drop rate of the bench pad 50 regardless of any adjustments made by the user. This is considered an important safety feature not heretofore provided by known weight lifting bench mechanisms.

It bears noting that foot lever 130 and mechanism linkage 132 although in the form of a spring in this non-limiting embodiment operate in the same manner and interact with the plunger 155 to open/close the plunger valve 150 as in the pressure compensating valve assembly 145 described herein.

Bench Pad Auto-Return Feature

According to one aspect of the invention, an auto-return system is provided which automatically returns the bench pad 50 to its upper exercise position after an escape scenario.

The accumulator 106 described herein provides one means for returning the bench pad upwards, as explained below.

As already described herein and shown in FIGS. 39A-B, the escape scenario is first initiated by the user pressing the foot lever 130 downwards which lowers the bench pad 50 to the lower escape position to allow the user to escape from under the barbell. When the user now gets off the bench equipment with the bench pad 50 in its lower escape position, the user releases the foot lever 130 which returns to the upward unactuated position that in turn moves the plunger valve 122 (or alternatively adjustable plunger valve 150 if provided instead) back to its closed position via the mechanical linkage 132. Referring to the hydraulic flow diagram of FIG. 40, at this point in the process the force from the pressurized air stored in the accumulator 106 now is greater than the gravity force from the weight of the equipment without the user seated on the bench pad 50. This is accomplished by initially pressuring the air in the accumulator 106 to a pressure which exceeds the bare weight of the bench pad structure alone without a user seated thereon. The pressurized air forces the hydraulic fluid 101 in the accumulator 106 to bypass the plunger valve 122 (now closed), and flow back to the hydraulic cylinder 102 through a check valve 147. This extends the cylinder rod 116 from its prior retracted position when the bench pad 50 is in the lower escape position. As the rod extends, it exerts a force on the rear (head-end) strut 32 causing both strut 32 and front (foot-end) struts 31 operably coupled by the bench pad 50 to move back upwards. The struts 31, 32 pivot about their fixed pivot point locations, causing the angle between the struts relative to the ground and frame base 22 to increase, thus raising the bench pad 50 to the upper exercise position.

In addition to relying on the reverse flow path formed by the check valve 147 to return the bench pad 50 upwards, the user may optionally also press downwards on the foot lever 130 to open the plunger valve 122 and speed up the bench return. This will create a dual reverse flow path for the hydraulic oil 101 from the accumulator 106 back into the hydraulic cylinder 102 as shown in FIG. 40. This alterative flow path back in a reverse direction through plunger valve 122 to the hydraulic cylinder 102 is represented by open flow arrows and the normal automatic flow path through the check valve 147 to the cylinder is represented by the closed (solid) flow arrows.

Figure 43:
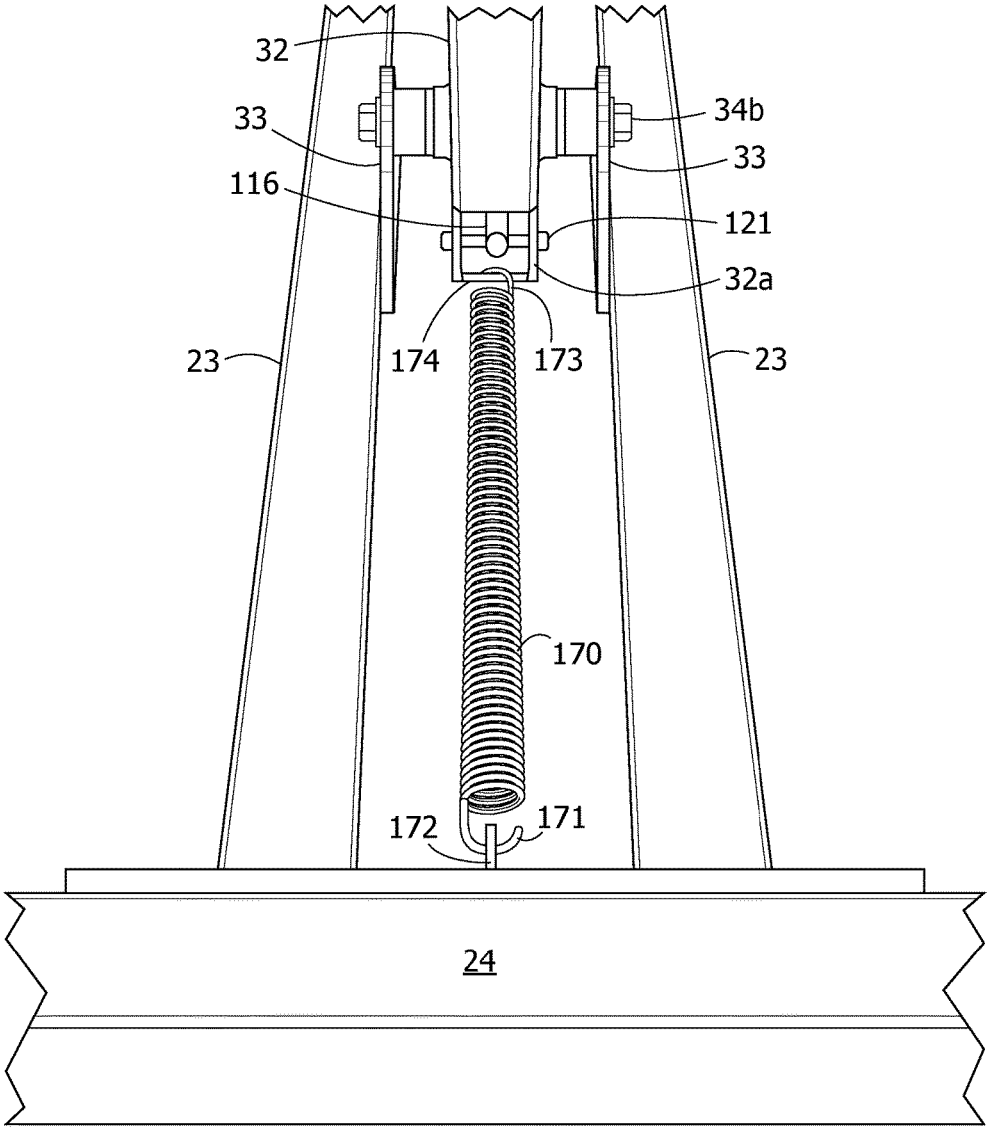
FIG. 43 is a top perspective view showing an alternative bench pad automatic return mechanism comprising a spring usable in lieu of or in addition to an accumulator.

The automatic bench return feature can be accomplished using either the stored air pressure in the accumulator 106 described above to pressurize the hydraulic cylinder 102 (which is high enough to overcome the weight of the unloaded bench pad without a user thereon), or in an alternative embodiment an extension spring mechanism, or a combination of both. FIG. 43 shows an extension spring 170 having a first hooked end 171 engaged with a tab 172 extending from cross member 24 of the frame 21 and an opposite hooked end 173 engaged with a cross pin 174 mounted to pivot extension 32*a* on the lower end of rear strut 32. Cross pin 174 extends laterally between spaced apart sides 175 of pivot extension 32*a* and is disposed below cross bolt 34*b* to impart a pivoting action about the cross bolt via the extension spring. End 171 of spring 170 engages an opening formed in tab 172. In operation, when the escape scenario described herein is initiated, the extension spring 170 exerts an axial pulling force on the bottom of rear strut 32, thereby causing the strut and bench pad 50 to pivot and automatically return back upwards into the starting exercise position when the user gets off the pad. Spring 170 is selected with a spring force which is greater than the weight of the bench pad 50 without a user seated thereon. It will be appreciated that other types of springs such as for example without limitation compression springs, torsion springs, etc. may be used in the alternative to provide the same functionally of the bench auto-return feature.

Second Operating Lever and Accumulator Option

Figure 41:
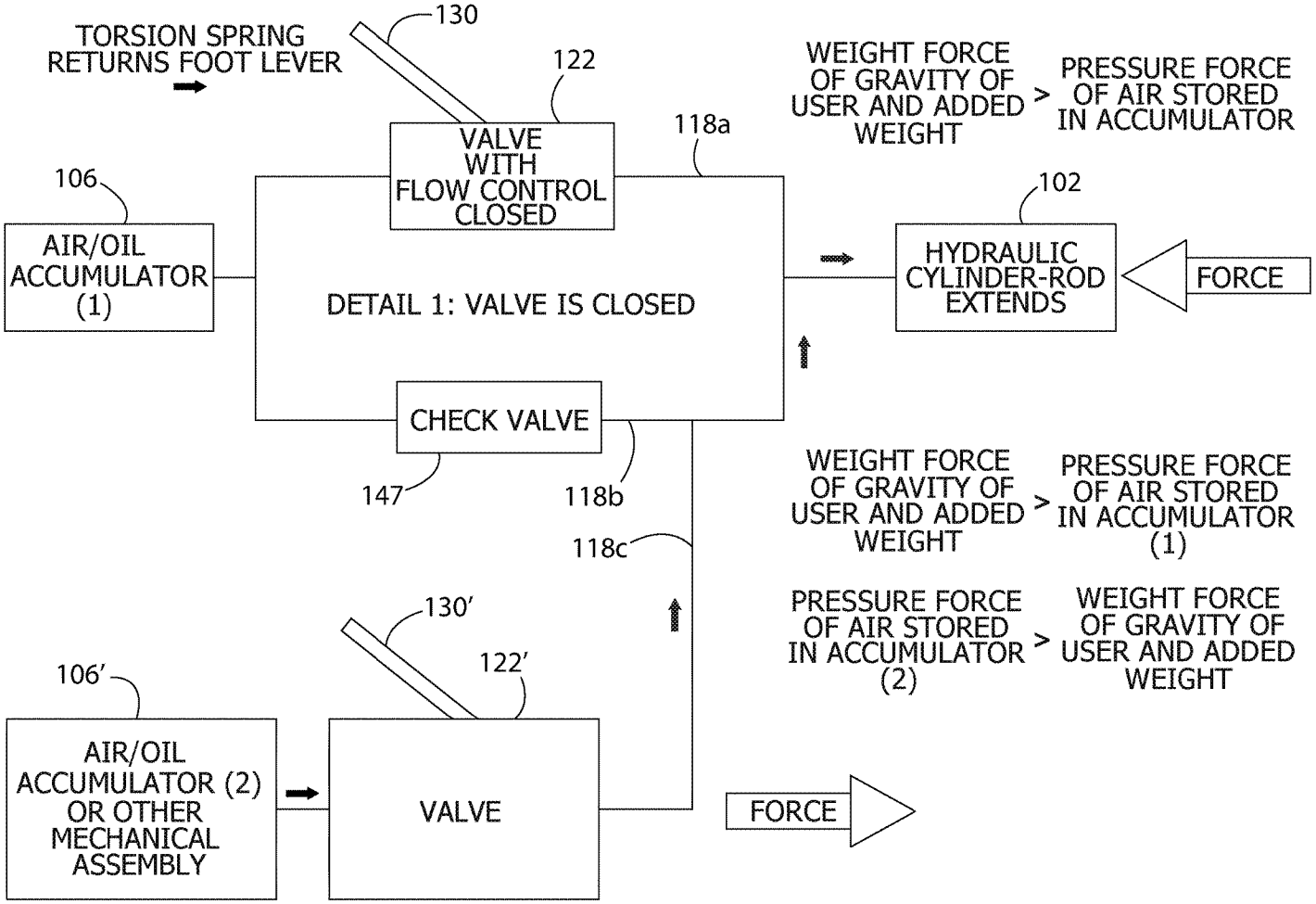
FIG. 41 is a schematic flow diagram of a modified hydraulic control system having a second accumulator and lever operated plunger valve which allows a user to adjust the upper exercise position of bench pad independently of the first plunger valve and accumulator.

In another embodiment shown in FIG. 41, the user can initiate the auto return of the bench pad 50 or adjust the exercise position of the bench pad by using a second foot or hand operating lever, plunger valve, and accumulator or another mechanical component (e.g. spring-loaded strut or piston, etc.). While the user remains on the bench pad 50, a second foot lever 130' in one embodiment can be depressed to provide a force generated from the compressed air in a second accumulator 106', or another mechanical means, to raise the bench pad 50 back upright towards its starting upper exercise position. If the angle of the bench is increased beyond that is which desired, this option provides the user ability to decrease the angle back towards the starting position. The force generated by the second accumulator, or other mechanical means, must be such that the force is greater than the weight force of gravity from the body of the user and the bench pad equipment to raise the bench pad upwards with the user seated thereon.

FIG. 41 illustrates a flow diagram of one possible configuration of a flow conduit circuit 118*c* incorporating a second accumulator 106' and second plunger valve 122' with operating lever 130' check valve 147' which are fluidly connected via a suitable flow conduit (e.g. tubing and/or piping) arranged as shown. Operating lever 130' may be a foot lever configured similarly to foot lever 130 or hand-operated lever. Flow conduit circuit 118*c* is tied into flow conduit circuit 118*b* downstream of check valve 147, but upstream of hydraulic cylinder 102 in the original hydraulic circuit.

In operation, with the user seated on the seat pad 50, the operating lever 130' is depressed and actuated which opens second plunger valve 122'. Compressed air flows from second accumulator 106' through second valve 122' and flow conduit circuit 118*c* into flow conduit 118*b* to the hydraulic cylinder 102. This extends the cylinder rod 116 thereby raising the position of the bench pad 50 as desired. When the position sought is reached, the operating lever 130' is released which returns automatically to its original position which shuts off flow of air from the second accumulator 106'. It may be noted that the second accumulator is pressurized to a higher pressure than the original accumulator 106 which has insufficient pressure to raise the bench pad 50 against the weight force of the user and bench pad equipment. The pressure force of air stored in the second accumulator 106' however is greater than the weight force of gravity of the user and added bench pad equipment to raise the bench pad when the user is seated and the operating lever 130' is actuated to open the second plunger valve 122'.

In one implementation, it may be preferable that the user does not hold the barbell B while adjusting the lifting or exercise position of the bench pad 50 via the second accumulator and plunger valve flow circuit for safety reasons. Accordingly, the pressure of compressed air in the second accumulator 106' is preferably pre-pressurized to a pressure insufficient to raise the bench pad against the weight force of the user, the bench pad equipment, and the barbell. In such a case when the second operating lever 130' would be depressed (i.e. actuated), the added weight of the barbell would cause the hydraulic fluid 101 to flow in a reverse direction through flow conduit 118*c* into the second accumulator 106', thereby automatically dropping the bench pad 50 to its lower escape position as a safety precaution. In other embodiments, however, it is possible to pre-pressurize the second accumulator 106' to a pressure sufficient to also overcome the added weight of the barbell allowing a user to adjust the bench pad position while holding the weight. Either setup of the second accumulator 106' is possible.

Safety Rack Height Relative to Bench Position

It is desirable that when the bench pad 50 is in the lowest escape position, the safety racks are positioned and sufficiently elevated such that the top of the safety racks are located above the user's chest or torso region. In all instances, when the user presses the foot lever 130 and the bench pad lowers to its lower escape position shown for example in FIG. 5B, the main rod or bar of the barbell B which a user grasps must rest on the safety racks 28 at a height such that the barbell and its weight are completely removed from the user's torso region (barbell shown in dashed lines). To achieve this accordingly, in the lower escape position of the bench pad 50, the top surface of the safety rack 28 on which the barbells rests is positioned at a critical height H1 above the top surface of the bench pad 50. The critical height H1 is sufficient to vertically separate the top surface of the safety racks 28 and barbell B during an escaped scenario from the user's torso region in a manner that completely and safely removes the weight from the user to prevent injury. Preferably, the height H1 is further selected to also provide adequate clearance for the user to readily have an easy path of egress from beneath the barbell B and off of the bench.

Figure 16:
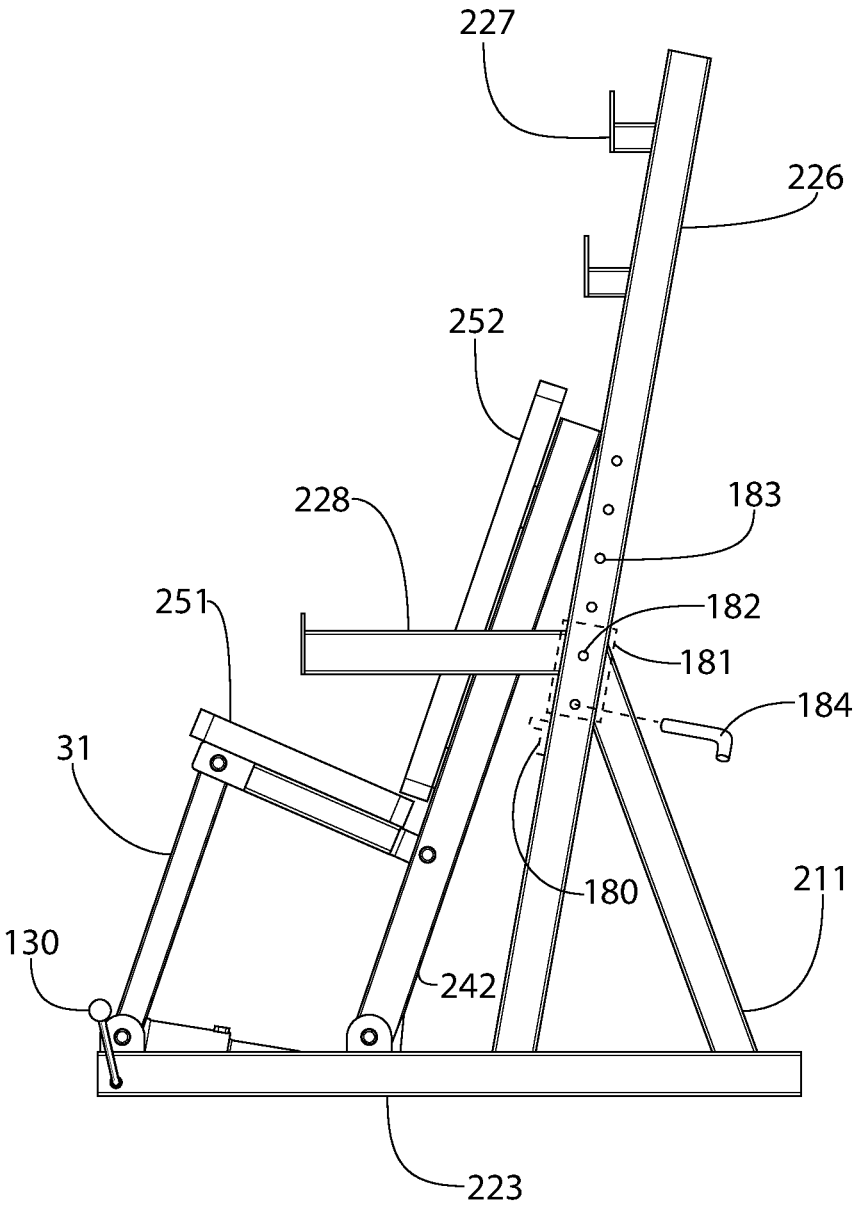
FIG. 16 is a first side view thereof.
Figure 17:
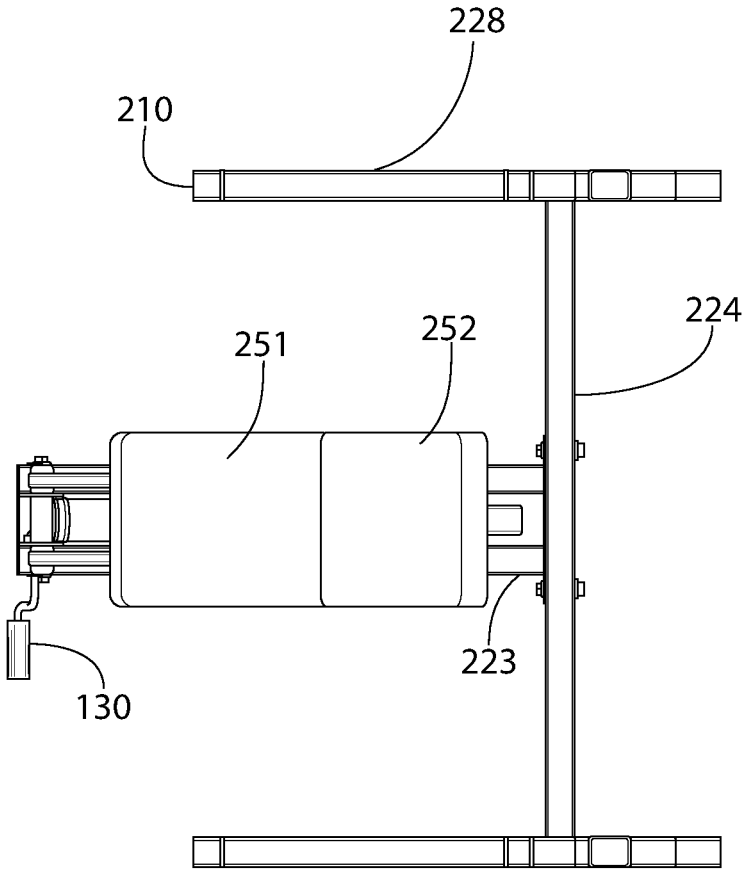
FIG. 17 is a top plan view thereof.
Figure 18:
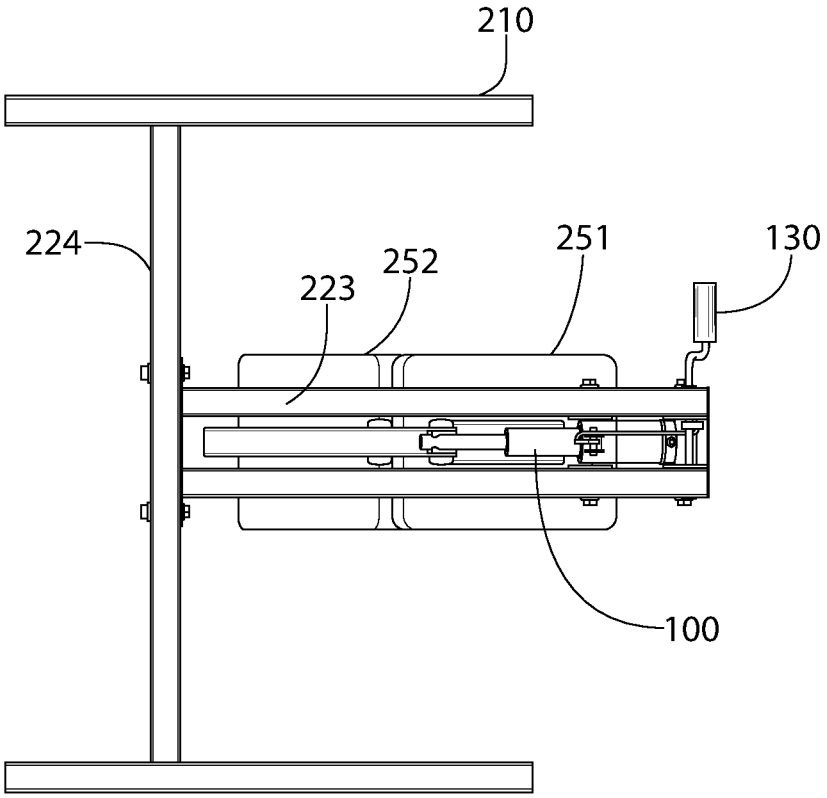
FIG. 18 is a bottom plan view thereof.

Although in some embodiments, the height of the safety racks 28 may be adjustable, as well as the working or exercise height of the bench pad 50, it remains important that when the bench pad 50 is in the lowest escape position, the safety racks are positioned such that the top surface of the safety racks are still located the critical height H1 and above the users torso. For such instances in which the safety racks are adjustable shown for example in FIG. 16 by dashed lines, a safety stop 180 is preferably positioned on the rack uprights (vertical stanchions 26) to prevent the safety racks 28 from being lowered to a position that is less than the critical height H1. Vertically adjustable safety racks 28 may be provided in one embodiment by providing an open tubular collar 181 on the proximal end of safety racks 28 which are configured for sliding up/down on the stanchions 26. One or more holes 182 are provided in the collar 181 which can be moved into various vertical positions concentrically aligned with mating holes 183 formed in stanchion. An L-shaped or other pin 184 may be removably inserted through the holes 182, 183 to lock the safety racks into one of a plurality of possible vertical positions. The safety stop 180 is fixedly mounted on the stanchions 26 to engage the collar 181 or bottom surface of the safety racks 28. In one embodiment, the safety stop 180 may be configured as an angle bracket or clip which is welded to each of the stanchions 26 to maintain the critical height H1.

Preferably, the lowermost position of the safety rack 28 whether fixedly attached to the vertical stanchions 26 or adjustable in height as described above is selected to maintain the critical height H1 regardless of whether a flat bench pad 50 is used (see, e.g. FIG. 1) or bench pad with an angularly adjustable back rest or pad is provided (see, e.g. incline bench 200 shown in FIGS. 12-19). Accordingly, when the back pad 252 is positioned in its lowest adjustment and escape position shown for example in FIG. 19 (represented by angle A3) and full actuation of the foot lever 130 has been implemented for an escape maneuver, the critical height H1 is still maintained.

As a means of egress from beneath the barbell B when the foot lever 130 is fully depressed and the bench pad 50 drops to its lowest escape position (see, e.g. FIG. 5B), the barbell becomes an integral part of the escape system. The barbell rests on the safety racks 28 and provides a stable hold for the user to grip and slide themselves out from under the weights. The user may push the barbell against the upright stanchions 26 to the proximal end 28*a* of the safety rack horizontal members. The force then applied by the user against the horizontal safety racks 28 and the stanchions 26 racks allows the user to push or pull themselves forward towards the distal foot end of the bench, and safely up and off the equipment to escape from underneath the barbell.

Incline Bench

FIGS. 12-19 show an incline bench 200 according to the present disclosure which incorporates the hydraulic cylinder assembly 100 described herein. The bench pad 50 is movable in the same manner previously described between several upper exercise positions and a lowermost escape position via actuation of the foot lever 130. The incline bench 200 further may incorporate the same auto-return feature which automatically returns the bench pad 50 to an uppermost exercise position following an escape scenario simply when the user releases the foot lever 130. In addition, the incline bench incorporates the features which controls the bench descent rate as further described herein.

Incline bench 200 has a frame 221 which is constructed similarly to and includes the same basic structural members described with respect to frame 21. Accordingly, frame 221 includes vertical stanchions 226 connected by a cross member 224, pair of longitudinal members 223 connected thereto, weight rests 227, and safety racks 228. In one implementation, a pair of vertically spaced weight rests 227 may be provided to offer a user two possible heights for positioning the barbell during a weight lifting routine. In the present embodiment, the safety racks 228 may be constructed as cantilevered members to facilitate access to the bench pad 50. In other embodiments, a vertical member similar to member 29 (see, e.g. FIG. 1) may also be provided which is connected at an upper end 29*a* the free end of each safety rack and has a lower end 29*b* contacting the floor or another part of the frame. The incline bench frame 221 may further comprise tie members 210 in the form of tubular elements as shown or alternatively straps to which the stanchions 226 are attached. An angle brace member 211 may be provided for additional support which spans between the rear head end of the tie member 210 and stanchion 226 obliquely to the tie member. The substantially horizontal base 222 is comprised of a bench portion 212 including longitudinal members 223 and a weight rack portion 213 including cross member 224 and tie members 210. Frame 221 may be constructed of the same type of structural members and materials as frame 21 describes herein.

In lieu of a solid one-piece bench pad 50 shown in FIG. 1 for the flat bench which collectively provides both seat and back portions, the bench pad 250 provided for the incline bench 200 instead comprises a two-piece assembly including a seat pad 251 and separate back pad 252. Back pad 252 is pivotably connected to the seat pad 251 via a lateral pivot bolt 240. In one embodiment, a U-shaped mounting clip 241 is attached to and extends rearwardly from seat pad 251 towards the rear head end of the bench. The clip 241 receives therein between the opposing sides an elongated version of a rear (head end) strut 242 having an extended length which is greater than rear strut 32 of the flat bench. Pivot bolt 240 is inserted through the clip 241 and rear strut 242 to form the pivot joint (best shown in FIG. 13). Back pad 252 is angularly positionable and adjustable in relation to the seat pad 251.

The pivotable linkage mechanism of the incline bench 200 which pivotably couples the bench pad 250 to the longitudinal members 223 of frame 221 comprises a rear strut 242. Rear strut 242 is pivotably connected at a lower end to longitudinal members 223 via cross bolt 34*a* similar to rear strut 32 of the flat bench (see, e.g. FIGS. 1-9C). Unlike rear strut 32, however, the rear strut 242 for the incline bench extends substantially above the bottom of seat pad 251 for distance which may be greater than the distance between cross bolt 34*a* and the bottom of the seat pad 251. The upper end of the rear strut 242 is fixedly attached to the underside of the back pad 252 such as via mounting tabs 243 using fasteners or another suitable fixed type mounting arrangement. Therefore, the angle of the back pad 252 will always match the angle of the rear strut 252 with respect to the base 222 and its horizontal members in the present embodiment. The rear strut 242 is further pivotably connected to the rear end of the seat pad 251 via clip 241 and pivot bolt 242. It bears noting that the seat pad 251 in the incline bench embodiment terminates at the rear strut 242 rather than extending rearward for a distance beyond the strut unlike rear strut 32 (see, e.g. FIGS. 1-2, 5-6, 8, and 9A-C).

The front (foot end) struts 31 of the pivotable linkage mechanism may be similar to the flat bench. Accordingly, struts 31 are pivotably connected to longitudinal members 223 at their bottom ends via cross bolt 34*a* and at their top ends via one or two cross bolts 34*c*. Any suitable type bracket such as without limitation the U-bracket 186 shown in FIG. 14 may be used to complete the pivotable connection of struts 31 to the underside of the seat pad 251. Other mounting bracket arrangements may be used.

The pivotable linkage mechanism of the incline bench 200 provides the same safety features and motion of the flat bench previously described thereby allowing a user to escape the barbell when fatigued via the foot lever 130 and safety racks 228. Bench pad 250 is therefore also movable between an upper exercise position and a lower escape position in which the barbell and its weight are completely removed from the user.

Advantageously, however, the incline bench pivotable linkage mechanism also allows users to perform weight-lifting exercises with the barbell at different angles without having to get off the bench to make adjustments in the position of the back pad 252. Accordingly, the same linkage mechanism is usable as part of the normal exercise routine allowing a user to conveniently adjust the position of the back pad 252 via operation of the foot lever 130 to train the chest muscles for example at different angles. When muscles are forced to contract at different angles, additional muscle fibers are incorporated into the workout which increases the potential for muscular growth. Large muscle groups such as the chest muscles optimally should be trained at different angels to involve fibers from all parts of the muscle. This type of training builds stronger, fuller muscles. As the user can adjust the angle of the back pad 252 to vary the parts of the chest muscles which are involved in the weight lifting exercise via the foot lever 130 while staying on the bench, the workout becomes more efficient allowing blood flow to stay in the chest area and eliminating wasted time adjusting the equipment.

Figure 19:
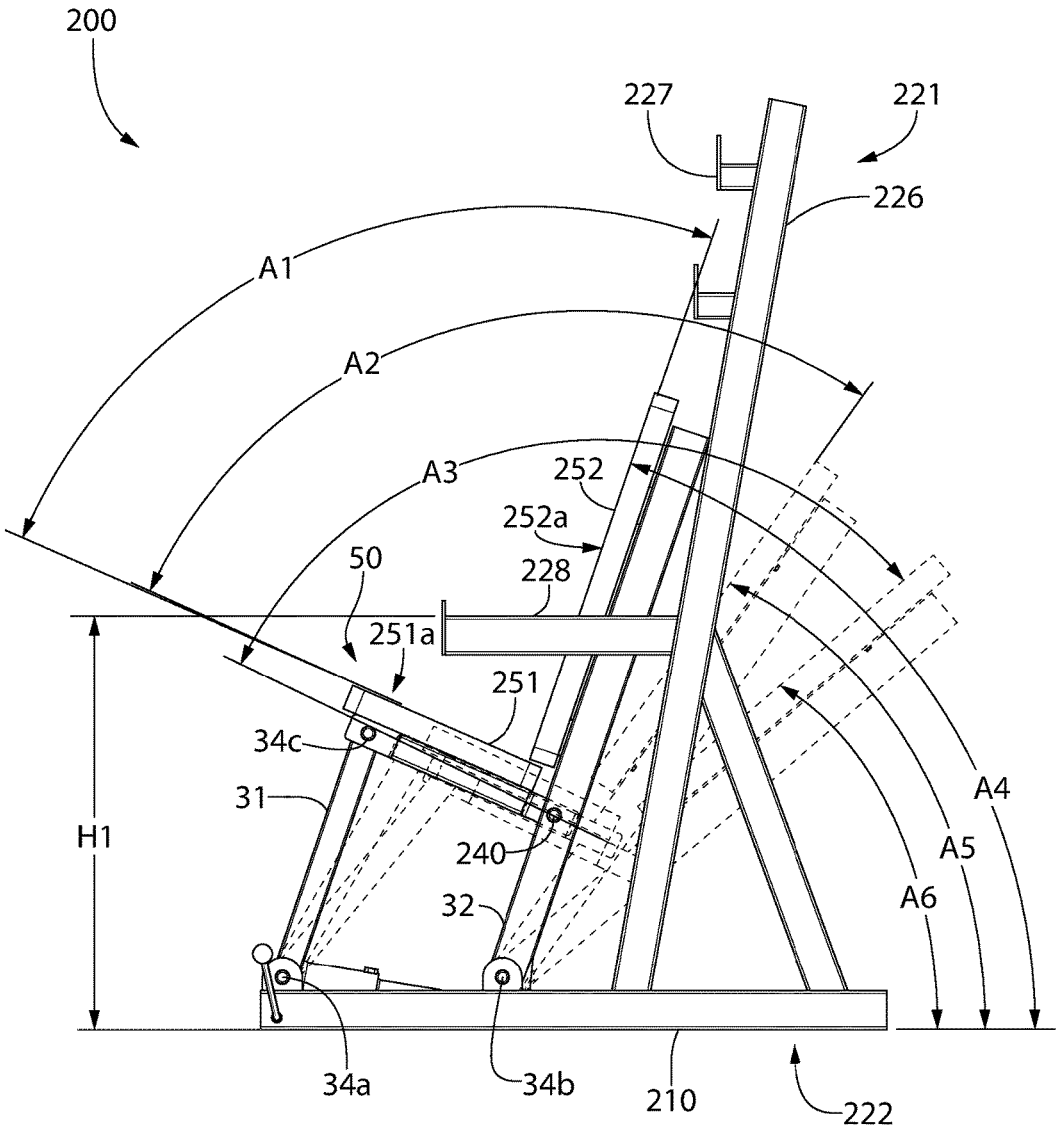
FIG. 19 is the first side view thereof showing the bench in various movable positions.

Operation of the incline bench 200 for varying the position of the bench pad 250 will now be described. FIG. 19 shows the pivoting and angular action of the bench pad 250 with respect to the frame 221 and relative movement between the seat pad 251 and back pad 252.

In the back pad's uppermost exercise position, an angle A1 between the top surface 251*a* of the seat pad 251 and top surface 252*a* of the back pad 252 is smallest. In one embodiment, angle A1 may be about 90 degrees. The seat pad 251 is not horizontal and in one embodiment the front end (foot end) of the seat pad remains always higher than the rear end (head end) throughout the entire angular range of motion of the bench pad 250. Accordingly, the front end (foot end) of the seat pad 251 closest to foot lever 130 is higher than the rear end (head end) of the seat pad closest to the stanchions 226. The lengths of the struts 31, 32 are selected to produce the approximate 90 degree angle created between the seat pad 251 and back pad 252 to securely maintain the weight lifters position during the exercise. The length (distance) of the front struts 31 between cross bolts 34*c* and 34*a* is greater than the length (distance) of the rear strut 32 between cross bolts 34*b* and pivot bolt 2240 to achieve this angular relationship. In its uppermost position, the back pad 252 is disposed at angle A4 with respect to the floor/base 222 of the frame 221. Angle A4 is between 0 and 90 degrees. The initial angles of the struts 31, 32 in this uppermost position of the back pad 252 are such that minimal force is exerted against the hydraulic cylinder 102 when in the back pad and bench pad 250 are in their highest position, while allowing the gravity force from the weight of the user and the additional weights (e.g. barbell) to initiate the lowering bench process via actuation of the cylinder by depressing and releasing the foot lever 130 at different angled positions.

The angle of the seat pad 251 changes relative to the back pad 252 as the angle of the back pad changes relative to the ground/base 222 of the frame 221 to maintain user comfort and produce different inclined weight lifting positions to exercise different portions of the chest muscle group. For example, the user may depress and release the foot lever 130 while remaining seated on the bench pad 250 until the back pad 252 reaches a second intermediate exercise position represented by angles A2 and A5 (measured with respect to the same reference points as angles A1 and A4). Angle A2 is greater than A1 and angle A5 is less than A4 as the back pad 252 is now moved closer to the floor/base 222 of frame 221. The user may continue to lower the bench pad gradually in the same manner into a plurality of different intermediate exercise positions to continue to work different parts of the chest muscle group. It bears noting that in some instances the more the user depresses the foot lever 130 downwards, the faster the bench will lower to successive intermediate exercise positions.

If during the exercise routine the user becomes fatigued and cannot return the weight safely to the weight rests 227, an escape scenario similar to that already described herein using the hydraulic cylinder assembly 100 may be implemented. In that case, the user fully depresses and holds the lever 130 in the downward position until the bench pad 250 drops to the lowermost escape position represented by angles A3 and A6 ((measured with respect to the same reference points as angles A1 and A4). Angle A3 is greater than angles A1 and A2, and angle A6 is greater than angles A4 and A5. In the escape position, the critical height H1 described above is similarly maintained which completely removes the weight from the user's torso or chest (and other portion of body which may be nearest to the barbell when resting on any portion of the safety racks 228).

It may be noted that when the cylinder rod 116 is fully extended, the bench pad 250 is in the highest upward position and the angle of the back pad is highest relative to the ground. At this point, the hydraulic fluid 101 fills the bore 110 in the cylinder 102 and extends the rod completely. The transfer of hydraulic fluid between the cylinder chamber and the air/oil accumulator controls the cylinder rod. When the cylinder rod is fully retracted by depressing the foot lever 130, the back pad 252 is in the lowest position and the angle of the back pad is lowest relative to the ground. At this point, the hydraulic fluid flows from the cylinder 102 to and fills the accumulator 106 wherein the rod is completely retracted into the cylinder. To adjust the angle of the bench pad, the user simply presses a foot lever 130. As already described herein, the foot lever 130 controls a plunger valve 122 which in turn controls the flow of hydraulic fluid between the hydraulic cylinder 100 and accumulator 106 that alternatingly either extends or retracts the cylinder rod 116 to change position of the bench pad 250.

The incline bench 200 thus provides a new method for performing the incline bench press exercise via the user's ability to change the angle of the back pad and work different muscle groups. A user can advantageously change the back angle by depressing and releasing the foot lever when the desired position is reached, never having to get off the bench to change angle with mechanical pins as used heretofore.

In some embodiments, the incline bench 200 may include the second operating lever 130' hydraulic system and components described herein (see, e.g. FIG. 41 and related description) to allow the user to adjust the angle of the back pad 252 while remaining seated on the bench, as discussed above.

Figure 20:
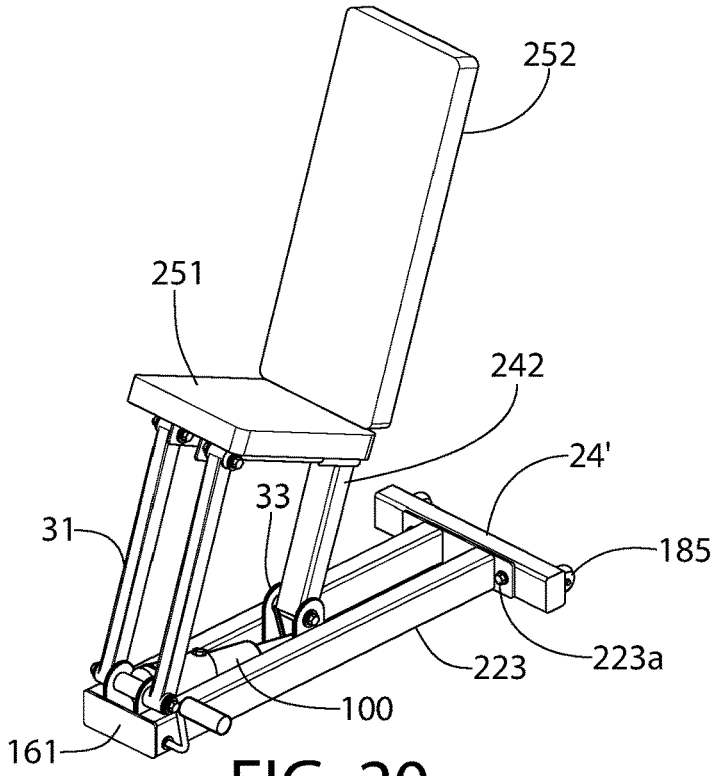
FIG. 20 is a front perspective view of an embodiment of a portable incline bench pad assembly without attached weight rack.
Figure 21:
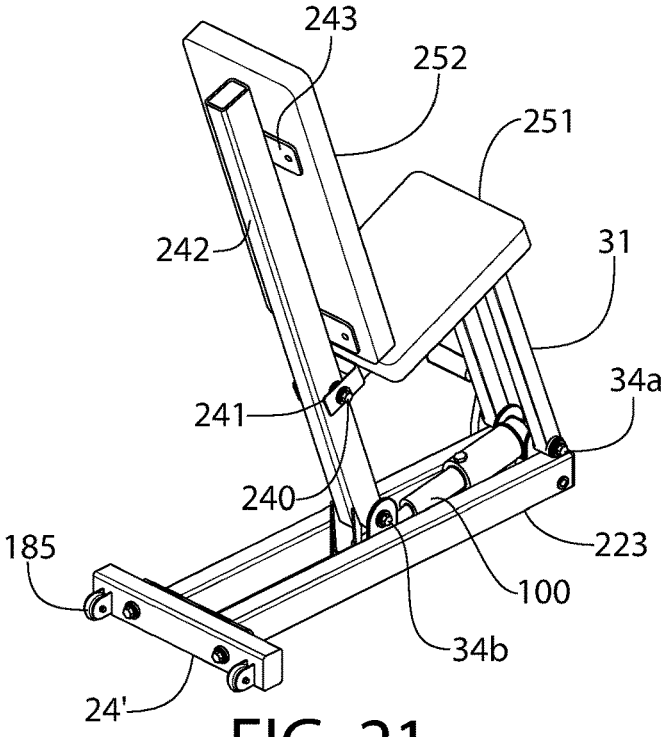
FIG. 21 is a rear perspective view thereof.

In other possible embodiments, a two-piece frame may be provided in which the incline bench pad 250 assembly and bench sub-frame comprising supporting longitudinal members 223 are a separate free standing component from and unattached to the cross member 224 and the weight rack portion or sub-frame 238 of the bench. In such an embodiment, shown for example in FIGS. 20 and 21, the proximal ends of the longitudinal members 223 may be positioned proximate but unconnected to cross member 224 in use during the exercise routine. This forms a separable free standing incline bench which is useable on its own or with multiple different weight rack configurations for performing different types of weight lifting exercise routines. In this portable bench embodiment, the proximal ends 223*a* of the longitudinal members 223 may be attached to a second cross member 24' (similar to the free standing utility bench in FIGS. 9-11) that may be positioned against or proximate to cross member 224 of the frame 222. A pair of wheels 185 may be fitted to cross member 24' to enhance the mobility of the free standing incline bench assembly.

Adjustable Weight Lifting Bench

FIGS. 44-54 depict an adjustable weight lifting bench 400 that incorporates features and operability of both the flat and incline benches described herein with further user adjustability and control of the bench pad angular position and bench configuration. For various exercise routines, bench 400 has two operating modes which can be altered by the user to selectively either maintain the back pad 402 in the same angular orientation when moved from the upper exercise position to the lower escape position of the bench, or alternatively the back pad 402 changes angular orientation moving between the exercise and escape positions similar to the incline bench 200. Advantageously, this provides a highly configurable and versatile weight lifting bench.

Bench 400 may utilize hydraulic cylinder assembly 100 having either of the valve configurations for a pressure compensating valve assembly 145 or user adjustable flow control plunger valve 150, both of which incorporate the safety feature of the speed control mechanism to regulate the rate of descent of the bench pad in a controlled slow manner. Other types of support mechanisms operably coupled between the sets of struts which support and maintain the position of the bench pad 401 in the upper and lower positions, and controls the movement of the pad therebetween, may instead be provided such as pneumatic, electrical, or mechanical types. The bench pad 401 is movable in the same manner previously described between several upper exercise positions and a lowermost escape position via actuation of the foot lever 130. The adjustable bench 400 further may incorporate the same auto-return feature which automatically returns the bench pad 401 to an uppermost exercise position following an escape scenario simply when the user releases the foot lever 130.

Adjustable weight lifting bench 400 may use any of the bench and/or weight rack sub-frames disclosed herein, or others. In one embodiment, the frame may be configured as a free standing "utility" bench similar to that shown in FIGS. 10 and 11 which is useable on its own or with multiple different weight rack configurations for performing different types of weight lifting exercise routines. These frame components are already described herein and numbered similarly, and hence will not repeated in detail for brevity. In other embodiments, as another example, the weight rack sub-frame 38 may instead be incorporated into the frame of the adjustable bench 400 similarly to that shown in FIG. 12 for the incline bench 200.

Referring to FIGS. 44-54, the adjustable weight lifting bench 400 includes longitudinal members 23, cross member 24', and optionally wheels 185. Front struts 31 and rear strut 404 are supported in position by hydraulic cylinder assembly 100. Foot lever 130 is supported by longitudinal members 23. The bench pad 401 includes back pad 402 and seat pad 403. The angular orientation of the back pad and seat pad are user adjustable. A longitudinally extending support rail 405 is pivotably mounted to the top ends of both the front and rear struts 31, 404 by cross bolts 34*c* and 34*d*. Rail 405 may be generally U-shaped in one embodiment in cross section and includes an elongated axial slot 406 extending from a point proximate a front end 405*a* to a point proximate the rear end 405*b*. The bottom ends of the front and rear struts 31, 404 are pivotably mounted to longitudinal members 23 by cross bolts 34*a* and 34*b*.

The upper end of the rear strut 404 is also pivotably coupled to a pair of longitudinally extending and laterally spaced apart support members 407 to which the back pad 402 is attached. The back pad support members 407 may be configured similarly to support members 35 already described herein formed from a pair of structural angles. The same cross bolt 34*d* may conveniently be used to couple both the upper end of rear strut 404 and lower ends of support members 407 to the rail 405. Support members 407 may be positioned on the outside of opposing lateral sides of rail 405 while the upper end of rear strut 404 with top mounting aperture 409 may be positioned inside of the lateral sides (see, e.g. FIG. 45).

Figure 44:
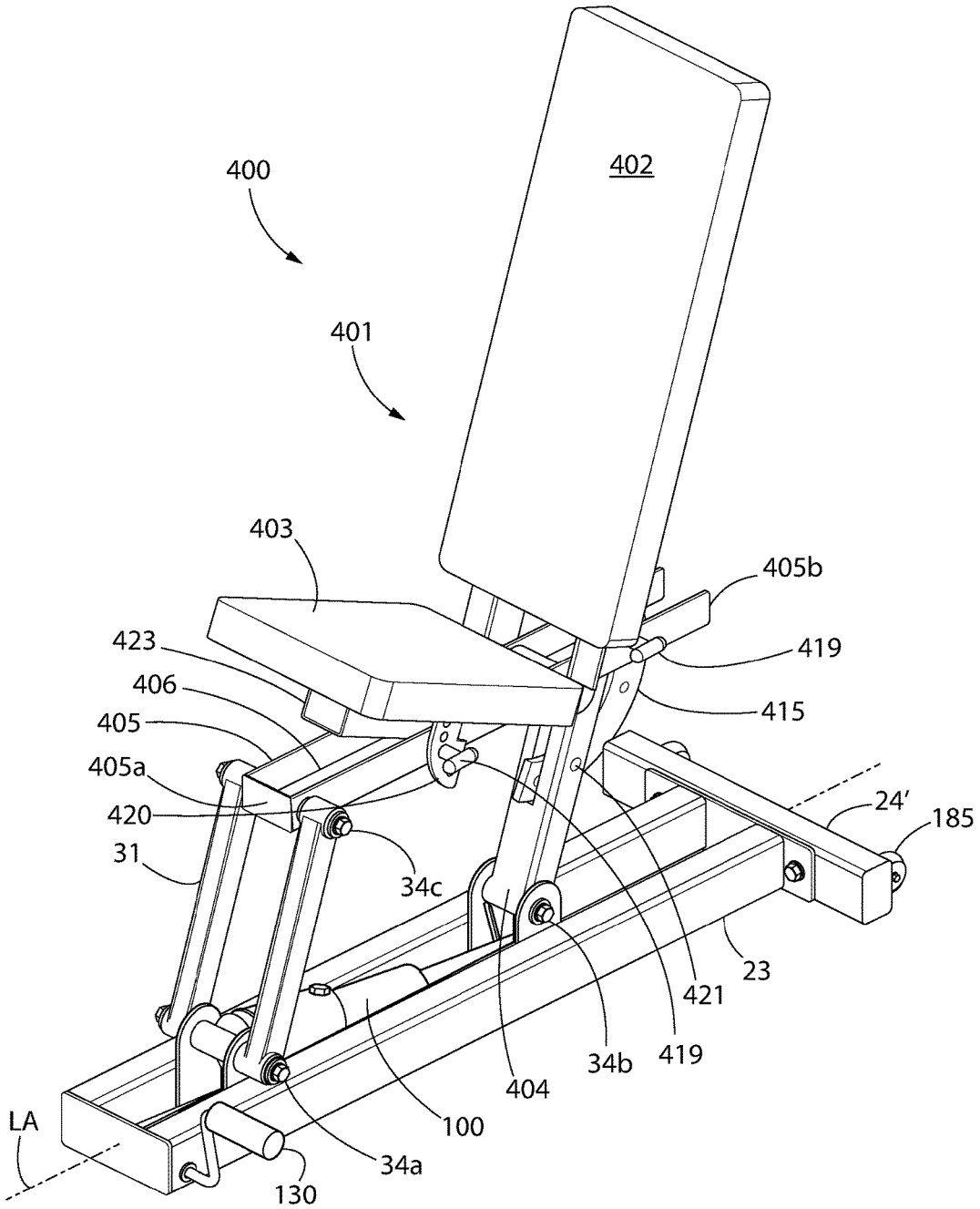
FIG. 44 is a front perspective view of an embodiment of an adjustable weight lifting bench that incorporates features of the flat bench of FIGS. 1-11 and incline bench of FIGS. 12-21 with further adjustability and control of the bench pad position and configuration.
Figure 45:
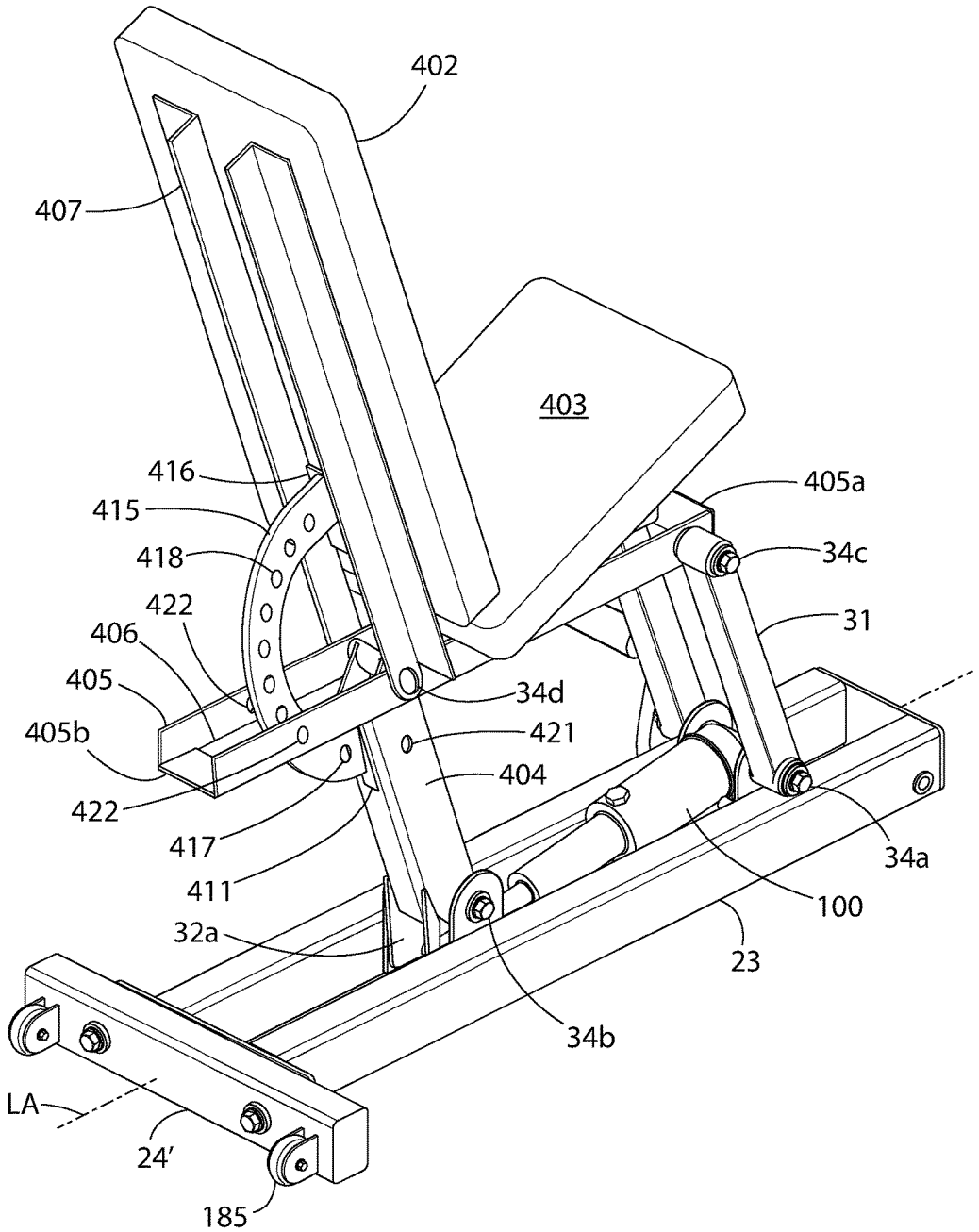
FIG. 45 is rear perspective view thereof.
Figure 46:
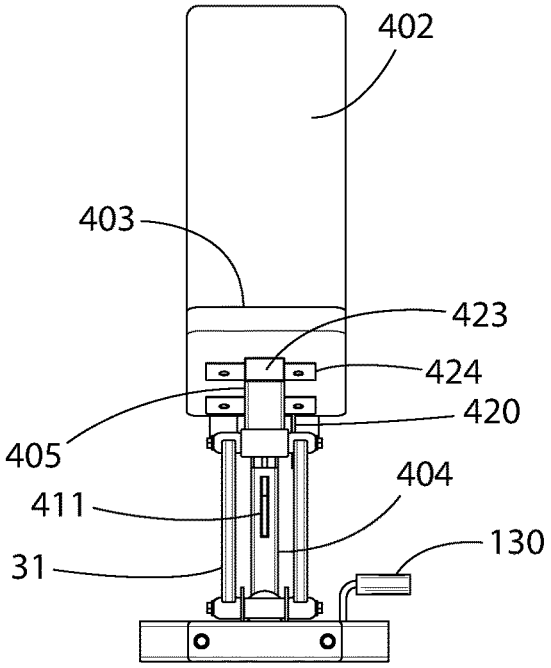
FIG. 46 is a front view thereof.
Figure 51:
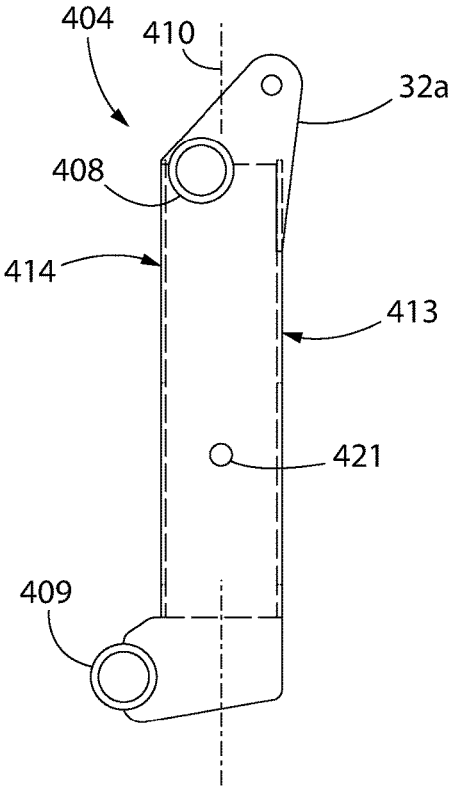
FIG. 51 is a side view of a rear strut of the bench of FIG. 44.
Figure 52:
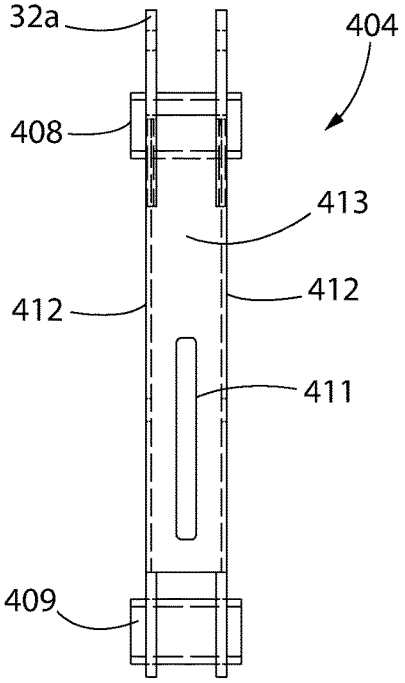
FIG. 52 is a front view thereof.

Rear strut 404 is shown in detail in FIGS. 51 and 52, and further shown in FIGS. 44 and 45. Strut 404 has an elongated body and may be generally L-shaped in the example embodiment having two opposing lateral sidewalls 412, a closed rear wall 413, and a closed front wall 414. The strut may have a generally rectangular tubular shape in transverse cross section. A vertically elongated slot 411 is formed in front and rear walls 414, 413 which slideably receives the back pad support bracket 415 therethrough in some motions of the bench pad 401. In some embodiments, the front or rear walls 414, 413 may be open thereby negating the need for a slot therein.

The top mounting aperture 409 which receives cross bolt 34*d* is transversely offset from the axial centerline 401 of elongated rear strut 410 by a distance greater than the bottom mounting aperture 408 which receives cross bolt 34*b*. This provides the geometric configuration allowing the dual operating modes of the back pad 402, as further described herein. In one embodiment, the top and bottom mounting apertures 409, 408 may be formed by transversely oriented tubular sleeves; the sleeve defining the top aperture being disposed between the lateral sides of rail 405 and the sleeve defining the bottom aperture being disposed between the mounting tabs 33 on the base longitudinal members 23. Pivot extension 32*a* is disposed on the lower end of rear strut 404 below mounting aperture 408 similarly to the arrangement shown in FIG. 6.

Figure 47:
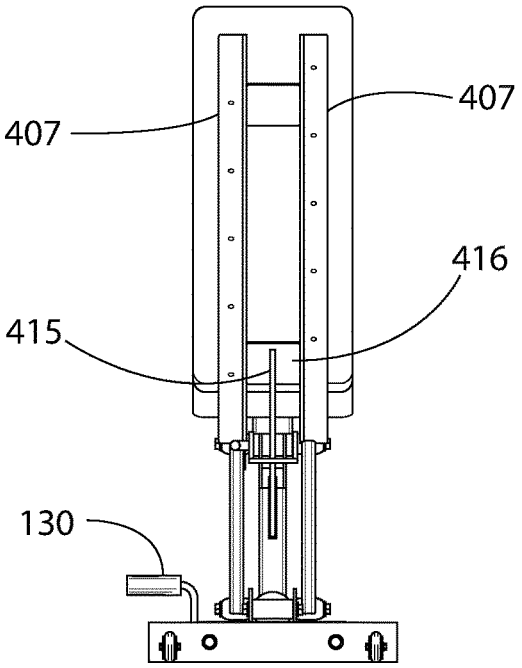
FIG. 47 is a rear view thereof.
Figure 50A:
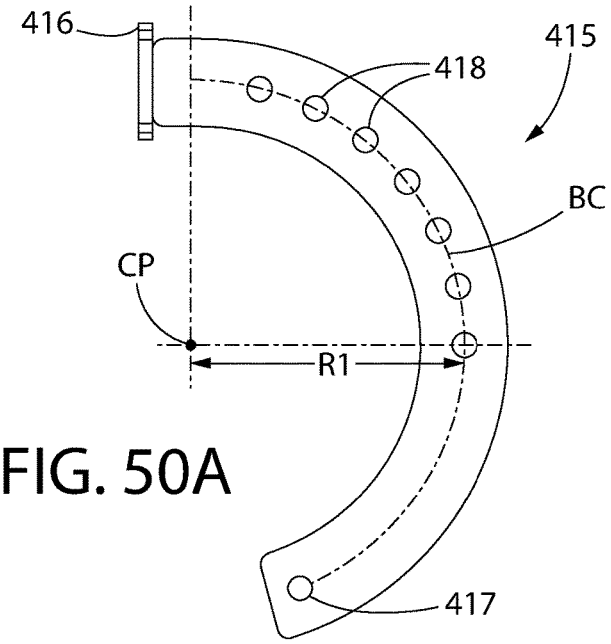
FIG. 50A is a side view of a support bracket of the bench of FIG. 44.

To control and guide the motion of back pad 402, the back pad support bracket 415 is attached at its top end to the rear of the back pad (see FIGS. 45, 47, and 50A). An enlarged flat mounting plate 416 may be attached to the top end to facilitate coupling bracket 415 to the back pad via fasteners inserted through fastener holes in the pad. Other types of coupling may of course be provided. Support bracket 415 has an arcuately shaped body forming an arc. Bracket 415 may be formed a flat metal plate in one embodiment.

Figure 48:
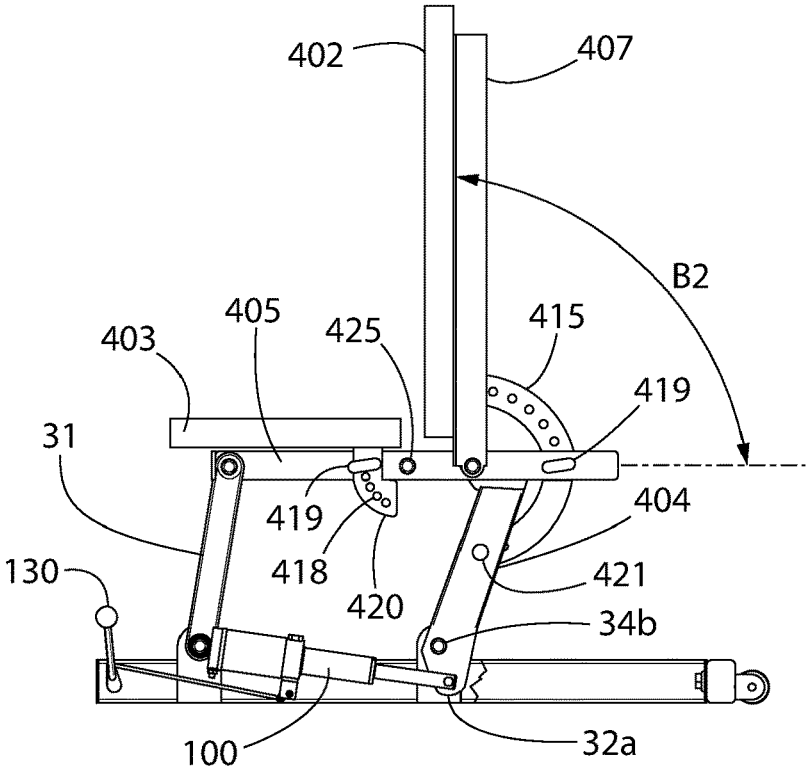
FIG. 48 is a side view showing the bench of FIG. 44 in a first operating mode with a lock pin in a first location.
Figure 49:
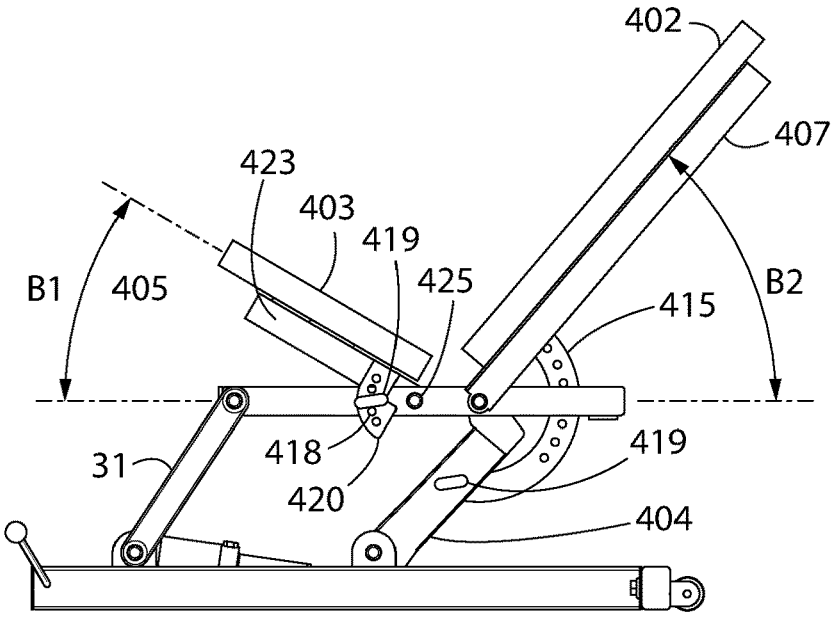
FIG. 49 is a side view showing the bench of FIG. 44 in a second operating mode with the lock pin in a second location.

The bottom end of support bracket 415 defines a first pin locking hole 417 for receiving lock pin 419 (see, e.g. FIG. 48). Lock pin 419 may alternatively be inserted through one of a series of second pin locking holes 418 disposed in the upper portion of mounting bracket 415 (see, e.g. FIG. 49) to change the operating mode of the bench 400. Holes 418 may start near the midpoint of the bracket and are arranged in an arc terminating proximate to the top end of the bracket as shown. Pin locking holes 418 are spaced radially apart along the bracket, and preferably may be equidistantly spaced from each other and between the curved sides of the bracket (best shown in FIG. 50). Locking holes 418 and locking hole 417 are arranged along a bolt circle BC having a critical radius R1. The center point Cp of the bolt circle BC that defines a critical radius R1 coincides with the location and axis of the upper rear cross bolt 34*d* used to couple the rear strut 404 (and back pad support members 407) to the horizontal support rail 405. This ensures that during the entire angular range of motion of the back pad 402, one of the pin locking holes 418 will always concentrically align with pin holes 422 formed in the spaced apart lateral sides of bench support rail 405 to lock the bracket 415 to the rail via lock pin 419. Furthermore, this also ensures that the single pin locking hole 417, also arranged on the same bolt circle BC at radius R1, can be concentrically aligned with pin holes 421 formed in the lateral sides of rear strut 404 to alternatively lock the bracket 415 to the rear strut via lock pin 419. When the back pad bracket 415 is mounted to the bench, it bears noting that in order to accomplish the foregoing concentric hole alignment relationships, the pin holes 421 and 422 in the rear strut 404 and support rail 405 respectively must also fall along the same bolt circle BC at critical radius R1 from the top rear cross bolt 34*d*.

In some embodiments, the single pin locking hole 417 at the bottom end of mounting bracket 415 may be spaced farther apart from the lower-most locking hole 418 by an arcuate distance greater than the arcuate distance between holes 418. In other embodiments, the series of locking holes 418 may continuous from the top end of bracket 415 to the bottom end thereby including locking hole 417 along bolt circle BC which in this case would correspond to lower-most hole in the series. In one non-limiting embodiment, a single sole pin locking hole 417 and series of seven pin locking holes 418 may be provided as an example; however, more or a lesser number of holes may be furnished. The pin locking holes 418 permit user selection of the angle of back pad 402, as further described herein.

Figure 50B:
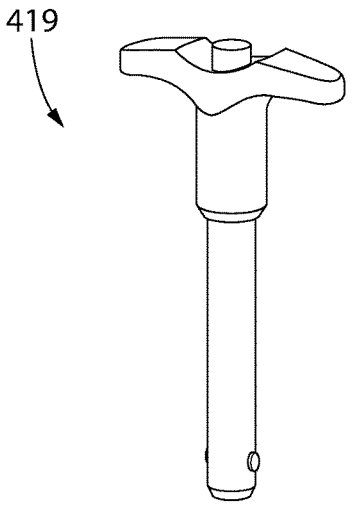
FIG. 50B is a perspective view of the lock pin referenced in the description of FIGS. 48 and 49 above.

The lock pin 419 may be a T-shaped pin in one embodiment with an elongated shaft and an operating handle arranged transversely to the shaft (see, e.g. FIG. 50B). Lock pin 419 may also be a self-locking ball lock type pin as depicted including a central plunger mechanism protruding through the operating handle which operably retracts or projects locking balls disposed in the shaft. Such pins are well known in the art. Other configurations of lock pins 419 may be provided including without limitation L-shaped pins like pin 39*a* (see, e.g. FIG. 1) or others. Accordingly, the invention is not limited by the type of lock pin used.

Figure 54A:
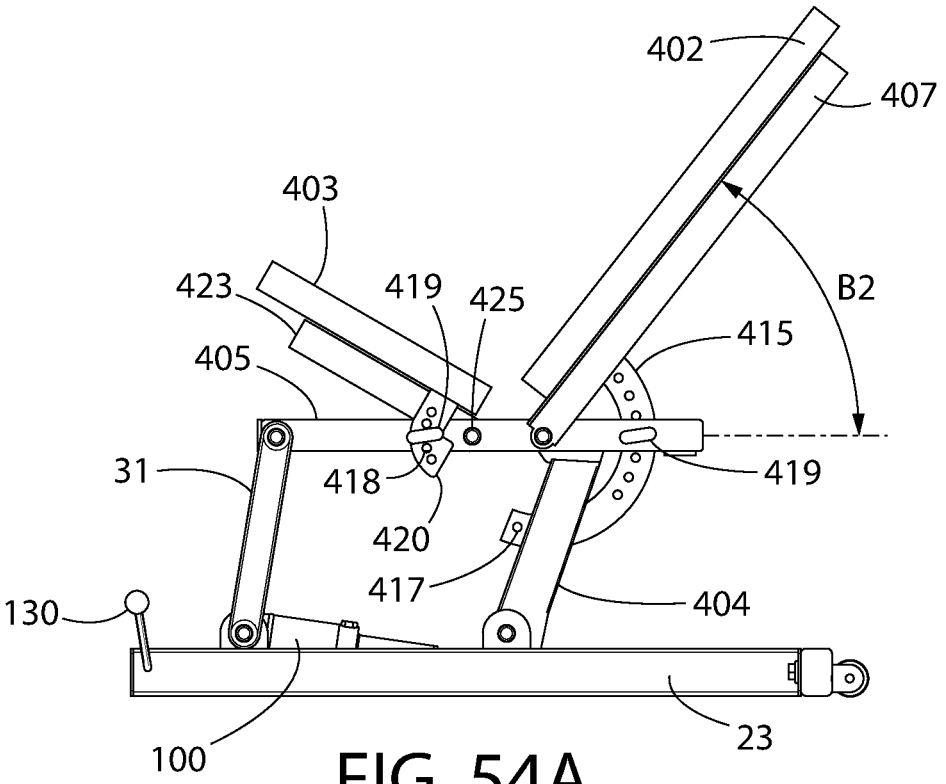
FIG. 54A is a side view of the bench of FIG. 44 in an upper position of the first operating mode with back pad in a second angular orientation.
Figure 54B:
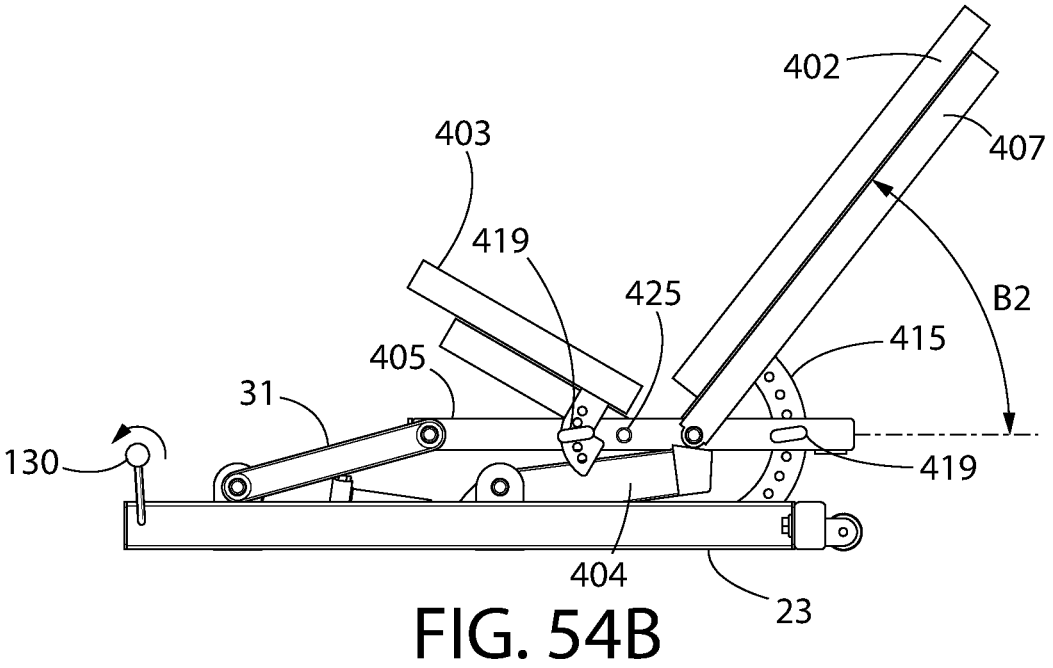
FIG. 54B is a side view thereof with bench in a lower position.

Referring to FIGS. 44, 46, and 48-49, the angular orientation of the seat pad 403 is also adjustable by the user via an arcuately curved support bracket 420. Bracket 420 is attached at its top end to the underside of seat pad 403 such as by a flat mounting plate 424 through which threaded fasteners may be installed. The seat pad support bracket 420 runs on the outside of horizontal support rail 405. The seat pad 403 is attached to an elongated tubular seat support member 423 pivotably attached to support rail 405 by a cross bolt 425. Support member moves inside of and into or out of support rail 405 depending on the angle of the seat pad. Bracket 420 may be shaped generally similar to back pad mounting bracket 415, but a much shorter version of the same. Seat pad mounting bracket 420 also includes a series of radially spaced apart locking holes 418 arranged in an arcuate pattern which receive a second lock pin 419. The user selects an angle B1 of the seat pad 403 in relation to support rail 405, and then inserts s shorter version of lock pin 419 through one of the series of locking holes 418 in bracket 420 and a concentrically aligned hole in the lateral side of support rail 405 (obscured by lock pin 419 in the figures), thereby locking the seat pad in position. As shown in FIGS. 54A and 54B, the seat pad 403 remains at the angle B1 selected between the upper exercise position and lower escape position of the bench pad 401 including positions therebetween.

Figure 53A:
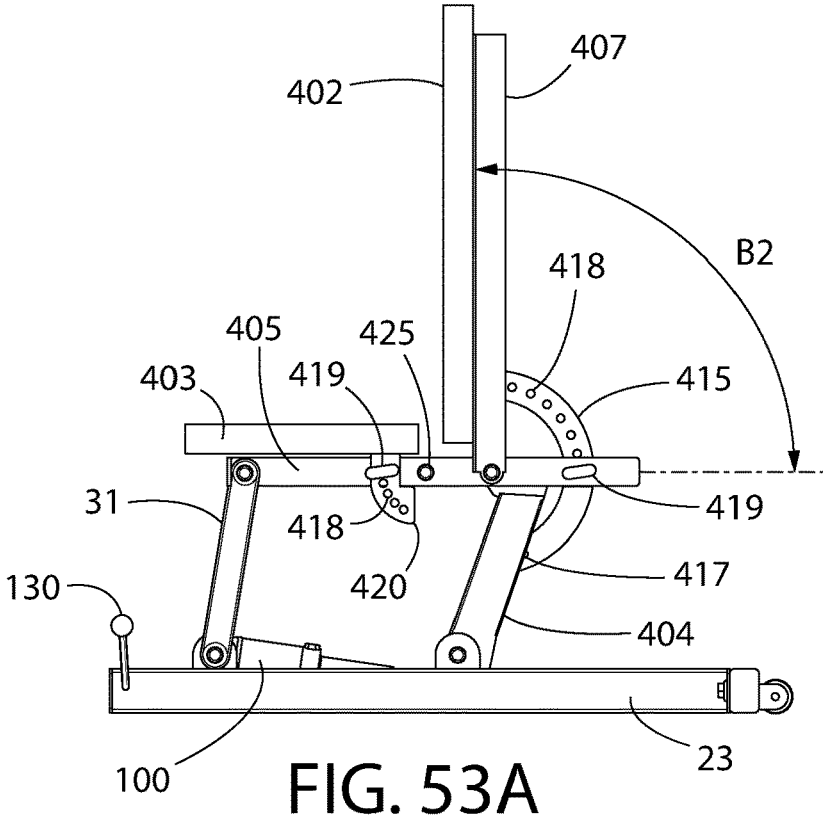
FIG. 53A is a side view of the bench of FIG. 44 in an upper position of the first operating mode with back pad in a first angular orientation.
Figure 53B:
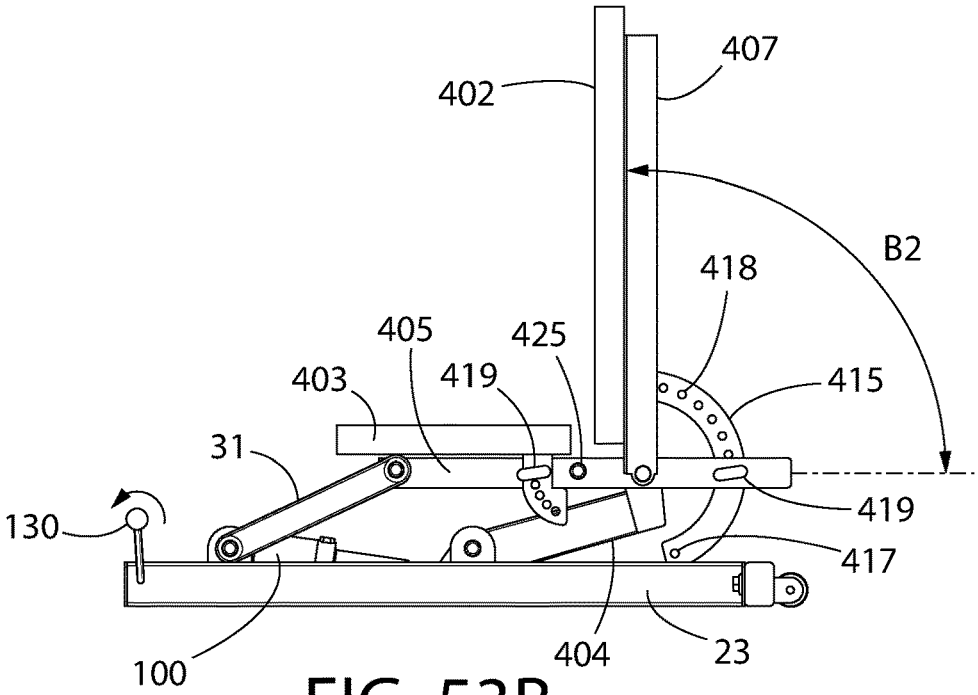
FIG. 53B is a side view thereof with bench in a lower position.
Figure 55A:
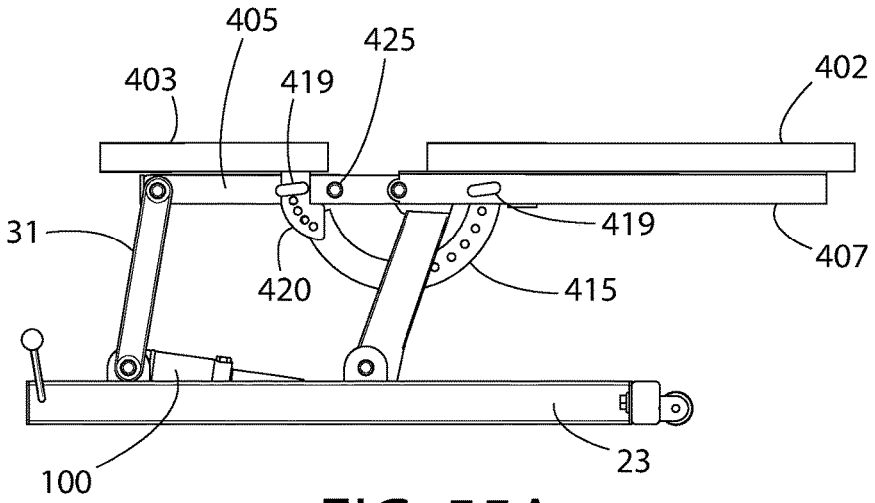
FIG. 55A is a side view of the bench of FIG. 44 in an upper position of the first operating mode with back pad in a third angular orientation.
Figure 55B:
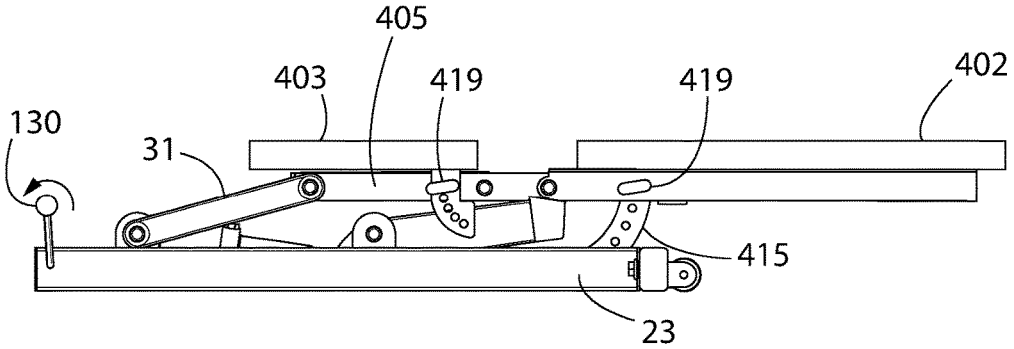
FIG. 55B is a side view thereof with bench in a lower position.
Figure 56A:
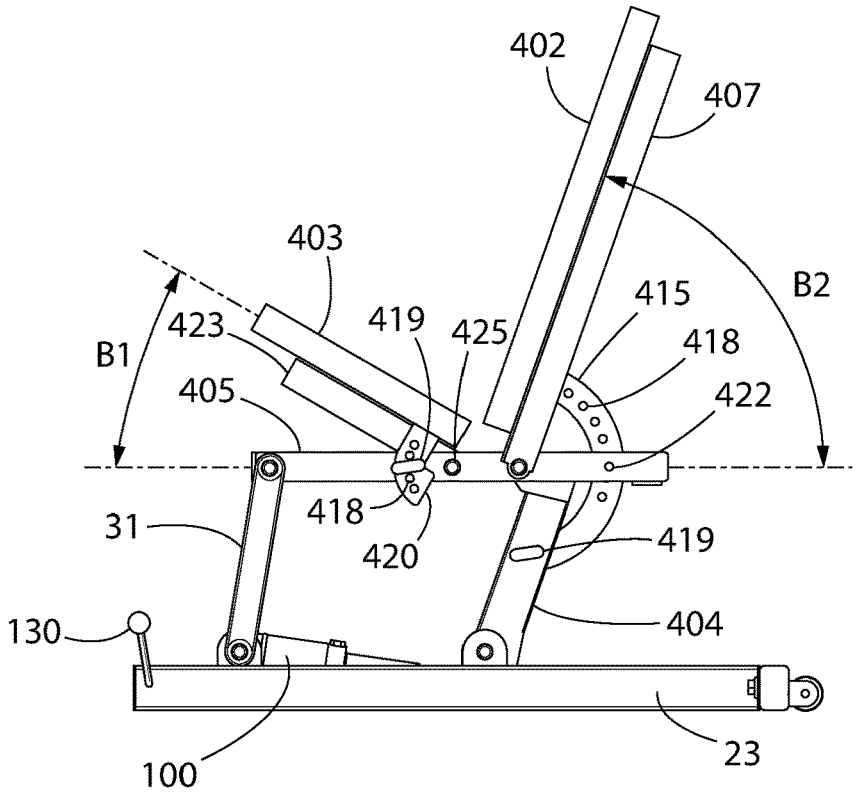
FIG. 56A is a side view of the bench of FIG. 44 in an upper position of the second operating mode with back pad in a first angular orientation.
Figure 56B:
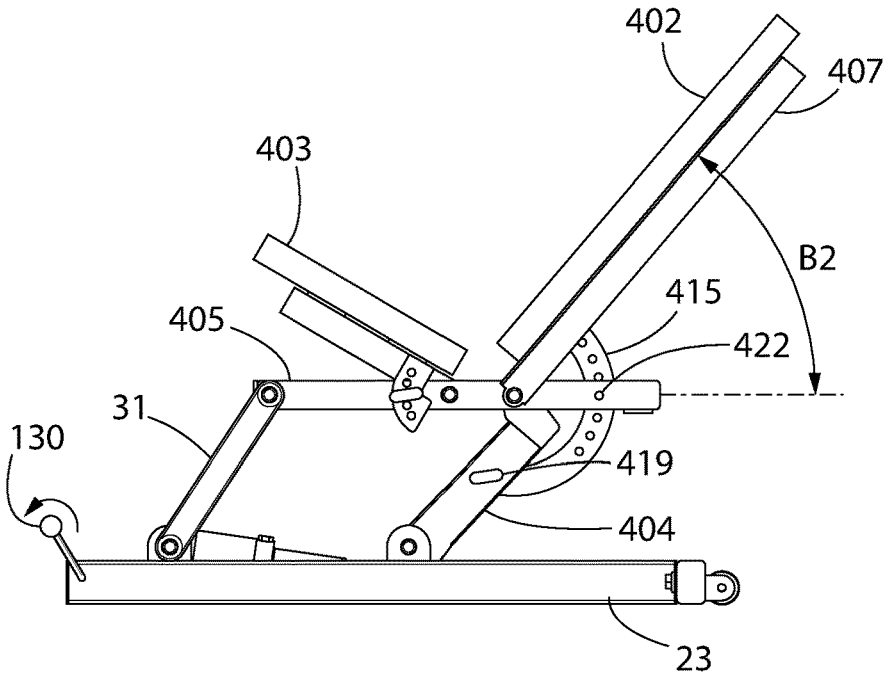
FIG. 56B is a side view thereof with bench in a first intermediate position and back pad in a second angular orientation.
Figure 56C:
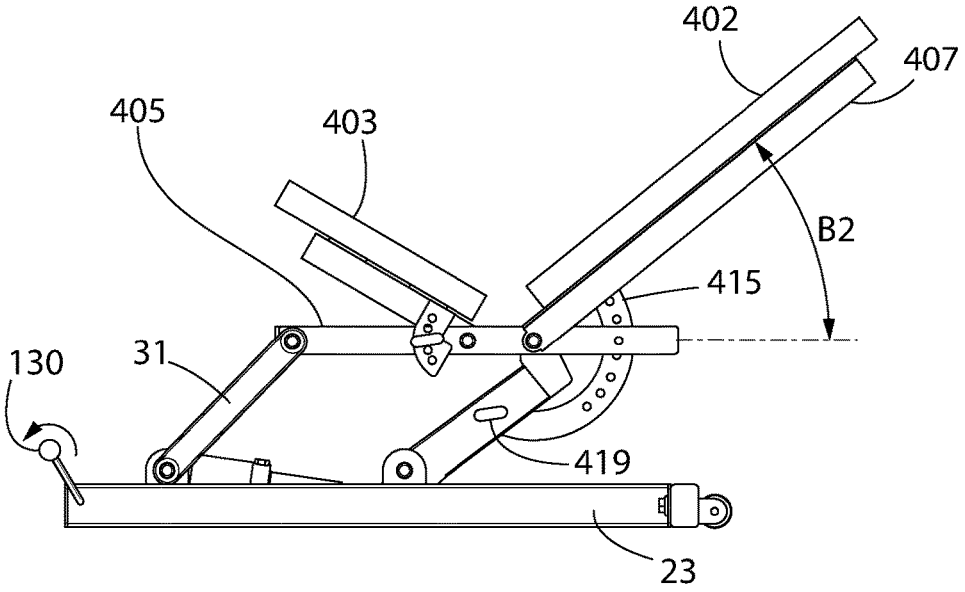
FIG. 56C is a side view thereof with bench in a second intermediate position and back pad in a third angular orientation.
Figure 56D:
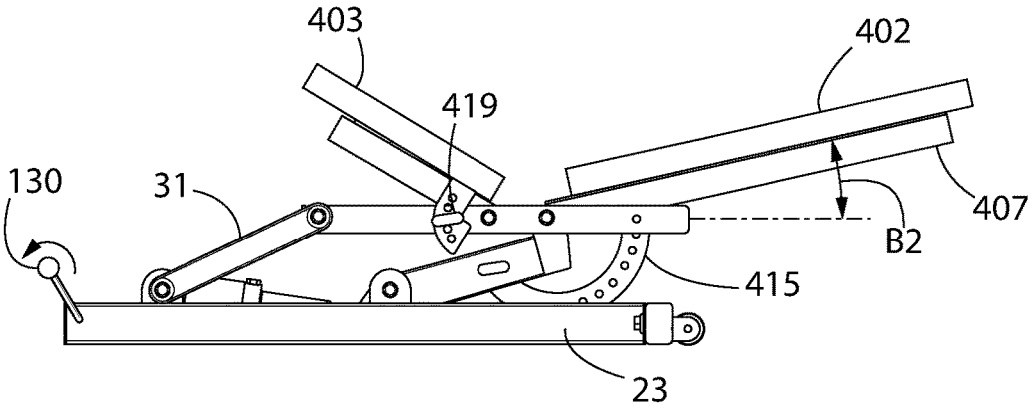
FIG. 56D is a side view thereof with bench in a lower intermediate position and back pad in a fourth angular orientation.
Figures 57, 58:
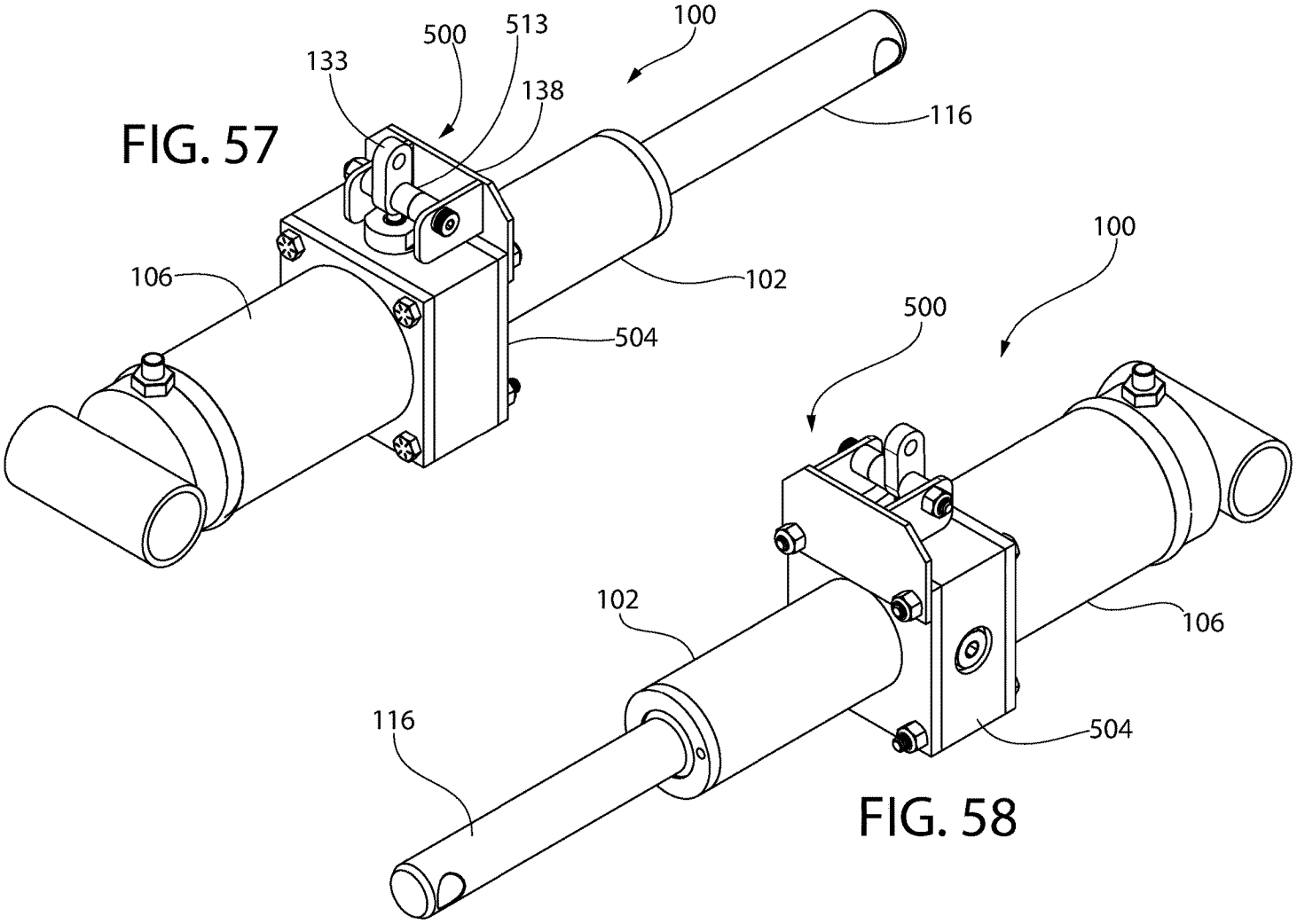
FIG. 57 is a front top perspective view of an alternative hydraulic cylinder assembly according to another embodiment including a hydraulic cylinder, accumulator, and flow control valve assembly.
FIG. 58 is a rear top perspective view thereof.
Figure 59:
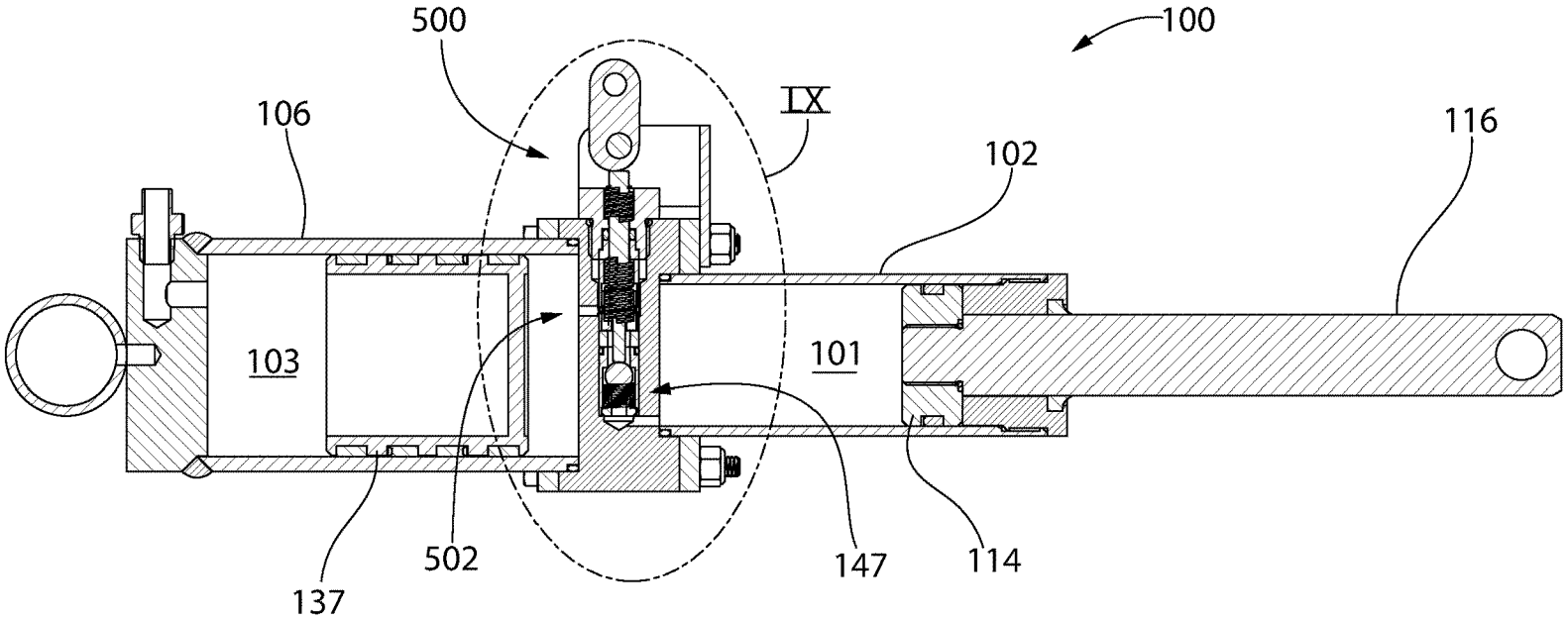
FIG. 59 is a side cross sectional view thereof.

The adjustable weight lifting bench 400 has two modes of operation as noted above. In the first operating mode, the back pad 402 is automatically maintained in the same angular orientation when the bench moves from the upper exercise position to the lower escape position of the bench via activation of foot lever 130. This accomplished by inserting the lock pin 419 for the back pad 402 in a first location through the support rail 405 which always remains parallel to the floor or ground regardless of the operating mode selected. This first pin location is shown for example in FIGS. 44, 48, and 53A-55B. The user first manually selects the desired angle B2 of the back pad 402 in relation to the support rail 405 corresponding to the desired weight lifting routine prior to exercise. Lock pin 419 is inserted through each of one of the series of locking holes 418 in the back pad support bracket 415 which has been concentrically aligned with the pair of laterally spaced apart pin holes 422 in the opposing lateral sides of the horizontal support rail 405 to lock the bracket 415 in position on the support rail 405. The angle of the back pad 402 has a full range of motion from 90 degrees vertical to 0 degrees horizontal for a variety of exercises. When the back pad angle B2 is increased beyond 90 degrees, the slots 411 in the rear strut 404 allows the back pad support bracket 415 to pass through the strut without interference. FIGS. 53A-B shows a military press position in which angle B2 is 90 degrees. FIGS. 55A-B shows a flat press position in which the back pad angle B2 is 0 degrees. And FIGS. 54-54B shows one of several intermediate angular positions afforded by the series of locking holes 418 in which the back pad angle B2 is between 90 and 0 degrees (e.g. 50 degrees, etc.). Regardless of the bench pad configuration selected by the user, it bears noting that the back pad angle B2 remains constant during the entire descent motion of the bench pad 401 in the first operating mode. The seat pad angle B1 selected by the user also remains constant during descent.

In the second operating mode, the back pad 402 has dynamically adjustable incline positions and automatically changes angular orientation when the bench moves the upper exercise and lower escape positions similar to the incline bench 200. This accomplished by inserting the lock pin 419 for the back pad 402 in a second location through the rear strut 404 instead of the support rail 405. This second pin location is shown for example in FIGS. 49 and 56A-D. Lock pin 419 is inserted through the pair of laterally spaced apart pin holes 421 in the opposing lateral sides of the rear strut 404 and the single pin locking hole 417 to lock the pin 419 to the rear strut (see also FIG. 51). The position of the back pad support bracket 415 to the rear strut remains constant during descent of the bench. This allows the user to automatically adjust the angle of the back pad 402 during the exercise via operation of foot lever 130 of the hydraulic cylinder system disclosed herein. The bench has a range of inclined positions from near 90 degrees vertical to near 0 degrees horizontal. When the foot lever 130 is pressed forward and downward, the angle B2 of the back pad 402 changes and the bench lowers to the floor/ground. FIGS. 56A to 56D shows various positions from a high incline press to a lower incline press position respectively. Although the back pad angle B2 changes during descent of the bench, the seat pad angle B1 selected by the user remains constant starting in FIG. 56A and ending in FIG. 56D.

It bears further noting that any of the bench pads and bench pad sub-frame disclosed herein which may include the bench descent control and auto-return mechanisms may be provided independently of any weight lifting frame with weight rests. Accordingly, the invention is expressly not necessarily limited to the presence of the weight lifting frame in order to possess full functionality and the various features associated with the bench pad assembly described herein.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A hydraulic cylinder assembly comprising:

a hydraulic cylinder containing a hydraulic fluid;

an accumulator in fluid communication with the hydraulic cylinder, the accumulator containing a pressurized compressible fluid; and a flow control valve assembly interposed in a flow path between the hydraulic cylinder and the accumulator, the flow control valve configured and operable to control flow of the hydraulic fluid exchanged between the hydraulic cylinder and accumulator;

the flow control valve including an axially reciprocating piston defining a flow control orifice and an axially movable plunger having an operating end and an opposing working end, the working end being received in the flow control orifice and positionable between a first axial position and a second axial position relative to the flow control orifice;

wherein the working end of the plunger defines a first flow area when the plunger is in the first axial position and a second flow area smaller than the first flow area when the plunger is in the second axial position.

2. The cylinder assembly according to claim 1, wherein the working end of the plunger comprises a terminal end segment having a first diameter and an intermediate segment adjoining the terminal end segment and having a second diameter larger than the terminal end segment, wherein the first flow area is defined when the terminal end segment is positioned in the flow control orifice and the second flow area is defined when the terminal end segment is positioned in the flow control orifice.

3. The cylinder assembly according to claim 2, wherein the piston is axially movable between: (i) a first axial position which forms the first axial position of the plunger and first flow area, and (ii) a second axial position which forms the second axial position of the plunger and the second flow area.

4. The cylinder assembly according to claim 3, further comprising a spring which biases the piston towards the first position.

5. The cylinder assembly according to claim 1, wherein the piston and the plunger are coaxially aligned and slideably disposed in an elongated axial central bore of the flow control valve.

6. The cylinder assembly according to claim 5, wherein the flow control valve further comprises a hydraulic cylinder port fluidly coupling the axial central bore to the hydraulic cylinder and an accumulator port fluidly coupling the axial central bore to the accumulator.

7. The cylinder assembly according to claim 6, wherein the piston is alternatingly movable to block or unblock the accumulator port when the piston reciprocates.

8. The cylinder assembly according to claim 1, further comprising a ball check valve, the check valve including an annular seat, a ball removably disposed on the seat and coaxially aligned with the plunger, and a spring biasing the ball into engagement with the seat.

9. The cylinder assembly according to claim 7, wherein the plunger is alternatingly movable between (i) a lower unblocking position in which the working end of the plunger engages and unseats the ball from the annular seat to permit flow through the check valve, and (ii) an upper blocking position in which the ball is seated to block flow through the check valve.

10. A hydraulic cylinder assembly comprising:

a hydraulic cylinder containing a hydraulic fluid;

an accumulator in fluid communication with the hydraulic cylinder, the accumulator containing a pressurized compressible fluid;

a block manifold disposed between the hydraulic cylinder and accumulator, the block manifold comprising an axial central bore defining a centerline, a hydraulic cylinder port fluidly coupling the central bore to the hydraulic cylinder, and an accumulator port fluidly coupling the central bore to the accumulator, the bore and ports collectively forming a hydraulic fluid flow path between the hydraulic cylinder and the accumulator;

a check valve disposed in the central bore and comprising an annular valve seat and a check ball biased into removable engagement with the valve seat by a check spring;

a reciprocating piston disposed in the central bore and axially movable between a first proximal position nearest the check valve and a second distal position farthest from the check valve, the piston including a flow control orifice and internal flow control cavity in fluid communication with the flow control orifice;

a plunger disposed in the central bore and axially movable between first and second axial positions, the plunger having an operating end and an opposing working end inserted through the flow control orifice and engageable with the check ball;

wherein moving the plunger from a first axial position to a second axial position causes the working end of the plunger to disengage the check ball from the valve seat to open the flow path from the hydraulic cylinder to the accumulator.

11. The hydraulic cylinder according to claim 10, wherein moving the plunger from the second axial position to the first axial position causes the check spring to re-engage the check ball with the valve seat to close the flow path from the hydraulic cylinder to the accumulator.

12. The hydraulic cylinder according to claim 10, wherein the piston includes circumferentially spaced apart first lateral flow orifices extending through sidewalls of the piston from the internal flow control cavity, the internal flow control cavity and first lateral flow orifices being in fluid communication with the accumulator port when the piston is in the proximal position and out of fluid communication with the accumulator port when the piston is in the distal position.

13. The hydraulic cylinder according to claim 12, wherein the piston is slideably disposed in a tubular outer sleeve fixedly mounted in the central bore and having a central passage extending therethrough.

14. The hydraulic cylinder according to claim 13, wherein the outer sleeve includes circumferentially spaced apart second lateral flow orifices extending through sidewalls of the outer sleeve from the central passage, the second lateral flow orifices in fluid communication with the accumulator port.

15. The hydraulic cylinder according to claim 14, wherein the second lateral flow orifices are in fluid communication with first lateral flow orifices of the piston when the piston is in the proximal position and the piston blocks the second lateral orifices when the piston is in the distal position.

16. The hydraulic cylinder according to claim 15, wherein the first lateral flow orifices are disposed in a circumferential slot formed in an outer surface of the piston.

17. The hydraulic cylinder according to claim 16, wherein the circumferential slot is in fluid communication with the accumulator port when the piston is in the proximal position and out of fluid communication with the accumulator port when the piston is in the distal position.

18. The hydraulic cylinder according to claim 10, wherein the piston is biased into the proximal position by a flow control spring disposed in the central bore.

19. The hydraulic cylinder according to claim 18, wherein the plunger is biased into the second position by a spring acting in an opposite direction of the flow control spring.

20. A method for operating a hydraulic cylinder assembly, the method comprising:

providing a hydraulic cylinder assembly including a hydraulic cylinder containing a hydraulic fluid, an accumulator in fluid communication with the hydraulic cylinder and containing a compressible fluid, and a flow control valve assembly interposed in a hydraulic fluid flow path between the hydraulic cylinder and the accumulator, the flow control valve assembly including a reciprocating piston, a plunger, and a check valve collectively forming an open flow path between the hydraulic cylinder and accumulator;

engaging a spring-biased check ball with an annular valve seat of the check valve to form a closed flow path;

moving the plunger from a first axial position to a second axial position;

displacing and disengaging the check ball from the valve seat with the plunger; and opening the flow path via unseating the check ball wherein hydraulic fluid flows from the hydraulic cylinder to the accumulator.

21. The method according to claim 20, wherein the hydraulic fluid pressure is greater in hydraulic cylinder than the accumulator.

22. The method according to claim 21, further comprising moving the piston relative to the check valve from a proximal position to a distal position which closes the hydraulic fluid flow path when the check ball is displaced from the valve seat.

23. The method according to claim 22, wherein when the hydraulic fluid pressure in the hydraulic cylinder and accumulator are balanced, a spring forces the piston from the distal position back to the proximal position which re-opens the hydraulic fluid flow path causing hydraulic fluid to flow from the hydraulic cylinder to the accumulator.

24. The method according to claim 23, wherein when compressible fluid pressure in the accumulator is greater than hydraulic fluid pressure in the accumulator and the plunger returns to the first axial position, the check ball disengages the valve seat and hydraulic fluid flows from the accumulator back to the hydraulic cylinder.

* * * * *